US009799224B2

(12) United States Patent
Okamoto

(10) Patent No.: US 9,799,224 B2
(45) Date of Patent: Oct. 24, 2017

(54) PLATOON TRAVEL SYSTEM

(71) Applicant: DENSO CORPORATION, Kariya, Aichi-pref. (JP)

(72) Inventor: Kazuya Okamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 275 days.

(21) Appl. No.: 14/249,700

(22) Filed: Apr. 10, 2014

(65) Prior Publication Data

US 2014/0316671 A1 Oct. 23, 2014

(30) Foreign Application Priority Data

Apr. 17, 2013 (JP) ..... 2013-86891

(51) Int. Cl.
*G08G 1/00* (2006.01)

(52) U.S. Cl.
CPC ..... *G08G 1/22* (2013.01)

(58) Field of Classification Search
CPC ..... G08G 1/22
See application file for complete search history.

(56) References Cited

U.S. PATENT DOCUMENTS

| | | | | |
|---|---|---|---|---|
| 5,680,122 | A | 10/1997 | Mio | |
| 6,032,097 | A * | 2/2000 | Iihoshi | G08G 1/22 180/168 |
| 2010/0256836 | A1 | 10/2010 | Mudalige | |
| 2010/0256852 | A1 * | 10/2010 | Mudalige | 701/24 |
| 2011/0029358 | A1 | 2/2011 | Hyde et al. | |
| 2011/0184596 | A1 * | 7/2011 | Andreasson | 701/19 |
| 2011/0288754 | A1 * | 11/2011 | Shida | 701/117 |
| 2012/0109421 | A1 * | 5/2012 | Scarola | 701/2 |
| 2013/0041567 | A1 * | 2/2013 | Yamashiro | 701/96 |

FOREIGN PATENT DOCUMENTS

| | | | | |
|---|---|---|---|---|
| JP | 1999-170887 | A | 6/1999 | |
| JP | 2006-261742 | A | 9/2006 | |
| JP | 2007-199939 | A | 8/2007 | |
| JP | 2009-157790 | A | 7/2009 | |
| JP | 2009-157794 | A | 7/2009 | |
| JP | 2009157790 | A * | 7/2009 | G08G 1/00 |

OTHER PUBLICATIONS

U.S. Appl. No. 14/249,729, dated Apr. 10, 2014, Okamoto.
Office Action dated Mar. 3, 2015 issued in corresponding JP patent application No. 2013-86891 (and English translation).
Office Action dated May 18, 2015 issued in co-pending U.S. Appl. No. 14/249,729.
Office Action issued by U.S. Patent Office dated Oct. 19, 2015 in connection with related U.S. Appl. No. 14/249,729.

* cited by examiner

*Primary Examiner* — Yonel Beaulieu
*Assistant Examiner* — Martin Weeks
(74) *Attorney, Agent, or Firm* — Posz Law Group, PLC

(57) ABSTRACT

A platoon travel system organizes a platoon having plural platoon vehicles traveling in two vehicle groups, in which a preset inter-vehicle distance is reserved between each of the platoon vehicles. When a new vehicle joins in the platoon, the platoon travel system adjusts the inter-vehicle distance by decelerating, among all platoon vehicles, deceleration target vehicles that are the platoon vehicles behind a join position in the platoon, which are included in a latter one of the two vehicle groups.

17 Claims, 27 Drawing Sheets

PLATOON TRAVEL SYSTEM

CROSS REFERENCE TO RELATED APPLICATION

The present application is based on and claims the benefit of priority of Japanese Patent Application No. 2013-86891, filed on Apr. 17, 2013, the disclosure of which is incorporated herein by reference.

TECHNICAL FIELD

The present disclosure generally relates to a platoon travel system for performing a platoon travel of two or more vehicles.

BACKGROUND INFORMATION

Platoon travel systems are generally known. For example, a patent document 1 (i.e., Japanese Patent No. 3358403) describes a departure process and a post-departure auto-drive process for a platoon travel control apparatus. When an in-front vehicle, such as a vehicle at the top (or "front) of a platoon, is planning to depart from the platoon, the system may slightly decelerate a self-vehicle, such as the second vehicle from the top of the platoon, and fix its speed so that the self-vehicle cruises at a constant speed. Further, when a joining vehicle is traveling in front of the self-vehicle, the platoon travel control apparatus increases an inter-vehicle distance to the joining vehicle for the ease of joining the other vehicles.

However, if the self-vehicle is the third vehicle or further behind in the platoon, the above-mentioned platoon travel control apparatus controls the self-vehicle to accelerate in order to catch up to the top vehicle and to resume the original formation of the automatic platoon travel.

In a platoon involving many vehicles, each vehicle may have different travel outputs (e.g., different horsepower output), respectively. A high travel output vehicle has a higher travel output than a low travel output vehicle in relative terms. Therefore, the above-mentioned platoon travel control apparatus may position a high travel output vehicle in front of a low travel output vehicle. Further, when traveling under the same travel resistance, the low travel output vehicle consumes more travel energy than the high travel output vehicle.

Therefore, the above-mentioned platoon travel control apparatus accelerates the low travel output vehicle to a speed that is equal to or greater than a normal platoon travel speed when the low travel output vehicle is traveling as a follow/behind vehicle in the platoon. As such, the travel energy of the low travel output vehicle is wasted. In other words, by the acceleration of the low travel output vehicle under control of the above-mentioned platoon travel control apparatus, the energy consumption of the whole platoon may be increased.

Further, the respective vehicles which have participated in the platoon have respectively different remaining energies. Therefore, the above-mentioned platoon travel control apparatus may position a low remaining energy vehicle behind a high remaining energy vehicle. The high and low remaining energies mean that the high remaining energy vehicle has a higher remaining energy than the low remaining energy vehicle in relative terms.

Therefore, the above-mentioned platoon travel control apparatus accelerates the low remaining energy vehicle to a speed that is equal to or greater than the normal platoon travel speed when the low remaining energy vehicle is traveling as a follow/behind vehicle in the platoon. As a result, even when joining in a platoon and performing a platoon travel, the low remaining energy vehicle may not be able to extend its travel distance due to the low energy consumption reduction effects.

SUMMARY

It is a first object of the present disclosure to provide the platoon travel system that prevents deterioration of whole platoon energy consumption. Further, a second object of the present disclosure is to provide the platoon travel system that realizes an extended travel distance of the vehicles participating in the platoon.

In an aspect of the present disclosure, the platoon travel system organizes plural vehicles into platoon vehicles and performing a platoon travel of the platoon vehicles at a preset travel speed and a preset inter-vehicle distance from each other. The platoon travel system includes a platoon organization unit that organizes a platoon by acquiring, from each of the plural vehicles, projection area information indicative of a projection area of each vehicle and positions, from a top of the platoon, vehicles in a larger projection area vehicle first manner. The platoon travel system also includes an inter-vehicle distance adjustment unit adjusting an inter-vehicle distance between the platoon vehicles at a vehicle joining time or at a vehicle departure time, the vehicle joining time defined as when a joining vehicle joins in the platoon in which the inter-vehicle distance is adjusted to the preset inter-vehicle distance by decelerating decel-target vehicles in the platoon which are traveling behind a join position that is reserved for the joining vehicle, and the vehicle departure time defined as when a departing vehicle departs from the platoon in which the inter-vehicle distance is adjusted to the preset inter-vehicle distance by decelerating decel-target vehicles in the platoon which are traveling ahead of the departing vehicle.

When a new vehicle joins in the platoon, it is necessary to reserve a join-in space (i.e., a vacant position) for the new vehicle which joins in the platoon as the joining vehicle. When a vehicle departs from the platoon, a post-departure space (i.e., a vacant position) will be left at a position which has been occupied by the departing vehicle. Therefore, in the present disclosure, the platoon vehicles constituting the platoon are decelerated for the adjustment of the inter-vehicle distance at the vehicle joining/departure time. In such manner, the deterioration of the energy consumption by the whole platoon is prevented in comparison to a case in which the platoon vehicles are accelerated for the adjustment of the inter-vehicle distance. In addition, the travel distances of the platoon vehicles are extended in the above-described manner.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
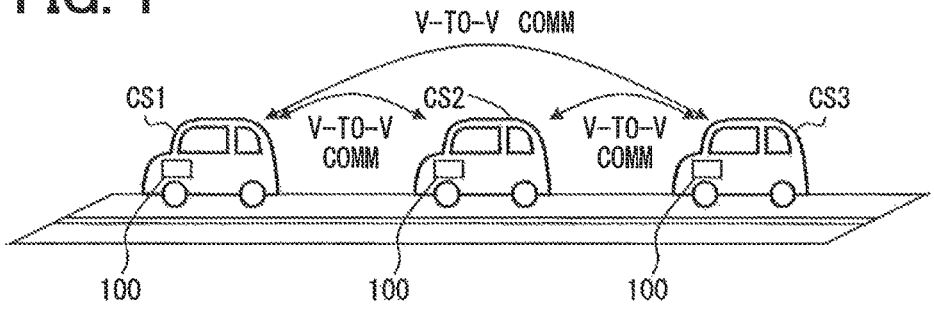
FIG. 1 is an illustration of the platoon travel system in an embodiment of the present disclosure.

Embodiments of the present disclosure are described based on the drawings. As shown in FIG. 1, a platoon travel system is a system for organizing a platoon travel of plural vehicles at a preset speed with a preset inter-vehicle distance from between each of the plural vehicles. Therefore, platoon vehicles which have participated in a platoon travel at a constant speed (i.e., at a preset travel speed set up in advance), although there may be some acceleration and deceleration. Therefore, it is a proper description that the platoon consisting of plural vehicles in the present embodiment is traveling at a constant speed.

A platoon travel system may also be designated as a system for organizing and performing platoon travel of plural vehicles, in which a platoon of vehicles is organized/formed by plural platoon vehicles and a leader vehicle in the platoon is followed by follower vehicles based on control information that is transmitted/passed among the platoon vehicles. In other words, the platoon travel is a group of traveling vehicles, i.e., plural vehicles traveling in one group. Therefore, the platoon travel can be put in another way as a travel of vehicle groups. The vehicles (e.g., CS1-CS3, etc.) which adopt the platoon travel system are provided with an on-board unit 100 respectively. In the present embodiment, the system adopts the multi-master method in which the platoon travel control is performed by all of the platoon vehicles respectively serving as a master of the platoon.

The platoon in the present embodiment consists of the first vehicle group containing plural vehicles and the second vehicle group containing plural vehicles. Further, the body size of the vehicles in the first vehicle group and the body size of the vehicles in the second vehicle group are different. In other words, the vehicles having a predetermined body size range (i.e., in the first range) belong to the first vehicle group, and, on the other hand, the vehicles having a second body size range, which defines a smaller body size than the first range, belong to the second vehicle group. Therefore, the vehicles in the first vehicle group have substantially the same body size, and, similarly, the vehicles in the second vehicle group have substantially the same body size. However, the body size differs between the vehicles in the first vehicle group and the vehicles in the second vehicle group. The vehicles participating in the platoon may be hereafter called platoon vehicles. A "vehicle group" may also be called, simply, as a "group".

The body size of the vehicles may also be referred to as a projection area (i.e., size) of the vehicles. A projection area here is the area size calculated as a product of the width of a vehicle and an overall height (i.e., a length from a ground surface to the highest point of the vehicle).

Figure 8:
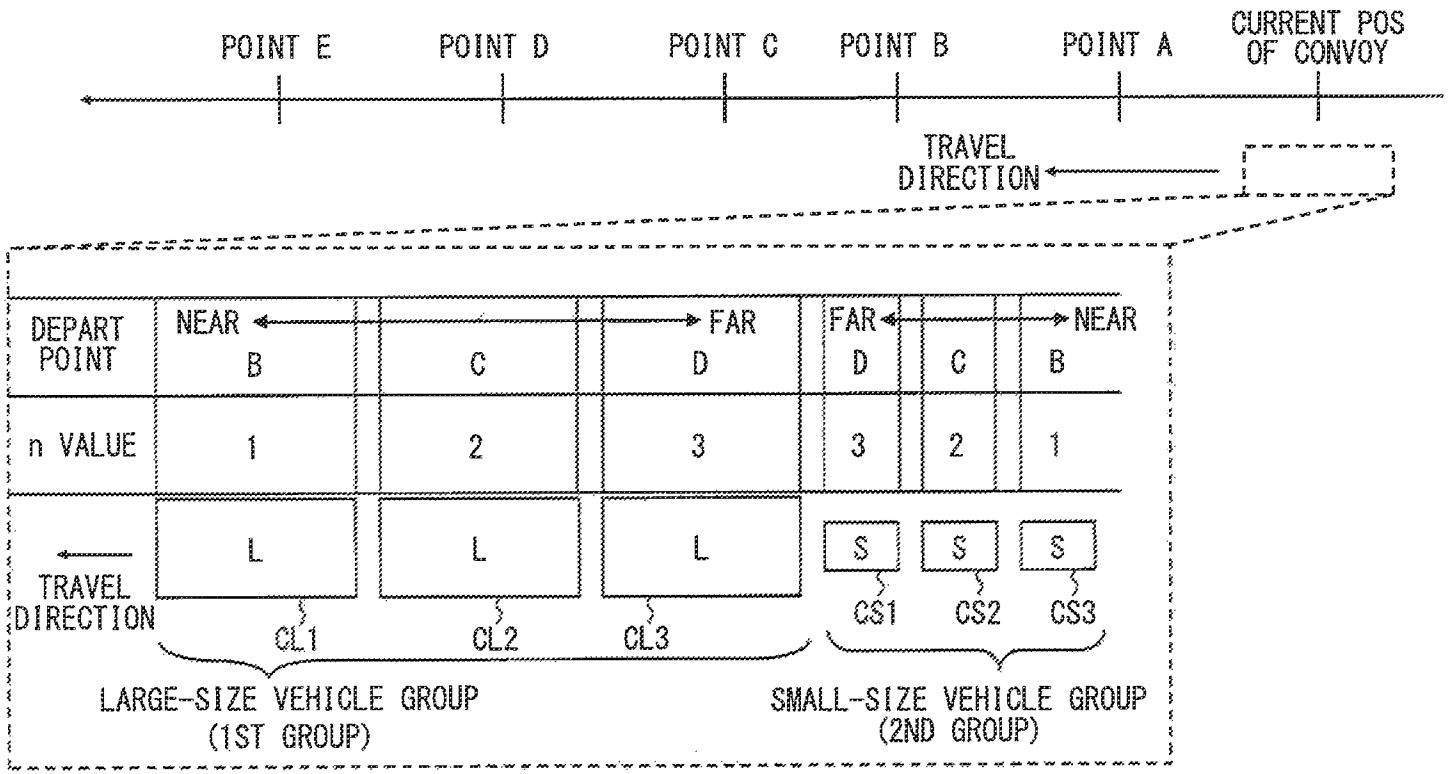
FIG. 8 is an illustration of the platoon that includes two different types of vehicle groups.

According to the present embodiment, an example of the platoon is shown in FIG. 8. This platoon includes a large-size vehicle group (i.e., the first vehicle group/the first group) containing three the large-size vehicles CL1-CL3 and a small-size vehicle group (i.e., the second vehicle group/the second group) containing three the small-size vehicles CS1-CS3. However, the present disclosure is not limited to such configuration. For example, it is possible to have the platoon formed as a combination of a medium-size vehicle group (i.e., the first vehicle group/the first group) including plural medium-size vehicles and the small-size vehicle group (i.e., the second vehicle group/the second group) containing plural the small-size vehicles. Similarly, it is possible to have the platoon formed as a combination of a large-size vehicle group (i.e., the first vehicle group/the first group) including plural the large-size vehicles and a medium-size vehicle group (i.e., the second vehicle group/the second group) containing plural medium-size vehicles. Further, the number of vehicles in each vehicle group is not limited to three. Furthermore, the number of vehicles in the first vehicle group and the number of vehicles in the second vehicle group may be different. A large-size vehicle may include a truck, a bus, and the like. A medium-size vehicle may include a large-size passenger vehicle and the like. A small-size vehicle may include a medium-size passenger vehicle, a small-size passenger vehicle and the like.

The platoon shown in FIG. 8 passes through a point A, a point B, a point C, a point D, and a point E from the current position of the platoon. Therefore, the travel route of the platoon includes the current position, the point A, the point B, the point C, the point D, and the point E. The large-size vehicle CL1 departs from the platoon at the point B. The large-size vehicle CL2 departs from the platoon at the point C. The large-size vehicle CL3 departs from the platoon at the point D. The small-size vehicle CS1 departs from the platoon at the point D. The small-size vehicle CS2 departs from the platoon at the point C. The small-size vehicle CS3 departs from the platoon at the point B. Further, a value "n" in FIG. 8 will be explained in detail later.

Figure 2:
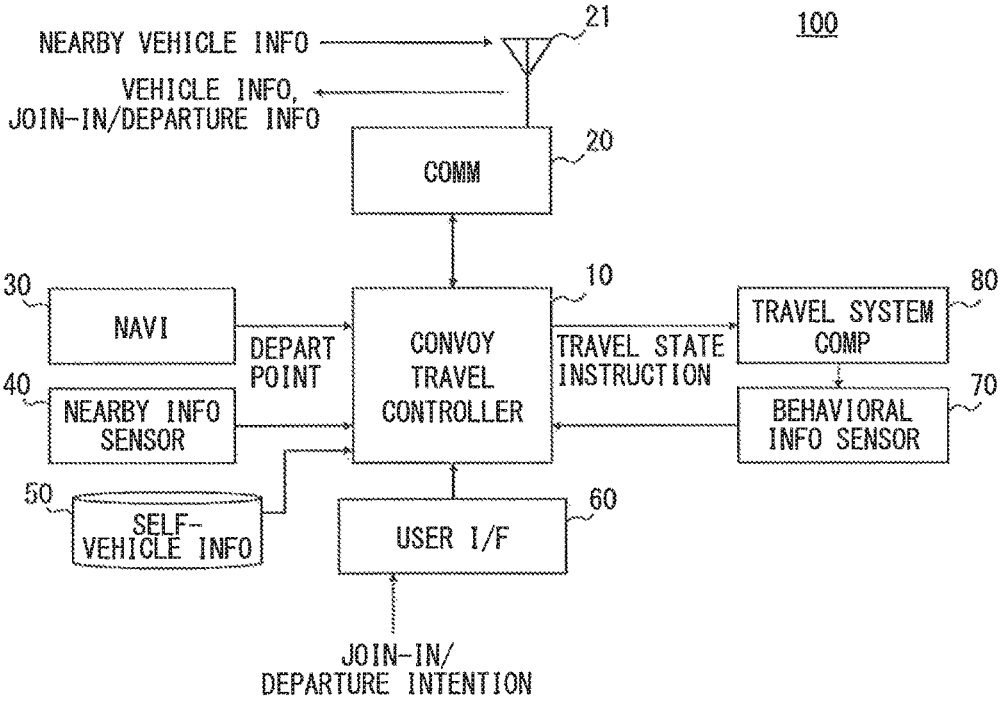
FIG. 2 is a block diagram of an on-board unit in an embodiment of the present disclosure.

Here, the configuration of the on-board unit 100 is explained with reference to FIG. 2. The on-board unit 100 is provided with a platoon travel controller 10, a communication device 20, a nearby information sensor 40, a memory unit 50, a user interface 60, a behavioral information sensor 70, a travel system component 80, and the like.

The platoon travel controller 10 is a computer provided with CPU, ROM, RAM (none illustrated), together with other parts. Hereafter, the platoon travel controller 10 may simply be referred to as an ECU 10. The ECU 10 performs the platoon travel control by using the CPU which executes a program memorized by the ROM with a help of a temporary storage function of the RAM and by controlling the communication device 20 and the travel system component 80 according to such platoon travel control. Further, the ECU 10 instructs a travel state to the travel system component 80, for example. Further, the details of the ECU 10 are explained later.

The communication device 20 (i.e., a communication unit in the claims) is provided with an antenna 21 (i.e., a communication unit in the claims), and performs wireless communications with the vehicles which are around a self-vehicle (i.e., with nearby vehicles), and functions as a transmitter and a receiver. In other words, the communication device 20 is provided with a function as a vehicle-to-vehicle communication device, for example, making it possible to transmit and receive information to/from other vehicles by DSRC (i.e., Dedicated Short-Range Communications). Further, the communication device 20 may also be implemented as a device that is capable of performing both of a simultaneous transmission communication, which transmits the same information to all vehicles in a communication range, for example and an "individual" communication which specifies a communication partner. The communication device 20 receives, from the nearby vehicles via the antenna 21, nearby-vehicle information of the nearby vehicles, join-in information of the nearby vehicles, and departure information of the nearby vehicles, and outputs the various received information to the ECU 10. The communication device 20 transmits, to the nearby vehicles via the antenna 21, vehicle information, the join-in information, the departure information and the like of the self-vehicle according to the instructions from the ECU 10. Further, the communication device 20 may also be provided with, in addition to the function as a vehicle-to-vehicle communication device, a function as a road-to-vehicle communication device.

Further, the nearby vehicles are respectively defined as a vehicle which adopts the platoon travel system and is positioned around the self-vehicle. Therefore, the nearby vehicles are provided with the on-board unit 100. Further, the nearby vehicles not only include the vehicles that have participated in the platoon but also include the vehicles which have not yet participated in the platoon.

The above-mentioned vehicle information includes the information which shows the projection area of the self-vehicle (i.e., the projection area information), the information which shows a guidance route of the self-vehicle, and the like. Further, the vehicle information may include the information which shows a depart point (i.e., the depart point information) in addition to the information which shows the projection area of the self-vehicle and the information which shows the guidance route of the self-vehicle. The nearby-vehicle information is, in other words, the self-vehicle information of each of the nearby vehicles which is output from each of the nearby vehicles. The join-in information is the information which shows a join-in intention of the self-vehicle for joining in the platoon, which is in FIG. 3 and in other drawings, for example, designated as self-vehicle join-in intention information. The departure information is the information which shows a departure intention of the self-vehicle for departing from the platoon, which is in FIG. 3 and in other drawings, for example, designated as self-vehicle departure intention information. The departure information of the nearby vehicle is designated as other vehicle departure intention information in FIG. 3 and in other drawings. The join-in information of the nearby vehicle is designated as other vehicle join-in intention information in FIG. 3 and in other drawings.

Platoon information to be explained later includes the information which shows the projection area of each of the platoon vehicles, the information which shows a travel route (i.e., the guidance route) of each of the platoon vehicles, the information which shows a position of each of the platoon vehicles in the platoon, and the information which shows a depart point of each of the platoon vehicles. Further, the platoon information includes the information which shows the travel route of the platoon, the information which shows the number of vehicles in the first vehicle group, the information which shows the number of vehicles in the second vehicle group, and the like. The platoon information is the information shared among all platoon vehicles. The re-organization request information which is explained later is the information which requests re-organization of the platoon.

A navigation device 30 detects a current position of the self-vehicle, calculates a guidance route from the detected current position to a destination with reference to map and the like, and performs a travel guidance based on the calculated guidance route. The navigation device 30 computes a depart point where the self-vehicle departs from the platoon based on the guidance route of the self-vehicle and the travel route of the platoon. Then, the navigation device 30 outputs, to the ECU 10, the information which shows the guidance route, the information which shows the depart point for the departure from the platoon, and the like.

The ECU 10 may also compute the travel route of the platoon based on the guidance route of the self-vehicle and the nearby-vehicle information (i.e., travel routes of the nearby vehicles) acquired from the nearby vehicles. Further when the platoon information is received from the nearby vehicles, the ECU 10 is enabled to acquire (i.e., to calculate) the travel route of the platoon from such platoon information. In such a case, the ECU 10 outputs the calculated travel route of the platoon to the navigation device 30. Since such a calculation of the travel route of the platoon is a well-known matter, detailed explanation of such calculation is omitted from the embodiment.

The information which shows a depart point may be output to the ECU 10 from the user interface 60 which is explained later in detail. In other words, a depart point may be specified by a vehicle occupant who operates the user interface 60. In the present embodiment, the information which shows a depart point is output to the ECU 10 when the vehicle occupant operates the user interface 60. Further, a depart point that is output from the user interface 60 is used by the ECU 10. The ECU 10 may also compute a depart point based on the guidance route of the self-vehicle and the travel route of the platoon.

Further, the navigation device 30 of the self-vehicle may compute, if the self-vehicle is already a platoon vehicle, a depart point of a joining vehicle which is newly joining in the platoon. In such case, the navigation device 30 computes a depart point of the joining vehicle based on the guidance route included in the vehicle information of the joining vehicle and the travel route of the platoon in the platoon information of the current platoon. The navigation device 30 outputs, to the ECU 10, the computed information which shows a depart point of the joining vehicle. If the ECU 10 receives the information which shows a depart point of the joining vehicle, the ECU 10 updates the platoon information by adding the information which shows a depart point of the joining vehicle to the current platoon information.

The nearby information sensor 40 detects the existence of vehicles before and behind the self-vehicle as well as an inter-vehicle distance to each of those vehicles, which may be implemented as radar, a camera, and the like. The nearby information sensor 40 outputs the information which shows a detection result to the ECU 10.

The nearby information sensor 40 may further detect a change of the detected inter-vehicle distance, and the sensor 40 may output the information which shows the change of the detected inter-vehicle distance to the ECU 10. The ECU 10 disposed in each of the platoon vehicles transmits the information which shows the inter-vehicle distance and the information which shows the change of the inter-vehicle distance to the other platoon vehicles other than the self-vehicle via the communication device 20 and the antenna 21. Further, the control information includes such an inter-vehicle distance and the change of the inter-vehicle distance, together with other information.

The memory unit 50 is a device for memorizing the vehicle information and the like, and may be implemented as a hard disk or the like.

The user interface 60 is disposed in a passenger compartment of a vehicle, which may be operated by the vehicle occupant. That is, the user interface 60 may be, for example, a device such as a joystick, a touch panel disposed on a display device, and the like. Further, the display device on which the touch panel is disposed may be implemented as a display device which is capable of displaying an instrument panel, map data, and the like.

The vehicle occupant can input (i) information which shows a depart point, (ii) a signal which shows a join-in intention to join in the platoon, (iii) a signal which shows a departure intention to depart from the platoon, and the like by operating a device of the user interface 60, for example. The ECU 10 instructs, to the communication device 20, transmission of the join-in information which shows a join-in intention to join the platoon, if the signal which shows a join-in intention is input by the user interface 60. The ECU 10 instructs, to the communication device 20, transmission of the departure information including (i) the information which shows a departure intention from the platoon and (ii) the information which shows a depart point outputted from the navigation device 30, if the signal which shows a departure intention by the user interface 60 is input by the user interface 60.

The behavioral information sensor 70 is used for detecting an action of the self-vehicle, and includes, for example, an acceleration sensor which detects an acceleration applied to the self vehicle along a front-rear direction, a vehicle speed sensor which detects a travel speed (i.e., a vehicle speed) of the self-vehicle, a steering angle sensor which detects a steer angle relative to a straight-travel direction of the self-vehicle, a brake sensor which detects an amount of press of a brake pedal, and the like. The behavioral information sensor 70 outputs the information which shows detection results of these sensors to the ECU 10. Further, the control information may include the information which shows the above-described detection results.

A device having a numeral 80 is a travel system component, which includes a drive device, a brake device, and the like. In other words, the numeral 80 indicates devices such as an engine, a motor generator, a brake, a transmission, and the like in the self-vehicle.

Figure 3:
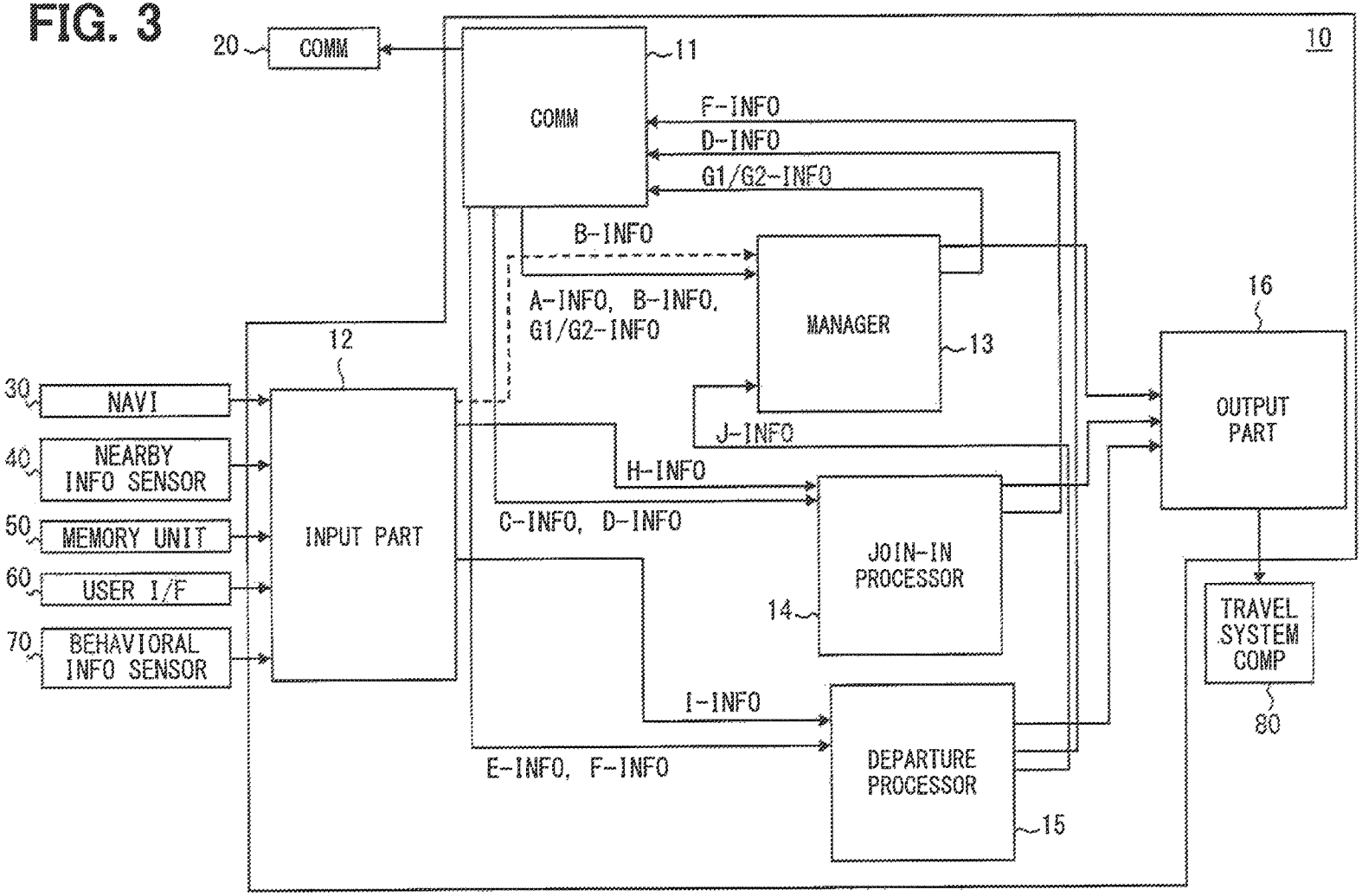
FIG. 3 is a block diagram of the platoon travel controller in an embodiment of the present disclosure.
Figure 4:
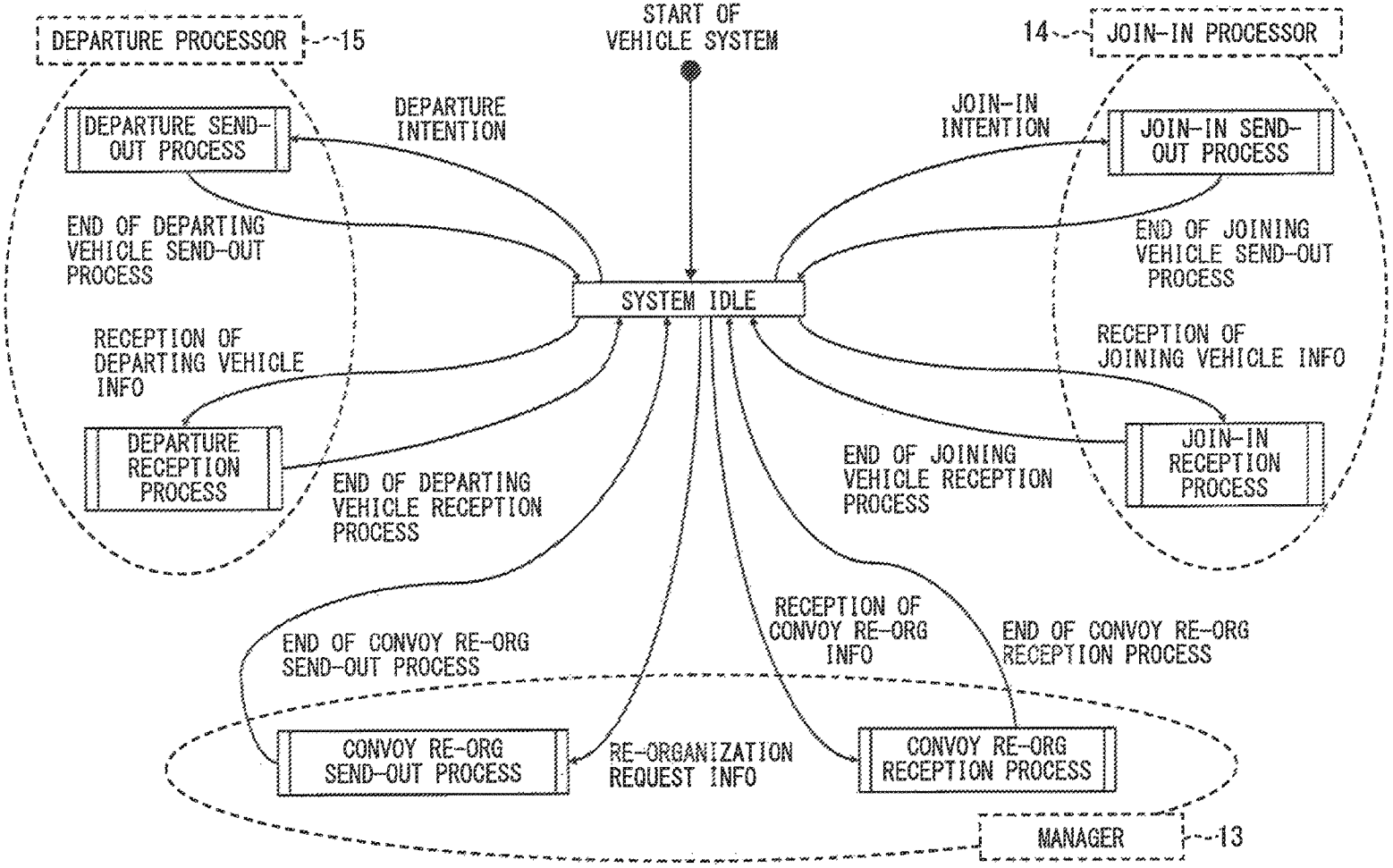
FIG. 4 is a state transition diagram of the processing operation of the platoon travel controller.

Here, explanation of the ECU 10 is provided with reference to FIG. 3 and FIG. 4. The ECU 10 includes, as functional blocks, a communication part 11, an input part 12, a platoon state management part 13, a join-in control processing part 14, a departure control processing part 15, and an output part 16. The ECU 10 performs the platoon travel control, as shown in FIG. 3 and in other drawings, by transmitting and receiving the information to/from each of these parts. The platoon state management part 13 may also be referred to as a manager 13 hereafter. The join-in control processing part 14 may also be referred to as a join-in processor 14 hereafter. The departure control processing part 15 may also be referred to as a departure processor 15 hereafter.

The communication part 11 is connected to the communication device 20, and, based on a transmission instruction from each of the various parts, instructs, to the communication device 20, transmission of the vehicle information of the self-vehicle and the like, or acquires the nearby-vehicle information and the like which is received by the communication device 20. The communication part 11 outputs the information acquired from the communication device 20 to each of the various parts, and/or holds the acquired information. When the communication part 11 holds the information acquired from the communication device 20, each of the various parts acquires the currently held information by polling in the communication part 11.

The communication part 11 outputs, as shown in FIG. 3, a variety of information regarding the platoon information (A-info), the re-organization request information (B-info), the other vehicle join-in intention information (C-info), pre-join-in process/during-join-in process information (i.e., D-info), as well as the other vehicle departure intention information (E-info), pre-departure process/during-departure process information (F-info), and pre-re-organization process information (G1-info), during-re-organization process information (G2-info). Further, to the communication part 11, the variety of information is input such as the pre-departure process/during-departure process information, the pre-join-in process/during-join-in process information, and the pre-re-organization process/during-re-organization process information. Among the above, the pre-join-in process/during-join-in process information is the information processed in the flowcharts in FIG. 5 to FIG. 7. The pre-departure process/during-departure process information is the information processed in the flowchart in FIG. 10. The pre-re-organization process information and the during-re-organization process information are the information processed in the flowchart in FIG. 12. Each of the above-described information may include further detail information, respectively.

The input part 12 is a device to which the variety of information is input from the navigation device 30 and from which the input information is output to each of the various parts. The input part 12 outputs the re-organization request information (B-info), the self-vehicle join-in intention information (H-info), the self-vehicle departure intention information (I-info), and the like, as shown in FIG. 3.

The manager 13 performs a platoon re-organization send-out process and a platoon re-organization reception process, as shown in FIG. 4, the manager 13 outputs the variety of information processed at a time of a pre-re-organization process, the variety of information processed at a time of a during-re-organization process, the drive information for the travel system component 80, and the like. Further, to the manager 13, the re-organization request information, the platoon information, post-departure platoon information (J-info), and the like are input. Regarding the details of the platoon re-organization send-out process and the platoon re-organization reception process, description is provided later with reference to FIG. 12 and the like.

The join-in processor 14 performs a join-in send-out process and a join-in reception process, as shown in FIG. 4. The join-in processor 14 outputs the variety of information processed at a time of a pre-join-in process, the variety of information processed at a time of during-join-in process, the drive information for the travel system component 80, and the like. To the join-in processor 14, the self-vehicle join-in intention information, the other vehicle join-in intention information, the variety of information processed at a time of the pre-join-in process, the variety of information processed at a time of the during-join-in process are input. Regarding the details of the join-in send-out process and the join-in reception process, description is provided later with reference to FIG. 5 and the like.

The departure processor 15 performs a departure send-out process and a departure reception process, as shown in FIG. 4. The departure processor 15 outputs the post-departure platoon information, the variety of information processed at a time of a pre-departure process, the variety of information processed at a time of a during-departure process, the drive information for the travel system component 80, and the like. To the departure processor 15, the self-vehicle departure intention information, the other vehicle departure intention information, the variety of information processed at a time of the pre-departure process, the variety of information processed at a time of the during-departure process are input. Regarding the details of the departure send-out process and the departure reception process, description is provided later with reference to FIG. 10 and the like.

The output part 16 is connected to the travel system component 80, and outputs, to the travel system component 80, the drive information from the manager 13, the join-in processor 14, and the departure processor 15, for providing a brake instruction, a deceleration instruction, and the like.

Here, the processing operation (i.e., the platoon travel control) of the ECU 10 is explained with reference to FIGS. 5 to 16. Further, please also refer to FIG. 3 and FIG. 4, together with the flowchart to be explained in the following regarding the processing operation.

Figure 9:
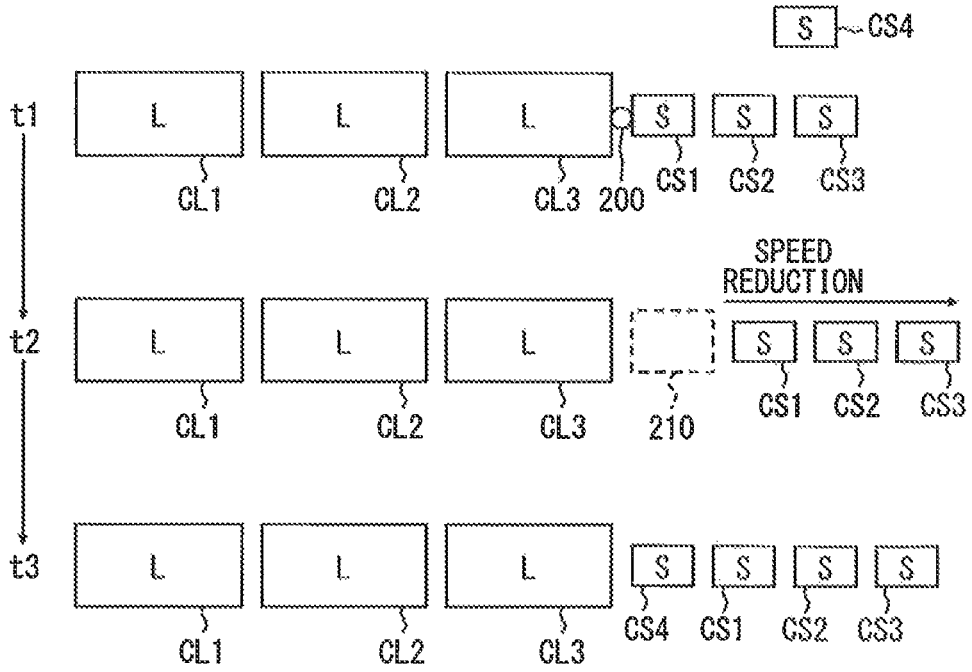
FIG. 9 is an illustration of vehicle behaviors at a time of joining in the platoon that includes two different types of vehicle groups.

First, processing of the ECU 10 at a time of join-in (i.e., a join-in process) is explained with reference to FIGS. 5 to 9. The platoon described in the present embodiment includes, as shown in FIG. 8, the large-size vehicle group (i.e., the first vehicle group) containing three large-size vehicles CL1-CL3 and the small vehicle group (i.e., the second vehicle group) containing three small-size vehicles CS1-CS3. In the following, as shown in FIG. 9, a situation is described as an example in which a small-size vehicle CS4 shows an intention of join-in and the join-in of the small-size vehicle CS4 is already permitted. In other words, in this example, the small-size vehicle CS4 is equivalent to the joining vehicle. Therefore, the vehicle CS4 may be designated as a joining vehicle CS4 hereafter.

Figure 5A:
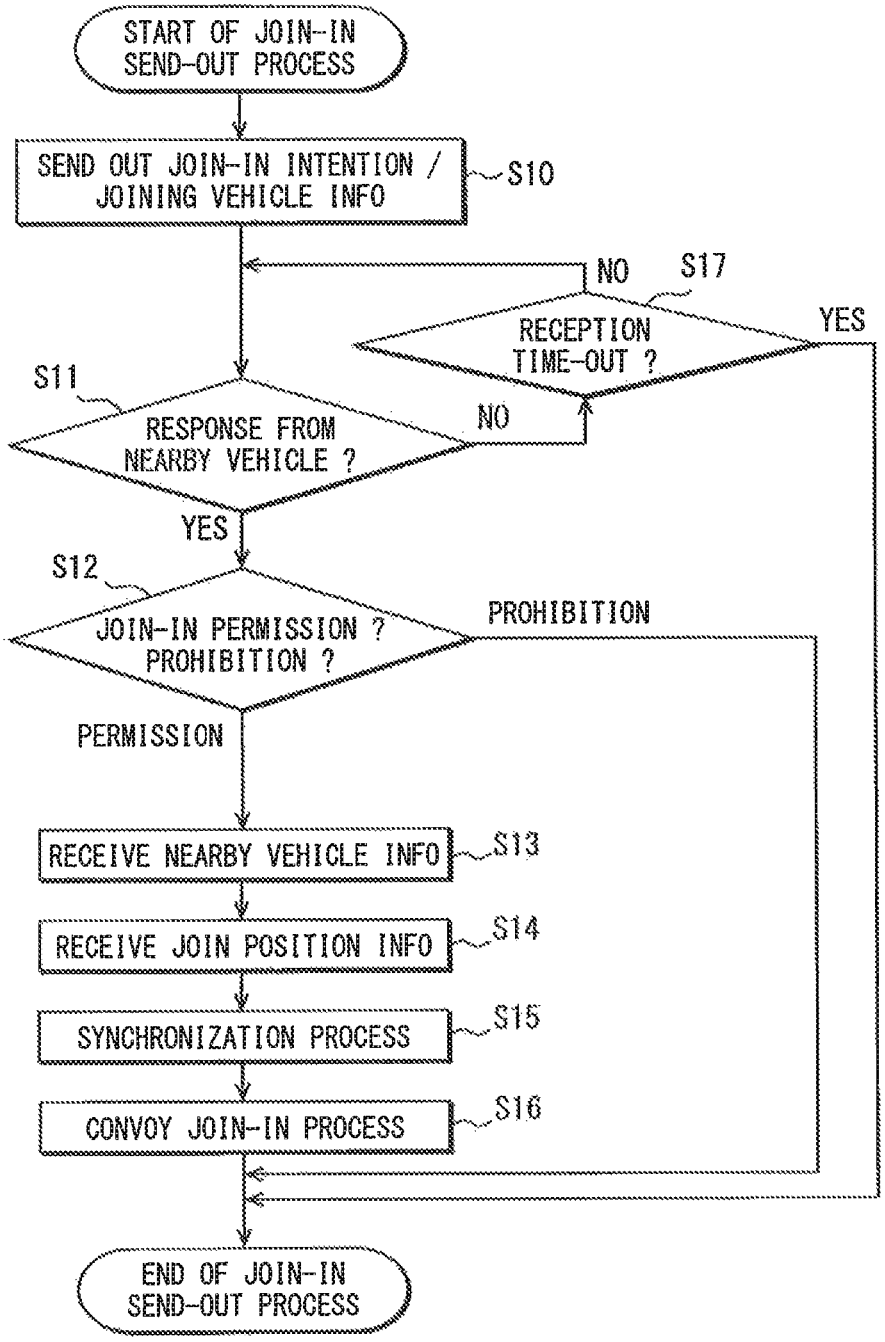
FIGS. 5A/B are flowcharts of join-in related processes by the platoon travel controller.

Steps S10-S17 in FIG. 5A show a join-in send-out process which is performed by the join-in processor 14. When the self-vehicle join-in intention information is input via the input part 12 from the user interface 60, the join-in processor 14 considers and acknowledges that such information is an intention to join in the platoon, and performs the join-in send-out process. Thus, this join-in send-out process is a processing which is performed by the join-in processor 14 of the ECU 10 that is disposed in a vehicle or in vehicles which will join in the platoon from now. In an example of FIG. 9, the process is performed by the join-in processor 14 of the ECU 10 in the joining vehicle CS4.

Figure 5B:
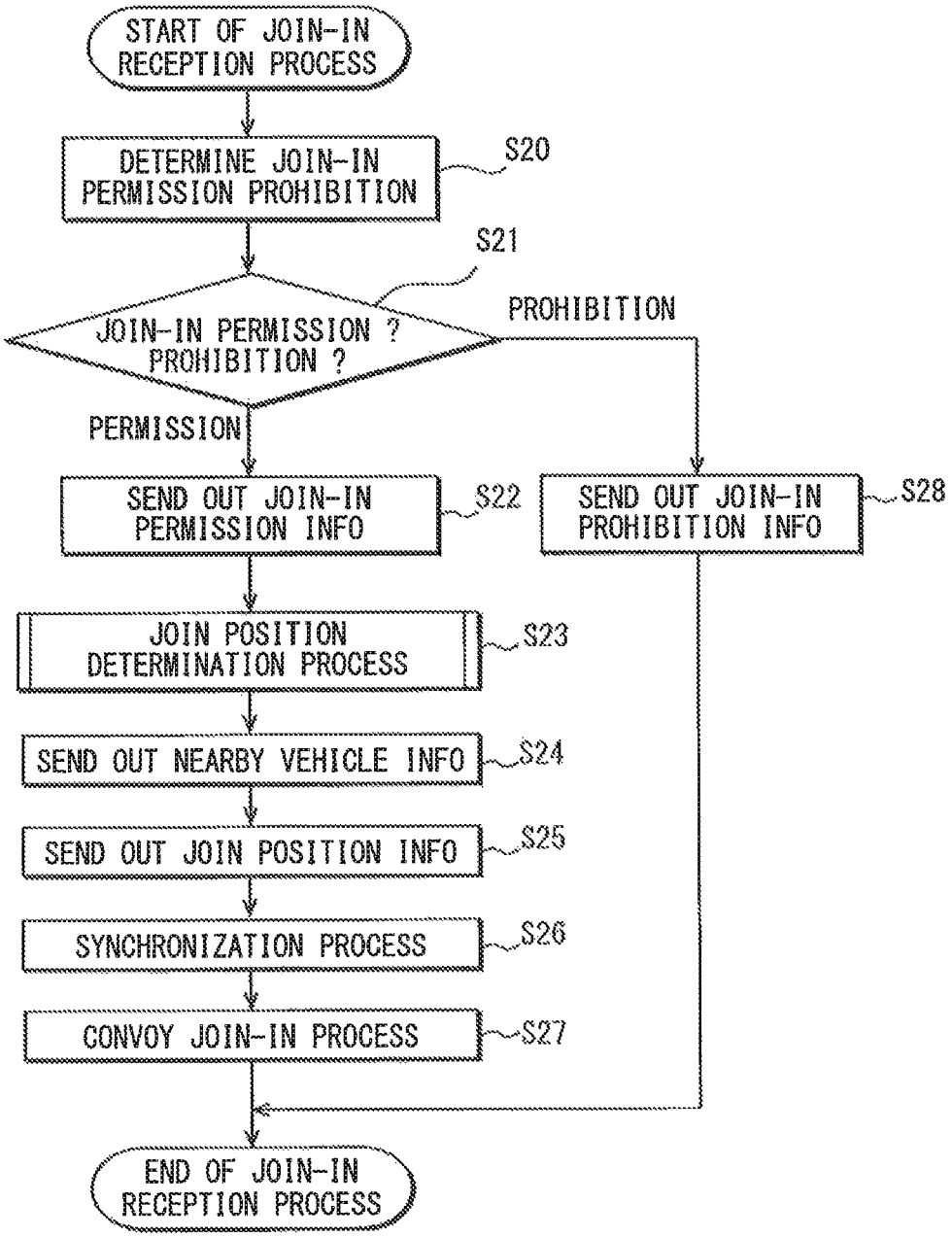

On the other hand, Steps S20-S28 in FIG. 5B show a join-in reception process which is also performed by the join-in processor 14. When the other vehicle join-in intention information is input via the antenna 21, the communication device 20, and the communication part 11, the join-in processor 14 considers/acknowledges that there is a vehicle which would like to join in the platoon, and performs the join-in reception process. Thus, this join-in reception process is a processing which is performed by the join-in processor 14 of the ECU 10 in the platoon vehicles. In an example of FIG. 9, the process is performed by the join-in processor 14 of the ECU 10 that is disposed in each of the large-size vehicles CL1-CL3 and the small-size vehicles CS1-CS3. Further, the variety of information in the pre-join-in process (i.e., D-info) which is output from the communication part 11 to the join-in processor 14 in FIG. 3 includes the other vehicle join-in intention information (C-info).

In Step S10, the join-in processor 14 sends out join-in intention and join-in vehicle information. That is, the join-in processor 14 transmits, via the communication part 11, the communication device 20, and the antenna 21, (i) the join-in information indicating a join-in intention and (ii) the vehicle information of the self-vehicle which serves as the join-in vehicle information. Therefore, the variety of information in the pre-join-in process (i.e., D-info), which is output from the join-in processor 14 to the communication part 11 in FIG. 3, includes the join-in information and the vehicle information.

A join-in permission prohibition determination is made in Step S20 (i.e., a join-in permission prohibition determination unit in the claims). At such time, the join-in processor 14 makes a join-in permission prohibition determination based on a depart point of the joining vehicle and a depart point of each of the platoon vehicles. Then, the join-in processor 14 determines whether a depart point of the joining vehicle is within a preset range from a depart point of each of the platoon vehicles. Then, if the depart point of the joining vehicle is within a preset range, it is determined that the join-in is permitted, and the process proceeds to Step S22, and, if the depart point is not in a preset range, the join-in processor 14 determines that the join-in is prohibited, and the process proceeds to Step S28. In the above, the join-in processor 14 can grasp a depart point of the joining vehicle based on the vehicle information from the joining vehicle, and can grasp a depart point of each of the platoon vehicles based on the platoon information.

The nearer the depart points of the platoon vehicles are, the longer (i.e., in terms of time) the platoon is organized and maintained. Therefore, by permitting a vehicle to join in the platoon only when a depart point of the joining vehicle is within a preset range from a depart point of each of the platoon vehicles, the platoon can be organized and maintained for a long time. Further, by maintaining the platoon for a long time, the energy consumption of the whole platoon can be reduced for a long time.

Further, the join-in processor 14 may be configured to make the join-in permission prohibition determination based on the number of platoon vehicles. Then, if it is determined by the join-in processor 14 that the number of the platoon vehicles has currently reached a preset value (i.e., is equal to or greater than a specified number), the join-in processor 14 prohibits the join-in and the process proceeds to Step S28, and, if it is determined that the number of the present platoon vehicles has not reached a preset value (i.e., below a specified number), the join-in processor 14 permits the join-in, and the process proceeds to Step S22. The join-in processor 14 can grasp the current number of the platoon vehicles based on the information in the platoon information which shows (i) the number of vehicles in the first vehicle group and (ii) the number of vehicles in the second vehicle group.

In other words, the platoon travel system restricts the number of platoon vehicles. That is, by restricting the number of platoon vehicles, interference of the platoon vehicles with other (i.e., non-platoon) vehicles even when a platoon travel is organized as a train of vehicles with a certain inter-vehicle distance interposed in between the platoon vehicles.

In Step S21, it is determined whether the join-in is permitted or prohibited based on the result of determination in Step S20. When it is determined that the join-in is permitted, the process proceeds to Step S22, and, when it is determined that the join-in is prohibited, the process proceeds to Step S28 under control of the join-in processor 14.

In Step S22, join-in permission information which shows a join-in permission to the platoon is sent to the vehicles which has sent out the join-in vehicle information. At such time, the join-in processor 14 sends out the join-in permission information via the communication part 11, the communication device 20, and the antenna 21. The join-in processor 14 may also be configured to send out the platoon information regarding the current platoon including such join-in permission information. On the other hand, in Step S28, the join-in prohibition information which shows a prohibition of join-in to the platoon is sent to the vehicle which has sent out the join-in vehicle information. At such time, the join-in processor 14 sends out the join-in prohibition information via the communication part 11, the communication device 20, and the antenna 21. Thus, in FIG. 3, the variety of information in the pre-join-in process (i.e., D-info) output from the join-in processor 14 to the communication part 11 includes the join-in permission information and the join-in prohibition information.

In Step S11, whether a response from the nearby vehicles exists or not is determined. The join-in processor 14 determines if a response from the nearby vehicles exists based on whether the join-in permission information or the join-in prohibition information sent out in above-mentioned Step S22 or Step S28 has been received. When the join-in permission information or the join-in prohibition information has been received via the communication part 11, the communication device 20, and the antenna 21, the join-in processor 14 determines that a response from the nearby vehicles exists, and the process proceeds to Step S12. On the other hand, when the join-in permission information or the join-in prohibition information has not been received, the is join-in processor 14 determines that a response from the nearby vehicles does not exist, and the process proceeds to Step S17. Thus, in FIG. 3, the variety of information in the pre-join-in process (i.e., D-info) output from the communication part 11 to the join-in processor 14 includes the join-in permission information and the join-in prohibition information.

In Step S17, it is determined whether it is a reception time-out. The join-in processor 14 determines whether it is a reception time-out based on whether a preset time has passed after the transmission of the join-in information and the vehicle information in Step S10. In other words, the join-in processor 14 determines whether it is a reception time-out based on whether a response from one of the nearby vehicles has arrived in a preset time, after transmitting the join-in information and the vehicle information in Step S10.

When it is determined that the preset time has not passed yet after transmitting the join-in information and the vehicle information, it is determined that it is not yet a reception time-out, and the process returns to Step S11, or, when it is determined that the preset time has already passed after transmitting the join-in information and the vehicle information, it is determined that it is a reception time-out now to conclude the join-in send-out process. These Step S11 and S17 may be omitted.

In Step S12, it is determined whether the join-in is permitted or the join-in is prohibited. The join-in processor 14 determines, based on whether the join-in permission information or the join-in prohibition information has been received from the nearby vehicles, whether the join-in to the platoon is permitted or the join-in to the platoon is prohibited. The join-in processor 14 determines, when the join-in permission information has been received, that the join-in to the platoon is permitted, and the process proceeds to Step S13, or determines, when the join-in prohibition information has been received, that the join-in to the platoon is prohibited, and concludes the join-in send-out process.

On the other hand, the ECU 10 (i.e., the join-in processor 14) of the vehicles in the platoon (i.e., platoon vehicles) performs a join position determination process shown in Step S23 (i.e., a join-in detection unit in the claims), after sending out the join-in permission information in Step S22. Here, the join position determination process is explained with reference to FIG. 6 and FIG. 7.

The joining vehicle projection area is acquired in Step S30 (i.e., a first acquisition unit in the claims). The join-in processor 14 acquires the information which shows the projection area contained in the received join-in vehicle information. In other words, the join-in processor 14 acquires the information which shows a projection area of a vehicle which was permitted to join in the platoon in Step S21. Still in other words, the join-in processor 14 acquires the information which shows a projection area of a vehicle having the join-in intention to join in the platoon. Here, the ECU 10 has the platoon information. Therefore, the join-in processor 14 has already acquired the information of the projection area of each of the platoon vehicles in the platoon.

The process in Step S31 computes a join-in group of the joining vehicle (i.e., a grouping unit in the claims). The join-in processor 14 computes the join-in group of the joining vehicle based on the projection area of the joining vehicle and a reference value (i.e., the first range, the second range). In other words, the join-in processor 14 computes the join-in group of the joining vehicle based on (I) the projection area of the joining vehicle and (ii) the projection area of each of the platoon vehicles in the current platoon.

In the examples of FIG. 8 and FIG. 9, the join-in processor 14 computes the join-in group of the joining vehicle CS4 based on (i) the projection area of the joining vehicle CS4 and (ii) the projection area (i.e., the first range, the second range) of the large-size vehicles CL1-CL3 and the small-size vehicles CS1-CS3 each of which is the platoon vehicle in the current platoon. In this case, the joining vehicle CS4 is a small-size vehicle. Therefore, the projection area of the joining vehicle CS4 is in the second range. Thus, the join-in processor 14 computes the join-in group of the joining vehicle CS4 as the second vehicle group. In other words, the join-in processor 14 determines the join-in group of the joining vehicle CS4 as the second vehicle group.

The process in Step S32 acquires a depart point of the joining vehicle (i.e., a second acquisition unit in the claims). The join-in processor 14 acquires the information which shows a depart point of the joining vehicle via the navigation device 30 and the input part 12 which is disposed in the self-vehicle. In other words, the navigation device 30 computes a depart point of the joining vehicle based on the guidance route of the joining vehicle included in the join-in vehicle information received based on the joining vehicle and the travel route of the platoon contained in the platoon information on the current platoon. The navigation device 30 then outputs the information which shows a computed depart point of the joining vehicle to the ECU 10.

Further, the join-in processor 14 may acquire, via the communication part 11, the communication device 20, and the antenna 21 (i.e., a second acquisition unit in the claims), the information which shows a depart point which is computed by the joining vehicle. In such case, it is assumed that the join-in processor 14 of one of the platoon vehicles has sent out the platoon information of the current platoon together with the join-in permission information (to the joining vehicle). On the other hand, the ECU 10 of the joining vehicle outputs the travel route of the platoon contained in the platoon information to the navigation device 30, when the ECU 10 has received the platoon information. The navigation device 30 disposed in the joining vehicle computes a depart point of the self-vehicle based on the guidance route of the self-vehicle and the travel route of the platoon. Then, the ECU 10 of the joining vehicle acquires the information which shows a depart point from the navigation device 30 of the self-vehicle, and transmits the information which shows the depart point to the platoon vehicles via the communication device 20 and the antenna 21. In such manner, the join-in processor 14 may acquire a depart point of the joining vehicle computed by the joining vehicle via the communication part 11, the communication device 20, and the antenna 21.

Further, the ECU 10 of the joining vehicle may be configured to transmit, to the platoon vehicles, the information which shows a depart point that has been output from the user interface 60. Even in such manner, the join-in processor 14 can acquire a depart point which was computed by the joining vehicle via the communication part 11, the communication device 20, and the antenna 21. Therefore, in FIG. 3, the variety of information in the pre-join-in process that has been output from the communication part 11 to the join-in processor 14 may include the information which shows the depart point.

In Step S33, the process acquires a number 'm' of vehicles in the join-in group. That is, the join-in processor 14 acquires, from the platoon information, the number of the join-in group into which the joining vehicle is joining. In an example of FIG. 9, the join-in group of the joining vehicle CS4 is the second vehicle group. Therefore, the number m of vehicles in the join-in group is set to 3. Further, the depart point of the joining vehicle CS4 is the point E.

In Step S34, the process performs a depart-point-specific join position determination process. Here, the depart-point-specific join position determination process is explained with reference to FIG. 7. The depart-point-specific join position determination process is a processing which compares a depart point of the joining vehicle with a depart point of each of the vehicles contained in the join-in group, and determines a join position of the joining vehicle in the join-in group. Therefore, a join position is eventually determined by this depart-point-specific join position determination process. Therefore, the depart-point-specific join position determination process may also be referred to as a final position determination process (i.e., a final position determination unit in the claims).

In Step S40, the process sets a value of 'n' to 1 (i.e., to an initial value). This value of 'n' shows respective position of the vehicles in each group (i.e., 'n' shows an order of the vehicle in the group). However, the meaning of 'n' is different in the first vehicle group and in the second vehicle group. As shown in FIG. 8, 'n' indicates that the vehicle is in the 'n'-th order from the top vehicle of the group in the first vehicle group, while, in the second vehicle group, the vehicle is in the 'n'-th order from the tail end vehicle of the group. That is, in the first vehicle group, n=1 is the large-size vehicle CL1, n=2 is the large-size vehicle CL2, and n=3 is the large-size vehicle CL3. On the other hand, in the second vehicle group, n=3 is the small-size vehicle CS1, n=2 is the small-size vehicle CS2, and n=1 is the small-size vehicle CS3.

The value of 'n' in Step S40 is set to 1 which is an initial value when performing the final position determination process for the first time. However, when performing the same process for the second time and further, the value of 'n' is set in Step S44 that is explained later.

In Step S41, the process determines whether a depart point of the joining vehicle is the same as the depart point of the n-th vehicle, or nearer than the depart point of the n-th vehicle. When the join-in processor 14 determines that a depart point of the joining vehicle is the same as or nearer than the depart point of the n-th vehicle, the process proceeds to Step S42, or, when it does not determine that a depart point of the joining vehicle is the same as or nearer than the depart point of the n-th vehicle, the process proceeds to Step S43.

That is, when the determination of Step S41 is performed for the first time, the value of n is equal to 1 (i.e., n=1). Therefore, a depart point of the joining vehicle is compared with a depart point of the n=1 vehicle. When a depart point of the joining vehicle is the same as or nearer than a depart point of the n=1 vehicle, the process proceeds to Step S42. When a depart point of the joining vehicle is not same or nearer than that of the n=1 vehicle, i.e., when a depart point of the joining vehicle is farther than that of the n=1 vehicle, the process proceeds to Step S43. In such configuration, the depart point of the n=1 vehicle is the nearest point relative to the current position of the platoon among the vehicles in the same group in the platoon.

Further, for the determination of Step S41 for the second time or later, the value of 'n' is being set either to 2, 3, 4 and the like by the process in Step S44 which is explained later.

In Step S42, the process determines the n-th position as a join position. When the first-time determination of Step S41 yields YES, a n=1 position is determined as the join position.

When the second-time determination of Step S41 yields YES, an n=2 position is determined as the join position. The join position is determined in the same manner for the determination of n=3 and further.

Figure 6:
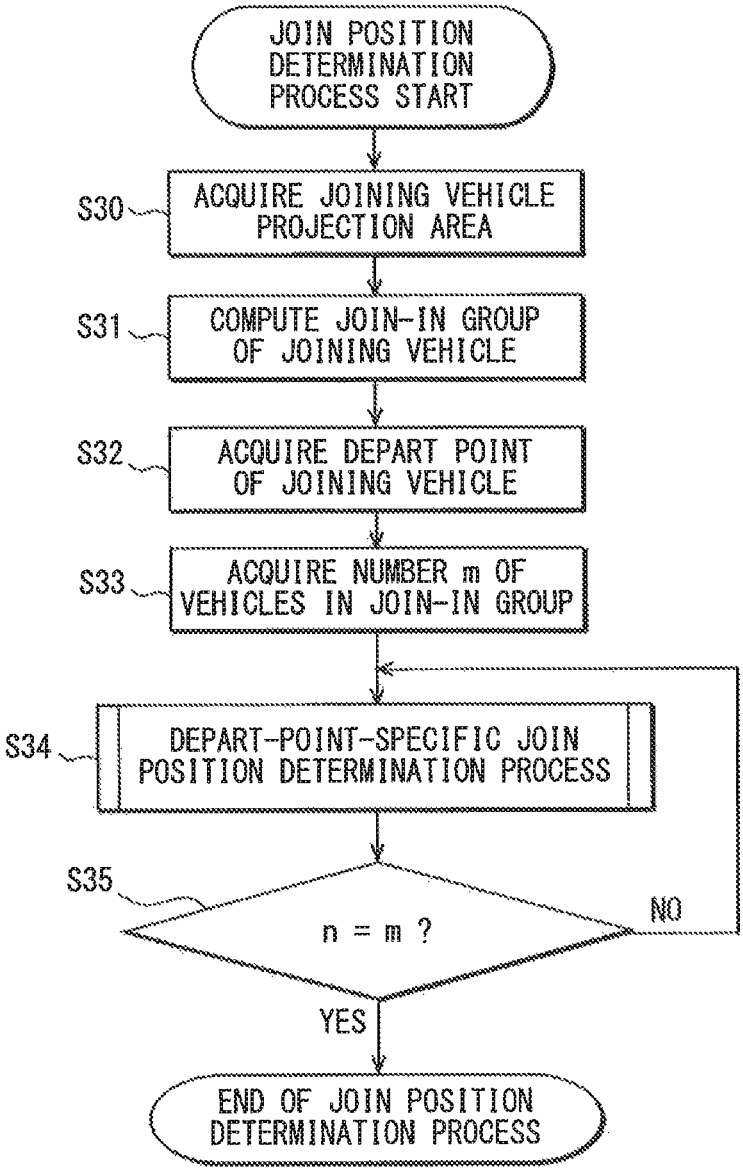
FIG. 6 is a flowchart of a position determination process by the platoon travel controller.
Figure 7:
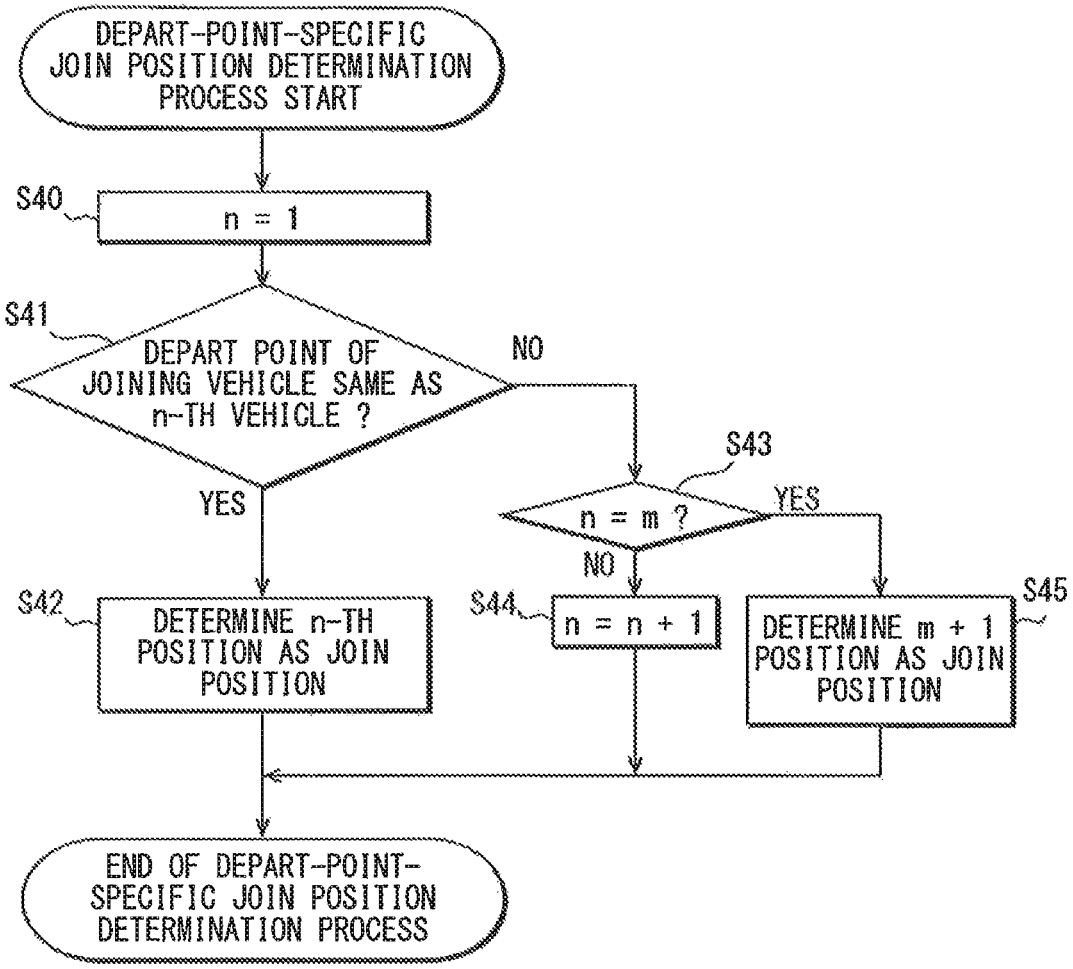
FIG. 7 is a flowchart of a depart point specific position determination process by the platoon travel controller.

After the end of processing in Step S42, the process proceeds to Step S35 of the flowchart of FIG. 6. In Step S35 of FIG. 6, it is determined whether n=m. When it is determined that n=m, the join position determination process is finished, and, when it is determined that n≠m, the process returns to Step S34. In other words, when the comparison of a depart point of the joining vehicle with a depart point of all the vehicles in the join-in group has been finished (i.e., when n=m), the join position determination process is finished, and, when the comparison has not been finished (i.e., when n≠m), the process returns to Step S34.

Further, the determination of Step S35 may alternatively be a determination whether the join position has already been determined. In other words, when it is determined in Step S35 that the join position has been determined, the join position determination process may be finished, and, when it is determined in Step S35 that the join position has not been determined, the process may return to Step S34. Therefore, when determining Step S35 after Step S42 or S45, the determination in Step S35 becomes YES, and the join position determination process is finished. On the other hand, when determining Step S35 after Step S44, the determination in Step S35 becomes NO, and the process returns to Step S34.

In Step S43, the process determines whether n=m. When it is determined that n=m, the process proceeds to Step S45, and, when it is determined that n≠m, the process proceeds to Step S44.

In Step S44, the final position determination process is finished as n=+1. In other words, in this step S44, the value of n for performing the final position determination process for the next time is set up. After the end of processing in Step S44, the process proceeds to Step S35 of the flowchart of FIG. 6. Since n≠m after processing in Step S44, the determination in Step S35 becomes NO. Therefore, the final position determination process will be performed again.

In Step S45, an m+1 position is determined as a join position. After the end of processing in Step S45, the process proceeds to Step S35 of FIG. 6. Since n=m after processing in Step S45, the determination in Step S35 becomes YES. Therefore, the join position determination process will be finished.

Here, the final position determination process is explained based on an example shown in FIG. 9. In this example, the n=1 vehicle in the join-in group into which the joining vehicle CS4 is joining is the small-size vehicle CS3. The depart point of the small-size vehicle CS3 is the point B. On the other hand, the depart point of the joining vehicle CS4 is the point E. Therefore, when the final position determination process is performed for the first time, the determination in Step S41 becomes NO. Further, in Step S43, since n≠3, the determination becomes NO. Then, in Step S44, the final position determination process is finished as n=n+1.

Now, when the final position determination process is performed for the second time, the n=2 vehicle is the small-size vehicle CS2. The depart point of the small-size vehicle CS2 is the point C. Therefore, in Step S41, the determination becomes NO. In Step S43, since n≠3, the determination becomes NO. Then, in Step S44, the final position determination process is finished as n=n+1.

Further, when the final position determination process is performed for the third time, the n=3 vehicle is the small-size vehicle CS1. The depart point of the small-size vehicle CS1 is the point D. Therefore, in Step S41, the determination becomes NO. In Step S43, since n is set to 3, the determination becomes YES. Then, in Step S45, the n-th position (i.e., an m+1 position) is determined as a join position, and the final position determination process is finished. As shown at timing t1 of FIG. 9, a join position 200 of the joining vehicle CS4 is determined as the position of m+1, i.e., the position in front of CS1.

Although not illustrated, when a large-size vehicle joins in the platoon, processing of joining is performed similarly. That is, when a large-size vehicle whose depart point is the point A would like to join in the platoon of FIG. 8 may be performed as follows. In such case, in Step S31, the first vehicle group is computed as the join-in group. Then, processing of Step S32 and S33 is performed.

Then, the final position determination process of Step S34 is performed. That is, when the final position determination process is performed for the first time, an n=1 vehicle is the large-size vehicle CL1. The depart point of the large-size vehicle CL1 is the point B. On the other hand, the depart point of the joining vehicle is the point A. Therefore, in Step S41, the determination becomes YES. Therefore, the n=1 position is determined as a join position. In other words, the position of the large-size vehicle CL1 in the current platoon is determined as a join position.

The join-in processor 14 of each of the platoon vehicles updates the platoon information that is held in itself, for an update of the determined join position of the joining vehicle, the number of vehicles in each of the vehicle groups, the travel route of the platoon, and the like, when the join position determination process is finished. That is, each of the platoon vehicles updates the platoon information. Thus, all platoon vehicles in one platoon hold the same platoon information. However, the ECU 10 in each of the platoon vehicles may be processing error or the like. That is, when processing error or the like is caused in one ECU 10, the platoon information may become different vehicle to vehicle (i.e., ECU 10 to ECU 10). Therefore, the join-in processor 14 in each of the platoon vehicles may be configured to transmit the updated platoon information to the other platoon vehicles via the communication part 11, the communication device 20, and the antenna 21. Then, it is determined in the ECU 10 in each of the platoon vehicles whether the platoon information held in the ECU 10 is the same as the platoon information received from the other platoon vehicles by the comparison of the two pieces of platoon information (e.g., based on majority vote or the like). When it is determined that the platoon information in one ECU 10 does not match the received platoon information, that ECU 10 may update the platoon information held therein by using the received platoon information from the other platoon vehicles (i.e., by using a "seem-to-be-correct" platoon information). In the above-described manner, the same platoon information is held in all platoon vehicles. Such a transmission and an update of the platoon information may be performed at any timing after the completion of the join position determination process.

In the present disclosure, the join position determination process is not necessarily limited to the above. The platoon travel system may organize a platoon as long as the system acquires the projection area information indicative of the projection area from each of the platoon vehicles and organizes the platoon in a "larger projection area vehicle first" manner, which arranges the vehicles in a descending order of the projection areas from the top of the platoon (i.e., a platoon organization unit in the claims). In other words, the platoon travel system may simply organize a platoon in the "larger projection area vehicle first" manner, without considering a grouping of vehicles and/or depart points of the vehicles. In such a case, the ECU 10 (i.e., the join-in processor 14) of each of the platoon vehicles has the platoon information and acquires the vehicle information from other platoon vehicles, thereby being capable of detecting a join position 200 in the platoon (i.e., the join-in detection unit).

After the end of the join position determination process, processing of Step S24 of FIG. 5B and thereafter is performed. In Step S24, the process sends out the nearby-vehicle information. That is, the join-in processor 14 in the platoon vehicle transmits the vehicle information of the self-vehicle to the joining vehicle via the communication part 11, the communication device 20, and the antenna 21.

Corresponding to this Step S24, the process in Step S13 receives the nearby-vehicle information. That is, the join-in processor 14 of the joining vehicle receives the nearby-vehicle information transmitted from the platoon vehicles via the antenna 21, the communication device 20, and the communication part 11.

In Step S25, join position information is sent out. That is, the join-in processor 14 of at least of the platoon vehicles transmits the join position information to the joining vehicle via the communication part 11, the communication device 20, and the antenna 21. Therefore, the variety of information in the pre-join-in process in FIG. 3 includes this join position information. The join position information is information which shows the position where the joining vehicle is put in the platoon.

Corresponding to this Step S25, the join position information is received in Step S14. The join-in processor 14 of the joining vehicle receives the join position information transmitted based on platoon vehicles via the antenna 21, the communication device 20, and the communication part 11.

The join position information may be any information as long as the information can notify the vehicle occupant of the join position of the joining vehicle. For example, the join position information may be the information which shows in what position the joining vehicle is to join in the platoon (e.g., n-th position determined in FIG. 7). At such time, if the joining vehicle has already acquired the platoon information, the information which shows the join-in group and an 'n' value may be used as the join position information.

In Step S15 and Step S26, the joining vehicle and the platoon vehicles respectively perform a synchronization process. This synchronization process is a processing which synchronizes the joining vehicle and the platoon vehicles, for the join-in of the joining vehicle into the platoon. The join-in processor 14 of the joining vehicle and the join-in processor 14 in each of the platoon vehicles synchronize with each other via the antenna 21, the communication device 20, and the communication part 11 which are disposed in each of those vehicles, for performing a platoon join-in process. In Steps S16 and Step S27, each of the joining vehicle and the platoon vehicles performs the platoon join-in process (i.e., a first drive unit and a deceleration unit in the claims).

Further, in Steps S26 and S27, the inter-vehicle distance between platoon vehicles is adjusted to a preset inter-vehicle distance when a new vehicle joins in the platoon (i.e., an inter-vehicle distance adjustment unit in the claims). Furthermore, when a new vehicle joins in the platoon, an inter-vehicle distance between (i) a front vehicle that is immediately in front of the join position and (ii) a behind vehicle that is immediately behind the join position is adjusted to a distance that allows the join-in of the joining vehicle into the platoon, which may also be designated as a join-in allow distance (i.e., an inter-vehicle distance adjustment unit in the claims). Furthermore, when a new vehicle joins in the platoon, the platoon vehicles behind the join position are decelerated as the deceleration target (decel-target) vehicles (i.e., an inter-vehicle distance adjustment unit in the claims). The platoon vehicles in the above context mean the vehicles in a pre-join-in platoon that has not yet allowed the join-in of the new vehicle.

Further, each of the decel-target vehicles may notify, when decelerates, the other decel-target vehicle immediately behind it of the deceleration of itself. At such a time, the ECU 10 in each of the decel-target vehicles may notify such deceleration through the vehicle-to-vehicle communication by using the communication device 20. In such manner, each of the decel-target vehicles receiving a deceleration notification can smoothly transit to deceleration control. Further, in the following, each of the decel-target vehicles may be configured to notify the deceleration to the other vehicles in the same manner.

As described above, the platoon travel system controls the plural vehicles to travel with the preset inter-vehicle distance between them, for the platoon travel of the vehicles. The amount of the inter-vehicle distance is predetermined, and may be referred to as a specified distance. Further, a distance that allows the join-in of the joining vehicle corresponds to a join-in space 210 in FIG. 9. Therefore, in other words, in Steps S26 and S27, when a new vehicle joins in the platoon, "behind platoon vehicles" traveling behind the join position in the platoon are decelerated as the decel-travel vehicles, for reserving the join-in space 210 and for adjusting the inter-vehicle distance to the specified distance.

Here, the platoon join-in process is explained with reference to an example of FIG. 9. In the example of FIG. 9, at timing t1, the join position 200 is determined as the position currently occupied by the small-size vehicle CS1. In other words, it is determined as a position between the large-size vehicle CL3 and the small-size vehicle CS1.

In the example of this FIG. 9, the join position 200 is not the top or the tail end of the platoon. In such a case, for the joining of the joining vehicle CS4, it is necessary to provide a join-in space 210 between the vehicles before and behind the join position 200. That is, when a new vehicle joins in the platoon, it is necessary to reserve the join-in space 210 for the join-in of the joining vehicle into the platoon.

Then, as shown at timing t2, the small-size vehicles CS1-CS3 which are the platoon vehicles behind the join position 200 are decelerated, for the reservation of the join-in space 210 (i.e., a speed reduction control, a deceleration unit, an inter-vehicle distance adjustment unit in the claims). At such time, the join-in processor 14 provided in each of the small-size vehicles CS1-CS3 outputs, to the travel system components 80 via the output part 16, the drive information which shows deceleration at a constant rate (i.e., a first drive unit in the claims). That is, the present disclosure adjusts the inter-vehicle distance by decelerating the vehicles which constitute the platoon at the time of join-in of a new vehicle into the platoon.

Further, when the join-in space 210 is reserved by the deceleration, the small-size vehicles CS1-CS3 preferably return to the before-deceleration speed by accelerating at a constant rate. At such time, the join-in processor 14 in each of the small-size vehicles CS1-CS3 outputs the drive information which shows acceleration at a constant rate to the travel system component 80 via the output part 16. Note that the acceleration here is for returning the vehicle speed (i.e., the speed of the small-size vehicles CS1-CS3) to a pre-deceleration speed, which was caused for the reservation of the join-in space 210. Therefore, the speed of these vehicles in the course of regaining to the platoon travel speed will not exceed the pre-deceleration speed.

Here, a method of decelerating, for the reservation of the join-in space 210, the decel-target vehicles when a sensor which detects an inter-vehicle distance to the front vehicle is adopted as the nearby information sensor 40 is explained. Hereafter, a vehicle just/immediately behind the join position 200 among all decel-target vehicles may also be called a just-behind vehicle.

The ECU 10 in each of the platoon vehicles acquires the information which shows the inter-vehicle distance to the front vehicles from the nearby information sensor 40 (i.e., a first acquisition unit in the claims). Then, the ECU 10 in the just-behind vehicle adjusts the inter-vehicle distance to an immediate front vehicle to a distance that allows the join-in of the joining vehicle into the platoon (i.e., the join-in allow distance), by decelerating the vehicle while confirming the inter-vehicle distance to such immediate front vehicle based on the information indicative of the inter-vehicle distance. The immediate front vehicle may also be referred to as a just-ahead vehicle (i.e., an inter-vehicle distance adjustment unit). Further, the ECU 10 in each of the other decel-target vehicles adjusts the inter-vehicle distance to a just-ahead vehicle to the specified distance, by decelerating the vehicle while confirming the inter-vehicle distance to such immediate front vehicle based on the information indicative of the inter-vehicle distance (i.e., an inter-vehicle distance adjustment unit).

More specifically, the join-in processor 14 of the ECU 10 in each of the platoon vehicles acquires, from the nearby information sensor 40 via the input part 12, the information which shows the inter-vehicle distance to the front vehicle. Then, the join-in processor 14 of the just-behind vehicle decelerates the self-vehicle, by outputting the drive information that instructs the deceleration to the travel system component 80 via the output part 16 while confirming the inter-vehicle distance to the just-ahead vehicle based on the acquired information. The join-in processor 14 of the just-behind vehicle adjusts, by decelerating the self-vehicle in this manner, the inter-vehicle distance to the just-ahead vehicle to the join-in allow distance that allows the join-in of the joining vehicle into the platoon. Further, the join-in allow distance may be set in advance according to the body size, the number of the joining vehicles and/or the other attributes of the joining vehicle.

On the other hand, the join-in processor 14 of each of the other decel-target vehicles decelerates the self-vehicle, by outputting the drive information that instructs the deceleration to the travel system component 80 via the output part 16 while confirming the inter-vehicle distance to the just-ahead vehicle based on the acquired information. The join-in processor 14 of each of the other decel-target vehicles adjusts the inter-vehicle distance to the just-ahead vehicle to the specified distance, by decelerating the self-vehicle in this manner.

In other words, when a sensor which detects an inter-vehicle distance to the front vehicle is adopted as the nearby information sensor 40, the platoon travel system adjusts the inter-vehicle distance by decelerating all vehicles behind the join position 200 as decel-target vehicles (i.e., an inter-vehicle distance adjustment unit in the claims). At such time, the platoon travel system adjusts the inter-vehicle distance between (i) a front vehicle that is immediately in front of the join position 200 and (ii) a behind vehicle that is immediately behind the join position 200 to the join-in allow distance (i.e., an inter-vehicle distance adjustment unit in the claims). Further, the platoon travel system adjusts the inter-vehicle distance between each of the decel-target vehicles to the specified distance (i.e., an inter-vehicle distance adjustment unit in the claims).

Thus, as described above, the platoon travel system can reserve the join-in space 210 by controlling each of the decel-target vehicles to detect the inter-vehicle distance by itself, when a sensor which detects an inter-vehicle distance to the front vehicle is adopted as the nearby information sensor 40. In other words, each of the decel-target vehicles contributes to the reservation of the join-in space 210, without performing the vehicle-to-vehicle communication. Therefore, by adopting the nearby information sensor 40 which detects the inter-vehicle distance to the front vehicles, the platoon travel system can improve an accuracy of the adjustment of the inter-vehicle distance, since such configuration will not be easily affected by the delayed response in the vehicle-to-vehicle communication, or the like.

Further, as the nearby information sensor 40 for detecting the inter-vehicle distance to the front vehicle, a radar cruise sensor which has already been sold in the market may be used. Therefore, the platoon travel system is realized at low cost by using the nearby information sensor 40 which detects the inter-vehicle distance to the front vehicle, since, in such manner, no special nearby information sensor is required.

Next, a method of decelerating, for the reservation of the join-in space 210, the decel-target vehicles when a sensor which detects an inter-vehicle distance to the behind vehicle is adopted as the nearby information sensor 40 is explained.

The ECU 10 in each of the platoon vehicles acquires the information which shows the inter-vehicle distance to the behind vehicles from the nearby information sensor 40 (i.e., a second acquisition unit in the claims). Then, the ECU 10 in each of the platoon vehicles transmits the acquired information indicative of the inter-vehicle distance to the just-behind vehicle via the vehicle-to-vehicle communication by using the communication unit 20 (i.e., a second transmission unit). Further, when transmitting such information regarding the inter-vehicle distance, the ECU 10 in each of the platoon vehicles transmits such information at predetermined intervals.

Then, the ECU 10 in the just-behind vehicle decelerates the self-vehicle based on the information about the inter-vehicle distance transmitted from the just-ahead vehicle while confirming the inter-vehicle distance to the just-ahead vehicle (i.e., an inter-vehicle distance adjustment unit in the claims). That is, an immediate behind vehicle (i.e., the just-behind vehicle) behind the join position 200 is the decel-target vehicle. Then, the ECU 10 in the just-behind vehicle adjusts the inter-vehicle distance to a just-ahead vehicle to the join-in allow distance, by decelerating the self-vehicle (i.e., an inter-vehicle distance adjustment unit in the claims).

More specifically, the join-in processor 14 of the ECU 10 in each of the platoon vehicles acquires, from the nearby information sensor 40 via the input part 12, the information which shows the inter-vehicle distance to the behind vehicle. Then, the join-in processor 14 transmits the acquired information about the inter-vehicle distance to the just-behind vehicle via the communication part 11 and the communication device 20.

Then, the join-in processor 14 of the just-behind vehicle decelerates the self-vehicle by outputting the drive information that instructs the deceleration to the travel system component 80 via the output part 16 while confirming the inter-vehicle distance to the just-ahead vehicle based on the acquired information. The join-in processor 14 of the just-behind vehicle adjusts, by decelerating the self-vehicle in this manner, the inter-vehicle distance to the just-ahead vehicle to the join-in allow distance that allows the join-in of the joining vehicle into the platoon.

In other words, when a sensor which detects an inter-vehicle distance to the behind vehicle is adopted as the nearby information sensor 40, the platoon travel system adjusts the inter-vehicle distance by decelerating the just-behind vehicle behind the join position 200 as a decel-target vehicle (i.e., an inter-vehicle distance control unit in the claims). At such time, the platoon travel system adjusts, to the join-in allow distance, the inter-vehicle distance that is indicated in the transmitted information from the just-ahead vehicle immediately in front of the join position 200 (i.e., an inter-vehicle distance control unit in the claims). Further, "the inter-vehicle distance that is indicated in the transmitted information from the just-ahead vehicle immediately in front of the join position 200" corresponds to an inter-vehicle distance between (i) the just-ahead vehicle that is immediately in front of the join position 200 and (ii) the just-behind vehicle that is immediately behind the join position 200.

Further, when a sensor which detects an inter-vehicle distance to the behind vehicle is adopted as the nearby information sensor 40, the platoon travel system may treat all vehicles behind the join position 200 as the decel-target vehicles. In other words, the platoon travel system may decelerate all vehicles behind the join position 200 in the platoon as the decel-target vehicles, and may adjust the inter-vehicle distance between each of those vehicles to the specified distance (i.e., an inter-vehicle distance adjustment unit in the claims). In such case, the ECU 10 of the just-behind vehicle adjusts the inter-vehicle distance in the manner described above.

On the other hand, based on the transmitted information from the just-ahead vehicle of the self-vehicle which shows the inter-vehicle distance, the ECU 10 in each of the other decel-target vehicles adjusts, to the specified distance, the inter-vehicle distance to the just-ahead vehicle, by decelerating the self-vehicle while confirming the inter-vehicle distance to the just-ahead vehicle (i.e., an inter-vehicle distance adjustment unit in the claims). More specifically, the join-in processor 14 of the just-behind vehicle decelerates the self-vehicle by outputting the drive information that instructs the deceleration to the travel system component 80 via the output part 16 while confirming the inter-vehicle distance to the just-ahead vehicle based on the acquired information. The join-in processor 14 of the just-behind vehicle adjusts, by decelerating the self-vehicle in this manner, the inter-vehicle distance to the just-ahead vehicle to the join-in allow distance that allows the join-in of the joining vehicle into the platoon. In such case, the inter-vehicle distance that is indicated by the transmitted information from the just-ahead vehicle corresponds to an inter-vehicle distance between the self-vehicle and the just-ahead vehicle.

Further, when a sensor which detects an inter-vehicle distance to the behind vehicle is adopted as the nearby information sensor 40, and in case that the join-in space 210 is reserved, the platoon travel system may accelerate the decel-target vehicles, for such vehicles to return to the pre-deceleration speed. In other words, when the join-in space 210 is reserved, the platoon travel system may adjust the inter-vehicle distance between each of the platoon vehicles to the specified distance by returning the speed of the decel-target vehicles to the preset speed (i.e., an inter-vehicle distance adjustment unit in the claims).

In such case, when the inter-vehicle distance to the just-ahead vehicle is adjusted to the join-in allow distance, the ECU 10 in the just-behind vehicle, which is one of the decel-target vehicles just behind the join position 200, accelerates the self-vehicle and returns the speed of the self-vehicle to the preset speed. At such time, the ECU 10 in each of the other decel-target vehicles accelerates the self-vehicle, returns the speed of the self-vehicle to the preset speed, and adjusts the inter-vehicle distance to the just-ahead vehicle to the specified distance.

More specifically, when it is determined that the inter-vehicle distance between the self-vehicle and the just-ahead vehicle becomes the join-in allow distance, the join-in processor 14 of the just-behind vehicle outputs the drive information which instructs acceleration to the travel system components 80 via the output part 16, and accelerates the self-vehicle. The join-in processor 14 of the just-behind vehicle returns the speed of the self-vehicle to the preset speed by accelerating the self-vehicle in such manner.

On the other hand, when it is determined that the inter-vehicle distance between the self-vehicle and the just-ahead vehicle becomes the specified distance, the join-in processor 14 of each of the other decel-target vehicles outputs the drive information which instructs acceleration to the travel system components 80 via the output part 16, and accelerates the self-vehicle. The join-in processor 14 of the each of the other decel-target vehicles returns the speed of the self-vehicle to the preset speed by accelerating the self-vehicle in such manner.

In such manner, even when a sensor which detects an inter-vehicle distance to the behind vehicle is adopted as the nearby information sensor 40, the join-in space 210 can be reserved by the deceleration of the (platoon) vehicles.

In the vehicles of recent years, a short-distance radar is mainly used for the monitoring of the backward field. However, the platoon travel system of the present disclosure is realizable by disposing the above-mentioned radar cruise sensor on the back of the vehicle as the nearby information sensor 40. Further, in this platoon travel system, the detection accuracy is improved by not adopting the short-distance but by adopting the radar cruise sensor. That is, the radar cruise sensor yields better detection accuracy for the platoon travel system than the short-distance sensor.

Thus, after the reservation of the join-in space 210 in the above-described manner, as shown at timing t3 of FIG. 9, the joining vehicle CS4 will go into the join-in space 210. At such time, the join-in processor 14 in the joining vehicle CS4 outputs, to the travel system component 80 via the output part 16, the drive information which shows and instructs a move (of CS4) from a pre-join position to the join-in space 210. Therefore, a joining of a new vehicle into a platoon is achieved by (i) gradually slowing down the "behind" vehicles behind the join position 200 for the reservation of the join-in space 210, which is a space required for the joining vehicle, and (ii) gradually accelerating, at a near-completion time of the reservation of the space 210, to resume the platoon travel at an original (i.e., pre-deceleration) speed, and, during such a period, the joining vehicle moves into the reserved join-in space 210 and the platoon is re-organized.

Thus, by decelerating the platoon vehicles for the reservation of the join-in space 210, the travel resistance is reduced and deterioration of the energy consumption is prevented, in comparison to the reservation of the join-in space 210 by the acceleration of the vehicles ahead of the join position 200. Further, by preventing the deterioration of the energy consumption, the travel distance of the platoon vehicle is extended.

Further, when reserving the join-in space 210 by accelerating the vehicles ahead of the join position 200, the vehicles ahead of the join position 200 must be accelerated to the speed that exceeds the speed of the platoon travel. However, when the vehicles ahead of the join position 200 are less powerful (e.g., in case that the vehicle is a small/compact vehicle or the like), it may be difficult to reserve the join-in space 210. On the other hand, since the present disclosure decelerates the platoon vehicles for the reservation of the join-in space 210, even when the vehicles ahead of the join position 200 are less powerful, the reservation of the join-in space 210 is securely performed.

Further, since every road has its own legal speed in general, the normal platoon travel speed is set to a value just below such legal speed, for the margin of acceleration. That is, for example, when the legal speed is set to 80 km/h, the normal platoon travel speed may be set to a value somewhere around 70 km/h in the other platoon travel system. As a result, a travel time of the same distance may become longer than the platoon travel at the limit legal speed. That is, the travel time efficiency of such system may be low.

On the other hand, it is not necessary for the platoon travel system of the present disclosure to have such speed acceleration margin, because the present system, as described above, simply decelerates the platoon vehicles for the reservation of the join-in space 210. That is, the platoon travel system of the present disclosure can set its platoon travel speed to the legal speed limit. Therefore, the platoon travel system of the present disclosure can improve the travel time efficiency of the vehicles for not only a vehicle join-in time but for a vehicle departure time and for a platoon reorganization time.

Thus, based on the project areas of the vehicles, the platoon travel system organizes a top group by the larger projection area vehicles, and organizes a tail end group by the smaller projection area vehicles. Further, when the platoon travel system has a joining vehicle joining into the platoon, the system determines the join-in group of the joining vehicle based on the projection area of the joining vehicle, and determines the join position of the joining vehicle in the join-in group based on the depart point of the joining vehicle and depart points of the vehicles in the join-in group.

Further, the platoon travel system determines the position of each of the plural vehicles in each vehicle group based on the depart point information. More specifically, the platoon travel system determines, as for the first vehicle group that is a top group of the platoon, the join position of the joining vehicle to be closer to the top/front of the group/platoon for a vehicle having a nearer depart point, which may also be stated a closer-to-front-most position relative to a travel direction of the platoon. That is, in the top group of the platoon, the vehicles are positioned in an ascending order of a depart point distance from the top of the platoon.

On the other hand, in the second vehicle group that is a tail end group of the platoon, the platoon travel system determines the join position of the joining vehicle to be closer to the tail end of the platoon for a vehicle having a nearer depart point, which may also be stated a closer-to-rear-most position relative to the travel direction of the platoon. That is, in the tail end group of the platoon, the vehicles are positioned in a descending order of a depart point distance from the top of the group. That may still be re-stated that the vehicles are positioned in an ascending order of a depart point distance from the tail end of the group/platoon.

In such manner, the platoon travel system in the present embodiment enables the platoon to have a departing platoon vehicle either departing from the top of the platoon or from the tail end of the platoon. Regarding the depart point distance, a near depart point means that the depart point is near/close to the current position of the vehicle/platoon. Therefore, the near depart point may be re-stated that the travel distance from the current position to the depart point is short.

In the above, a situation of accepting/joining a joining vehicle has been described as an example. However, the flowcharts of FIGS. 5A 7 may also be applied to a formation/organization of a new platoon. For example, when a new platoon is organized as the one shown in FIG. 8, those flowcharts are applicable. In such a case, the join-in processor 14 disposed in each of the plural vehicles that would like to perform a platoon travel performs both of the above-mentioned join-in send-out process and the join-in reception process. In such manner, the platoon travel system positions the vehicles having nearer depart points to be closer to the top of the platoon in the first vehicle group that is a top group of the platoon, and also positions the vehicles having nearer depart points to be closer to the tail end of the platoon in the second vehicle group that is a tail end group of the platoon. As a result, the platoon travel system can newly organize a platoon as shown, for example, in FIG. 8.

In other words, if a platoon is considered as a whole, from the top part toward the middle part of the platoon, vehicles are positioned so that depart points of the vehicles become farther step by step (i.e., vehicle by vehicle), and, from the tail end toward the middle part of the platoon, vehicles are also positioned so that depart points become farther step by step. Still in other words, the platoon organized by the platoon travel system of the present disclosure always makes the departing vehicle depart either from a top of the platoon or a tail end of the platoon.

Further, the above-described vehicle positioning, i.e., a nearer depart point vehicle is positioned closer to a top of the platoon in the first vehicle group that is a top group of the platoon and a nearer depart point vehicle is positioned closer to a tail end of the platoon in the second vehicle group that is a tail end group of the platoon, may be designated as an organization rule of the platoon. Therefore, it may be stated, in other words, that the platoon travel system organizes a platoon according to this organization rule.

Figure 10A:
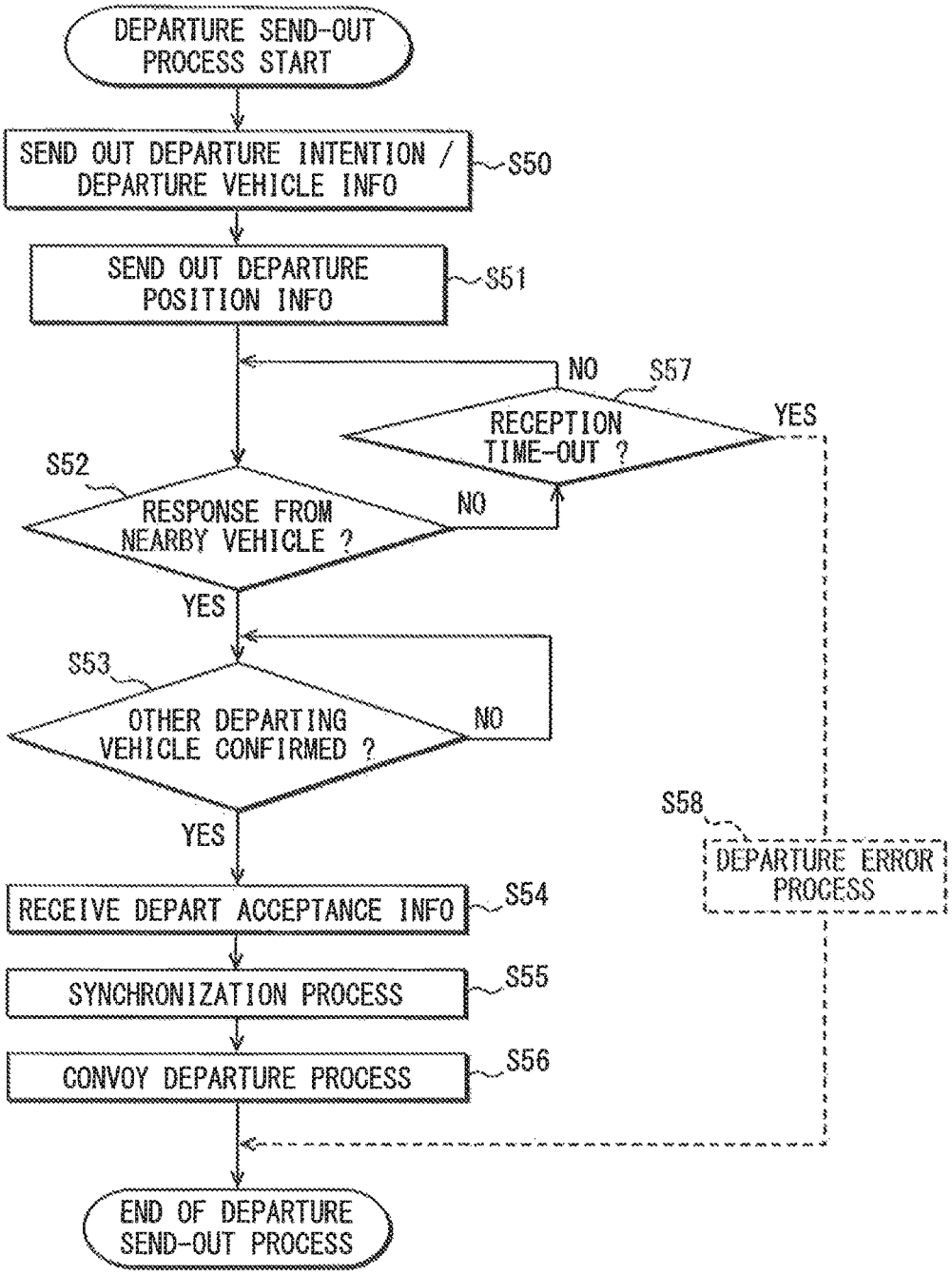
FIGS. 10A/B are flowcharts of departure related processes by the platoon travel controller.
Figure 10B:
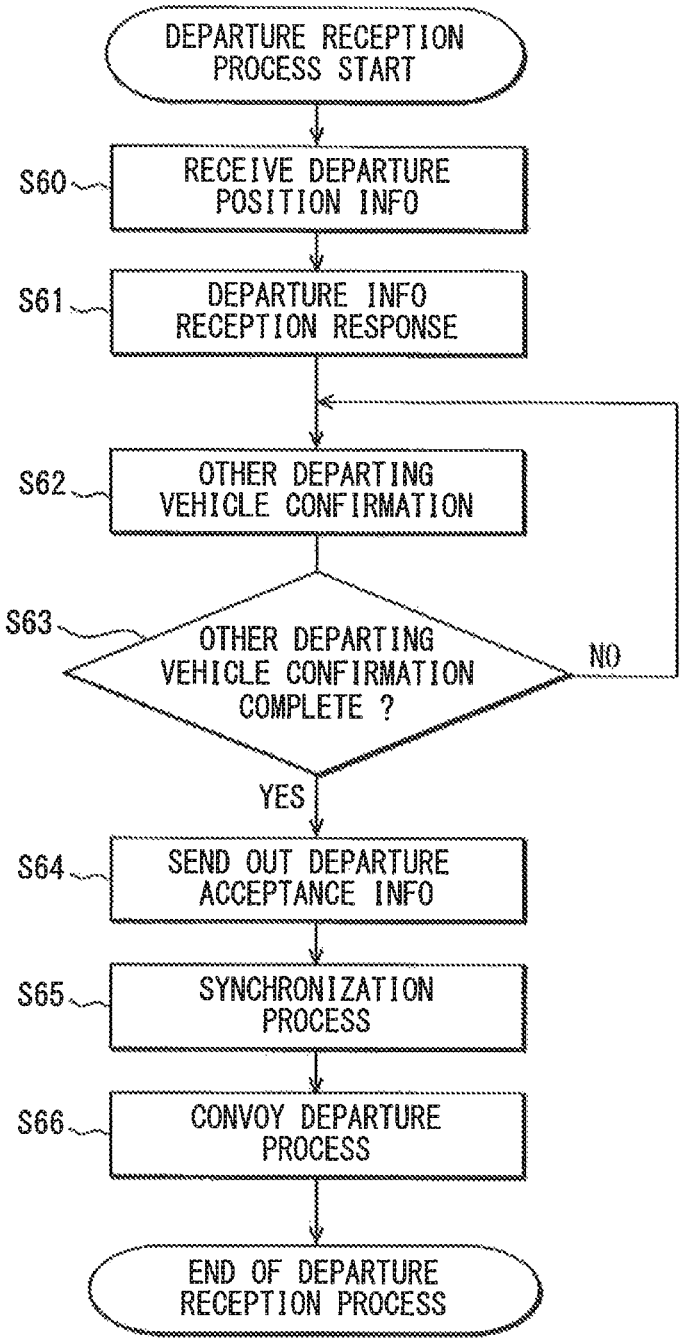
Figure 11:
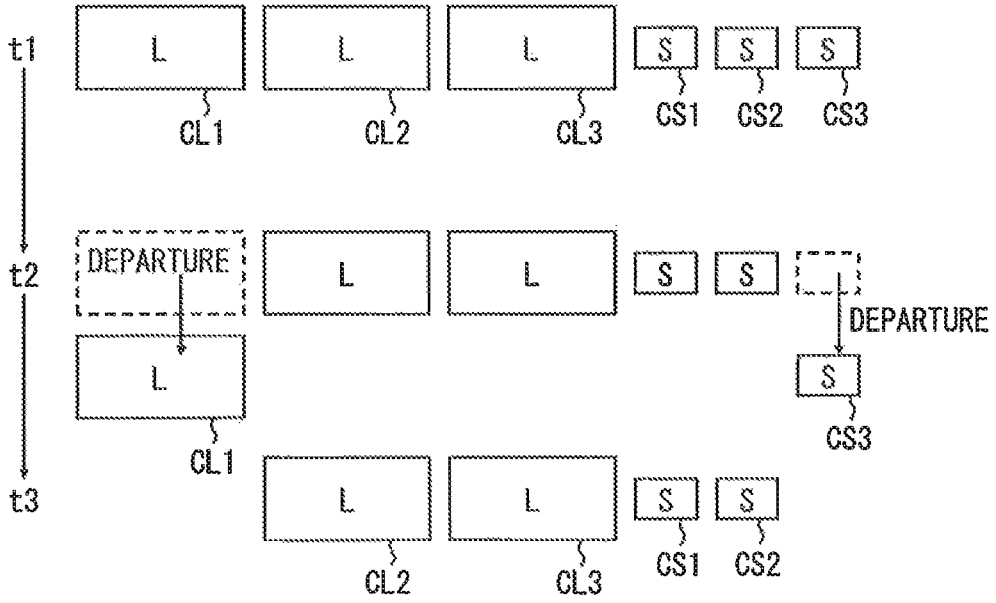
FIG. 11 is an illustration of vehicle behaviors at a time of departing from the platoon that includes two different types of vehicle groups.

Next, with reference to FIG. 8, FIG. 10, and FIG. 11, a depart time process of the platoon travel controller 10 is described. In this case, as shown in FIG. 11, an example in which the large-size vehicle CL1 and the small-size vehicle CS3 depart from a platoon of FIG. 8 is described.

Steps S50-S58 shown in FIG. 10A show the departure send-out process which is performed by the departure processor 15. When platoon departure intention information is input via the input part 12 from the user interface 60, the departure processor 15 considers/acknowledges that such information is an intention to depart from the platoon, and performs the departure send-out process. Thus, this departure send-out process is a processing which is performed by the departure processor 15 of the ECU 10 that is disposed in a vehicle or vehicles which depart from the platoon. Hereafter, vehicles which depart from the platoon may be designated as departing vehicles. In an example of FIG. 11, the departure send-out process is a processing which is performed by the departure processor 15 of the ECU 10 that is disposed in the large-size vehicle CL1 and the departure processor 15 of the ECU 10 disposed in the small-size vehicle CS3.

As an assumption, the navigation device 30 may be configured to calculate a remaining distance from the current position to a depart point at preset intervals, and, to output the platoon departure intention information when the remaining distance to a depart point reaches a preset value. In such a case, the departure processor 15 of the ECU 10 disposed in each of the platoon vehicles performs the departure send-out process, when the platoon departure intention information is input via the input part 12 from the navigation device 30. Further, the depart point is a position/point on a travel route of the platoon.

On the other hand, Steps S60-S67 of FIG. 10B show the departure reception process which is performed by the departure processor 15. When other vehicle departure intention information is input via the antenna 21, the communication device 20, and the communication part 11, the departure processor 15 considers/acknowledges that there is a vehicle which would like to depart from the current platoon, and performs the departure reception process. Thus, the departure reception process is a processing which is performed by the departure processor 15 of the ECU 10 that is disposed in platoon vehicles other than the departing vehicle. In the example of FIG. 11, the departure reception process is performed by the departure processor 15 of the ECU 10 in each of the large-size vehicles CL2, CL3, and the small-size vehicles CS1, CS2. Further, the variety of information in the pre-departure process is output to the departure processor 15 from the communication part 11 in FIG. 3 includes the other vehicle departure intention information. Further, vehicles other than the departing vehicle, which may be designated hereafter as non-departing vehicles, remain in the platoon after the departing vehicle departs from the platoon.

In Step S50, the departure processor 15 sends out a departure intention and departure vehicle information. That is, the departure processor 15 transmits, via the communication part 11, the communication device 20, and the antenna 21, (i) the departure information which shows a departure intention and (ii) the vehicle information of the self-vehicle as the departure vehicle information. Therefore, the variety of information in the pre-departure process output to the communication part 11 from the departure processor 15 in FIG. 3 includes this departure information and the vehicle information.

In Step S51, departure position information is sent out. That is, the departure processor 15 transmits, via the communication part 11, the communication device 20, and the antenna 21, the departure position information, i.e., the information which shows a position of the self-vehicle in the platoon. Therefore, the variety of information in the pre-departure process output to the communication part 11 from the departure processor 15 in FIG. 3 includes this departure position information.

In the example of FIG. 11, the departure processor 15 of the ECU 10 disposed in the large-size vehicle CL1 transmits the departure information, the vehicle information, and the departure position information (i.e., information which shows the n=1 position in the first vehicle group). The departure processor 15 of the ECU 10 disposed in the small-size vehicle CS3 transmits the departure information, the vehicle information, and the departure position information (i.e., information which shows the n=1 position in the second vehicle group).

Corresponding to the above, the departure processor 16 of the ECU 10 disposed in each of the non-departing vehicles performs processing of Step S60 (i.e., a departure detection unit in the claims). That is, in Step S60, the departure position information is received. At such a time, the departure processor 15 receives the departure position information via the antenna 21, the communication device 20, and the communication part 11. Further, the ECU 10 in each of the platoon vehicles has the platoon information, and acquires the departure position information from the ECU 10 of the departing vehicle, thereby enabled to detect the departure position of the departing vehicle in the platoon (i.e., a departure detection unit in the claims).

Then, in Step S61, the departure processor 15 responds to the departure information which has just been received. At such a time, the departure processor 15 sends out, to the departing vehicle, response information which shows that the departure information has been received via the communication part 11, the communication device 20, and the antenna 21. Thus, the variety of information in the pre-departure process output to the communication part 11 from the departure processor 15 in FIG. 3 includes this response information.

In Step S62, whether there is the other departing vehicle is confirmed. Then, in Step S63, when it is determined that there is a departing vehicle, the process returns to Step S62, and, when it is determined that there is no other departing vehicle, the process proceeds to Step S64. Although not illustrated, the departure processor 15 transmits, to the (original) departing vehicle via the communication part 11, the communication device 20, and the antenna 21, the above confirmation result of whether the other departing vehicle exists or not.

In a case of the multi-master method, the ECU 10 disposed in each of the platoon vehicles has the same information basically, and, through information exchange with the ECUs 10 in other platoon vehicles, the same information prevails instantaneously in one platoon. Therefore, when the departure information is sent out from one ECU 10 in a departing vehicle in the platoon, the ECU 10 in the other departing vehicle also sends out the departure information in synchronization with the departure information transmission from the original departing vehicle, thereby making it possible for the original departing vehicle to confirm whether there is the other departing vehicle in the platoon.

Further, if the platoon control is the multi-master method, the ECUs 10 in the platoon vehicles respectively have the depart point information of the other platoon vehicles. That is, the vehicles departing at the same depart point know each other in advance. In other words, the same point departing vehicle can be readily found and confirmed.

Further, in case that the platoon control is the master/slave method to be described later, the ECU 10 disposed in a master vehicle receives the departure information from the ECU 10 disposed in slave vehicles. Therefore, the other departing vehicle can be readily found and confirmed.

In Step S64, departure acceptance information is sent out. At such a time, the departure processor 15 sends out the departure acceptance information to a departing vehicle via the communication part 11, the communication device 20, and the antenna 21.

On the other hand, in Step S52, a response from a non-departing vehicle is determined. That is, the departure processor 15 determines a response from a non-departing vehicle based on whether the response information sent out in the above-mentioned Step S61 has been received. When the response information has been received via the communication part 11, the communication device 20, and the antenna 21, the departure processor 15 determines that there is a response from a non-departing vehicle, and the process proceeds to Step S53. On the other hand, when the response information has not been received, the departure processor 15 determines that there is no response from a non-departing vehicle, and the process proceeds to Step S57. Thus, the variety of information in the pre-departure process output to the departure processor 15 from the communication part 11 in FIG. 3 includes this response information.

In Step S57, it is determined whether a situation is a reception time-out. That is, the departure processor 15 determines whether it is a reception time-out based on whether a preset time has passed after transmitting the departure information, the vehicle information, and the departure position information in Steps S50 and S51. In other words, the departure processor 15 determines whether it is a reception time-out based on whether a response from the nearby vehicle is received within a preset time after transmitting the departure intention and the departure vehicle information in Step S50. The departure processor 15 determines that it is not a reception time-out when a preset time has not yet passed after transmitting the departure vehicle information, and the process returns to Step S52, or it determines that it is a reception time-out when a preset time has passed already, and the process proceeds to Step S58.

In Step S58, the departure processor 15 performs a departure error process. Even after transmitting the departure information, the vehicle information, and the departure position information in Steps S50 and S51, there may be no response from the nearby vehicles. In such a case, it is considered as an abnormal platoon state, which makes it impossible to depart from the platoon normally. Thus, the departure processor 15 may stop the platoon travel, and may shift to a manual travel mode in the departure error process, for example. In other words, the processor 15 instructs a vehicle driver to depart from the platoon by performing an accelerator operation and/or a steering operation. These Steps S52, S57, and S58 may be omitted in some cases.

In Step S53, it is determined whether the other departing vehicle confirmation has been complete. At such a time, the departure processor 15 determines based on the confirmation result of the other departing vehicle transmitted from the non-departing vehicle. When it is determined that the other departing vehicle confirmation has been complete, the process proceeds to Step S54, and, when it is determined that the confirmation has not yet been complete, the determination in Step S53 will be repeated. In Step S54, the departure acceptance information is received. At such a time, the departure processor 15 receives the departure acceptance information via the antenna 21, the communication device 20, and the communication part 11.

In Steps S55 and Step S65, the departing vehicle and non-departing vehicles perform a synchronization process. This synchronization process is performed for a synchronization between the departing vehicle and non-departing vehicles, for the departure of a vehicle that would like to depart from the platoon, as well as a synchronization among the platoon vehicles (i.e., among the non-departing vehicles). The departure processor 15 of the departing vehicle and the departure processor 15 in each of the non-departing vehicles synchronize with each other via the antenna 21, the communication device 20, and the communication part 11 which are disposed in each of those vehicles, for performing a platoon departure process.

In Steps S56 and Step S65, each of the departing vehicle and non-departing vehicles performs the platoon departure process. Here, this platoon departure process is explained with reference to the example of FIG. 11. In the example of FIG. 11, if the platoon arrives at the point B which is a depart point of the large-size vehicle CL1 and the small-size vehicle CS3 as shown in a row of timing t2, the large-size vehicle CU and the small-size vehicle CS3 departs from the platoon. As shown in a row of timing t3, the platoon after the departure of the large-size vehicle CL1 and the small-size vehicle CS3 is composed of the large-size vehicles CL2, CL3 and the small-size vehicles CS1, CS2.

As described above, the platoon is organized to have the departing vehicle to depart either from the top of the platoon or from the tail end of the platoon. Therefore, in the platoon departure process in Steps S56 and S65, the vehicle is controlled to depart from at least one of the top of the platoon or the tail end of the platoon. That is, in the present embodiment, a vehicle is enabled to depart from the top of the platoon or the tail end of the platoon as shown in FIG. 11.

After the completion of the platoon departure process, the departure processor 15 of each of the platoon vehicles updates the platoon information which is held therein, for reflecting, to the platoon information, a position of each vehicle, the number of vehicles in each of the vehicle groups and the like. In other words, after a departing vehicle has departed from the platoon, the departure processor 15 of a non-departing vehicle updates the platoon information. The updated platoon information may also be called the post-departure platoon information.

Further, the departure processor 15 of each of the platoon vehicles may be configured to transmit the updated platoon information to other platoon vehicle(s) via the communication part 11, the communication device 20, and the antenna 21 as mentioned above. Then, it may be determined by the ECU 10 of each of the platoon vehicles whether the platoon information held in each of the platoon vehicles matches the platoon information received from the other platoon vehicle(s).

When it is determined by an ECU 10 that the platoon information held therein and the platoon information received from the other platoon vehicle(s) do not match, the ECU 10 updates the platoon information held therein by overwriting the information in the self vehicle by the platoon information received from the other platoon vehicle(s).

In the above-described manner, the same platoon information is shared with all platoon vehicles. Such an update and transmission of the platoon information may be performed at any timing after the completion of the platoon departure process.

As explained in the above, by grouping the vehicles having the first range projection areas in the top group of the platoon and by grouping the vehicles having the second range projection areas in the tail end group of the platoon, the platoon travel system of the present embodiment enables that the second range projection area vehicles are positioned to follow the first range projection area vehicles. Thus, the vehicles in the tail end group have lower travel resistance than if they traveled alone without having the top group. As a result, the whole platoon energy consumption is reduced.

Further, the platoon travel system prevents the deterioration of whole platoon energy consumption by positioning the vehicles in an ascending order of depart point distances in the top group and by positioning the vehicles in a descending order of depart point distances in the tail end group in the top group, a vehicle order from a top of the platoon is a near depart point vehicle to a far depart point vehicle, and, in the tail end group, a vehicle order from a tail end toward the top of the platoon is a near depart point vehicle to a far depart point vehicle).

In other words, the platoon organization/re-organization in the above-described manner always makes the departing vehicle depart either from a top of the platoon or a tail end of the platoon. In such manner, the platoon will be less frequently collapsed. To put it differently, a post-departure space 220 in the platoon caused by the departure of a platoon vehicle will be less frequently generated.

Therefore, the platoon travel system of the present disclosure prevents deterioration of whole platoon energy consumption caused by the post-departure space 220 in the platoon. In other words, the deterioration of whole platoon energy consumption in a period after a collapse of the platoon and before re-organization of the platoon (i.e., during the platoon reform period) is prevented by the platoon travel system of the present disclosure.

However, as mentioned above, the platoon travel system of the present disclosure may simply organize a platoon in the "larger projection area vehicle first" manner, without considering a grouping of vehicles and/or depart points of the vehicles. In such case, in the platoon departure process in Steps S56 and Step S65, a vehicle other than the top vehicle of the platoon or the tail end vehicle of the platoon may depart from the platoon.

Therefore, in Steps S65 and Step S66, the inter-vehicle distance between each of the vehicles in the platoon (i.e., between platoon vehicles) is adjusted to a preset distance when a vehicle departs from a platoon (i.e., an inter-vehicle distance adjustment unit in the claims). In particular, when a vehicle departs from a platoon, an inter-vehicle distance between a vehicle just in front of a departing vehicle and a vehicle just behind the departing vehicle is adjusted to a preset distance (i.e., an inter-vehicle distance adjustment unit in the claims). Further, when a vehicle departs from a platoon, the inter-vehicle distance is adjusted by decelerating, as the decel-target vehicles, front platoon vehicles in front of the departing vehicle (i.e., an inter-vehicle distance adjustment unit, a deceleration unit in the claims). Note that the platoon vehicle in this context means vehicles in the platoon after the departure of the departing vehicle from the platoon.

Here, the departure time process is explained assuming that the small-size vehicle CS1 departs from the platoon shown at timing t1 of FIG. 11. When the small-size vehicle CS1 departs from the platoon shown at timing t1 of FIG. 11, the post-departure space 220 is generated between the large-size vehicle CL3 and the small-size vehicle CS2.

Therefore, by decelerating the large-size vehicles CL1-CL3 which are the platoon vehicles ahead of the departing vehicle, the post-departure space 220 is made small (i.e., a speed reduction control, an inter-vehicle distance adjustment unit in the claims). At such time, the departure processor 15 in each of the large-size vehicles CL1-CL3 outputs the drive information which shows deceleration at a constant rate to the travel system components 80 via the output part 16. In other words, the present disclosure adjusts the inter-vehicle distance by decelerating the platoon vehicles at a time of departure of a vehicle from the platoon. Further, when the post-departure space 220 is made small by the deceleration, the large-size vehicles CL1-CL3 preferably return to the pre-deceleration speed by accelerating at a constant rate. Note that the acceleration here is for returning the vehicle speed (i.e., the speed of the large-size vehicles CL1-CL3) to the pre-deceleration speed, which was caused for the reduction of the post-departure space 220. Therefore, the speed of these vehicles in the course of regaining to the platoon travel speed will not exceed the pre-deceleration speed.

Thus, by decelerating the platoon vehicles for the reduction of the post-departure space 220, the travel resistance is reduced and deterioration of the energy consumption is prevented, in comparison to the reduction of the post-reduction space 220 by the acceleration of the vehicles after the departing vehicle. Further, by preventing the deterioration of the energy consumption, the travel distance of the platoon vehicle is extended.

Further, when reducing the post-departure space 220 by accelerating the vehicles behind the departing vehicle, the vehicles behind the departing vehicle must be accelerated to the speed that exceeds the speed of the platoon travel. However, when the vehicles behind the departing vehicle are less powerful (e.g., in case that the vehicle is a small/compact vehicle or the like), it may be difficult to reduce the post-departure space 220. On the other hand, since the present disclosure decelerates the platoon vehicles for the reduction of the post-departure space 220, even when the vehicles behind the departing vehicle are less powerful, the reduction of the post-departure space 220 is securely performed.

Here, a method of decelerating, for the reduction of the post-departure space 220, the decel-target vehicles when a sensor which detects an inter-vehicle distance to the behind vehicle is adopted as the nearby information sensor 40 is explained. The ECU 10 in each of the platoon vehicles acquires the information which shows the inter-vehicle distance to the behind vehicles from the nearby information sensor 40 (i.e., a second acquisition unit in the claims).

Then, the ECU 10 in each of the decel-target vehicles ahead of the post-departure space 220 adjusts, to the specified distance, the inter-vehicle distance to the just-behind vehicle, by decelerating the self-vehicle based on the information about the inter-vehicle distance while confirming the inter-vehicle distance to the just-behind vehicle (i.e., an inter-vehicle distance adjustment unit in the claims). In particular, the ECU 10 in one of the decel-target vehicles, which is immediately in front of the post-departure space 220 decelerates the vehicle while confirming the inter-vehicle distance to the just-behind vehicle, for reducing the post-departure space 220 (i.e., an inter-vehicle distance adjustment unit in the claims). In other words, the ECU 10 in the just-ahead vehicle, which is one of the decel-target vehicles in front of the post-departure space 220, adjusts the inter-vehicle distance to the just-behind vehicle to the specified distance.

The processing at a time of departure of a vehicle from the platoon is a process that is conducted by the departure processor 15, i.e., the processor 15 serving as a subject of such process. Further, when transmitting the information which shows the inter-vehicle distance, when acquiring the information which shows the inter-vehicle distance, and when accelerating/decelerating the self-vehicle, the departure processor 15 behaves in the same manner as the join-in processor 14. Therefore, a detailed explanation of the departure processor 15 is omitted.

In other words, when a sensor which detects an inter-vehicle distance to the behind vehicle is adopted as the nearby information sensor 40, the platoon travel system decelerates, as the decel-target vehicle, all front vehicles ahead of the departing vehicle, for the adjustments of the inter-vehicle distance (i.e., an inter-vehicle distance adjustment unit in the claims). In the course of such adjustment, the platoon travel system adjusts the inter-vehicle distance between each of the platoon vehicles to the specified distance while reducing a wide gap of the post-departure space to the preset inter-vehicle distance (i.e., an inter-vehicle distance adjustment unit in the claims).

In such manner, when a sensor which detects an inter-vehicle distance to the behind vehicle is adopted as the nearby information sensor 40, each of the decel-target vehicles detects by itself the inter-vehicle distance, for the reduction of the post-departure space 220. Therefore, when a sensor which detects an inter-vehicle distance to the behind vehicle is adopted as the nearby information sensor 40, the platoon travel system can improve an accuracy of the adjustment of the inter-vehicle distance, since such configuration will not be easily affected by the delayed response in the vehicle-to-vehicle communication, or the like.

Next, a method of decelerating, for the reduction of the post-departure space 220, the decel-target vehicles when a sensor which detects an inter-vehicle distance to the front vehicle is adopted as the nearby information sensor 40 is explained.

The ECU 10 in each of the platoon vehicles acquires the information which shows the inter-vehicle distance to the front vehicle from the nearby information sensor 40 (i.e., a first acquisition unit in the claims). Further, the ECU 10 in each of the platoon vehicles transmits the acquired information which shows the inter-vehicle distance to the vehicles in front of the self-vehicle through the vehicle-to-vehicle communication by using the communication device 20 (i.e., a first transmission unit in the claims). Further, when transmitting the acquired information which shows the inter-vehicle distance, the ECU 10 in each of the platoon vehicles transmits the acquired information at predetermined intervals.

Then, the ECU 10 in the decel-target vehicle immediately ahead of the departing vehicle decelerates the self-vehicle based on the information of the inter-vehicle distance from the just-behind vehicle while confirming the inter-vehicle distance to the just-behind vehicle (i.e., an inter-vehicle distance adjustment unit in the claims). In other words, a vehicle immediately ahead of the post-departure space 220 is the decel-target vehicle. Further, the ECU 10 in the decel-target vehicle immediately ahead of the post-departure space 220 adjusts the inter-vehicle distance to the just-behind vehicle to the specified distance, by decelerating the self-vehicle (i.e., an inter-vehicle distance adjustment unit in the claims). When this ECU 10 decelerates the vehicle, it outputs the drive information which instructs deceleration to the travel system component 80 via the output part 16.

In other words, when a sensor which detects an inter-vehicle distance to the front vehicle is adopted as the nearby information sensor 40, the inter-vehicle distance is adjusted by decelerating the vehicle in front of the departing vehicle as the decel-target vehicle (i.e., an inter-vehicle distance control unit in the claims). At such time, the platoon travel system adjusts the inter-vehicle distance which is indicated in the information transmitted from the just-behind vehicle of the departing vehicle to the specified distance (i.e., an inter-vehicle distance control unit in the claims). Further, the inter-vehicle distance indicated in the information transmitted from the just-behind vehicle of the post-departure space 220 corresponds to an inter-vehicle distance between a vehicle just-ahead the departing vehicle and a vehicle just-behind the departing vehicle.

Further, the platoon travel system may treat all front vehicles as the decel-target vehicles ahead of the departing vehicle when a sensor which detects an inter-vehicle distance to the front vehicle is adopted as the nearby information sensor 40. In such case, the ECU 10 in the decel-target vehicle immediately ahead of the departing vehicle adjusts the inter-vehicle distance in the above-described manner. On the other hand, based on the information which shows the inter-vehicle distance transmitted from the vehicle just behind the self-vehicle, the ECU 10 in each of the other decel-target vehicles adjusts the inter-vehicle distance to the just-behind vehicle to the specified distance, by decelerating the self-vehicle while confirming the inter-vehicle distance to the just-behind vehicle (i.e., an inter-vehicle distance adjustment unit in the claims). Further, the inter-vehicle distance indicated in the information transmitted from the just-behind vehicle of the self-vehicle corresponds to an inter-vehicle distance between the self-vehicle and the just-behind vehicle. When the ECU 10 in each of the other decel-target vehicles decelerates the vehicle, it outputs the drive information which instructs the deceleration to the travel system component 80 via the output part 16. In other words, the platoon travel system may adjust the inter-vehicle distance between each of the platoon vehicles to the preset distance by decelerate all front vehicles ahead of the departing vehicle as the decel-target vehicles (i.e., an inter-vehicle distance adjustment unit in the claims).

Further, when a sensor which detects an inter-vehicle distance to the front vehicle is adopted as the nearby information sensor 40, and in case that the post-departure space 220 is reduced, the platoon travel system may accelerate the decel-target vehicles to return the speed of those vehicles to the pre-deceleration speed. In other words, when the inter-vehicle distance between the platoon vehicles before and behind the post-departure space 220 is reduced to the specified distance, the decel-target vehicle may be accelerated to return to the pre-deceleration speed.

In such case, when the inter-vehicle distance to the just-behind vehicle becomes the specified distance, the ECU 10 in the decel-target vehicle immediately ahead of the post-departure space 220 accelerates the self-vehicle, for returning the speed of the self-vehicle to the preset speed. At such time, the ECU 10 in each of the other decel-target vehicles returns the speed of the self-vehicle to the preset speed and adjusts the inter-vehicle distance to the just-behind vehicle to the specified distance, by accelerating the self-vehicle. When the ECU 10 in the decel-target vehicle accelerates the self-vehicle, it outputs the drive information which instructs the acceleration to the travel system component 80 via the output part 16. In other words, when the post-departure space 220 is successfully reduced, the platoon travel system may adjust, to the preset distance, the inter-vehicle distance between each of the platoon vehicles constituting the platoon by returning the speed of the decel-target vehicle to the preset speed (i.e., an inter-vehicle distance adjustment unit in the claims).

In the above-described manner, even when a sensor which detects an inter-vehicle distance to the front vehicle is adopted as the nearby information sensor 40, the post-departure space 220 is reduced by the deceleration of the platoon vehicles.

Figure 13:
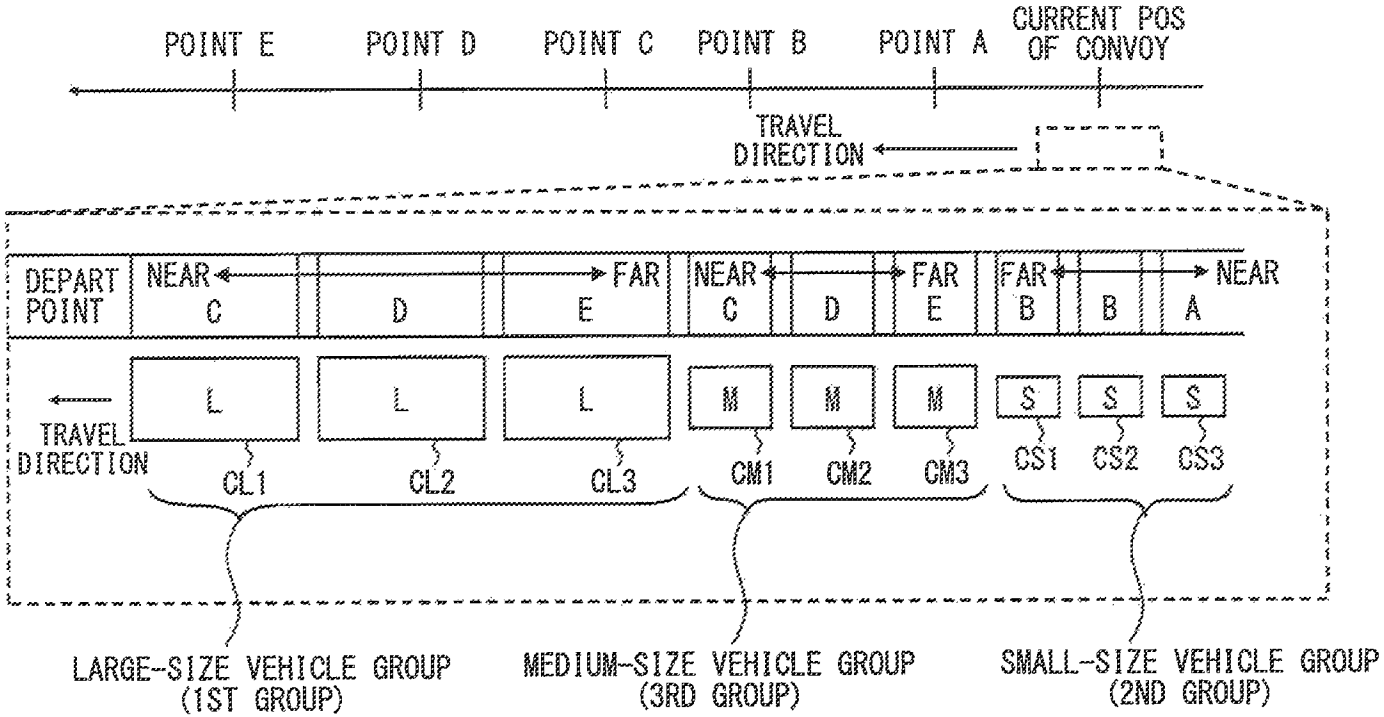
FIG. 13 is an illustration of an example of platoon in an embodiment of the present disclosure.

Even when a platoon is the one organized according to the organization rule by the platoon travel system, if a vehicle or two depart from the platoon, the platoon becomes the one that does not agree with the organization rule. That is, as shown in FIG. 13, a platoon having a third vehicle group in addition to the first vehicle group and the second vehicle group is used as an example, in which the third vehicle group is a vehicle group of medium-size vehicles. The processing at a time of organizing a platoon which has the third vehicle group will be explained later. Further, the platoon shown in FIG. 13 may also be referred to as a pre-departure platoon.

In this example, the first vehicle group includes the large-size vehicle CL1 whose depart point is the point C, the large-size vehicle CU whose depart point is the point D, and the large-size vehicle CL3 whose depart point is the point E. Further, the third vehicle group includes a medium-size vehicle CM1 whose depart point is the point C, a medium-size vehicle CM2 whose depart point is the point D, and a medium-size vehicle CM3 whose depart point is the point E. Further, the second vehicle group includes the small-size vehicle CS1 whose depart point is the point B, the small-size vehicle CS2 whose depart point is the point B, and the small-size vehicle CS3 whose depart point is the point A.

When this platoon passes the point B, all vehicles in the second vehicle group depart from the platoon. Then, the platoon after the departure of all vehicles in the second vehicle group from the platoon includes the large-size vehicle group and the medium-size vehicle group. In other words, a post-departure platoon includes the first vehicle group containing the large-size vehicles CL1-CL3 and the second vehicle group containing the medium-size vehicles CM1-CM3. Thus, the second vehicle group of the post-departure platoon is the third vehicle group of the pre-departure platoon.

Figure 14:
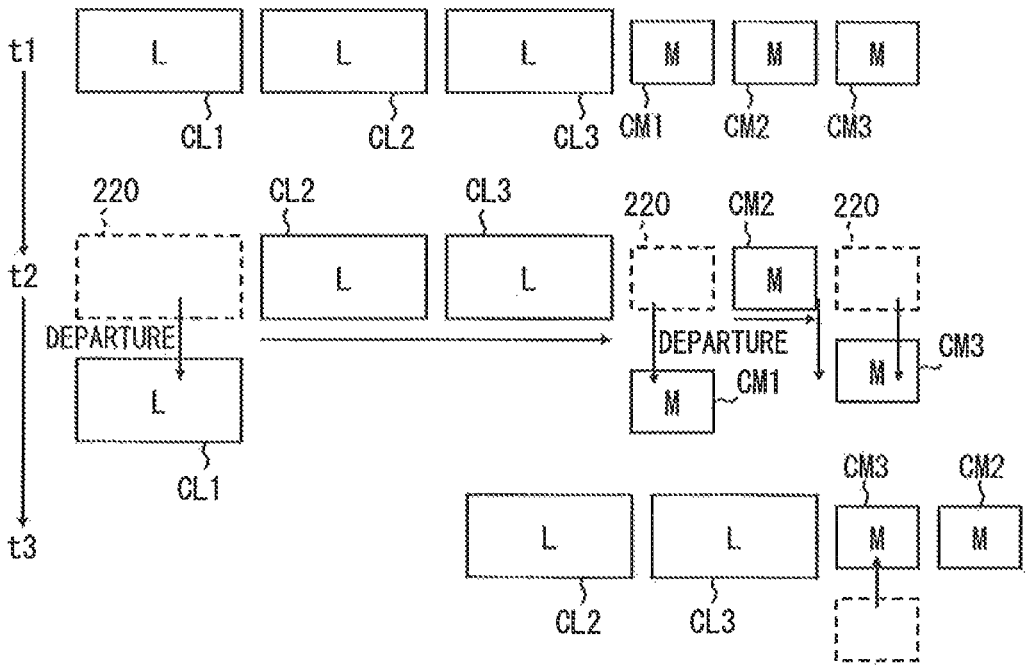
FIG. 14 is an illustration of a during-travel re-organization in an embodiment of the present disclosure.

In the first vehicle group of the post-departure platoon, vehicles are positioned in an order of depart point distances, i.e., nearer depart point vehicles positioned closer to a top of the platoon, which agrees with the organization rule. However, in the second vehicle group of the post-departure platoon, the order of the vehicle positioning does not agree with the normal organization rule that positions nearer depart point vehicles positioned closer to a tail end in (the second vehicle group of) the platoon, because farther depart point vehicles positioned closer to the tail end in the second vehicle group, i.e., in the post-departure platoon as shown in FIG. 14 at timing t1.

In such a case, the ECU 10 performs a re-organization process for re-organizing the platoon so that vehicle positioning in the platoon agrees with the organization rule. Here, the re-organization process of the ECU 10 is explained with reference to FIGS. 12A/B, FIG. 14, and FIG. 15. The platoon at timing t1 of FIG. 14 is the above-mentioned post-departure platoon.

Figure 12A:
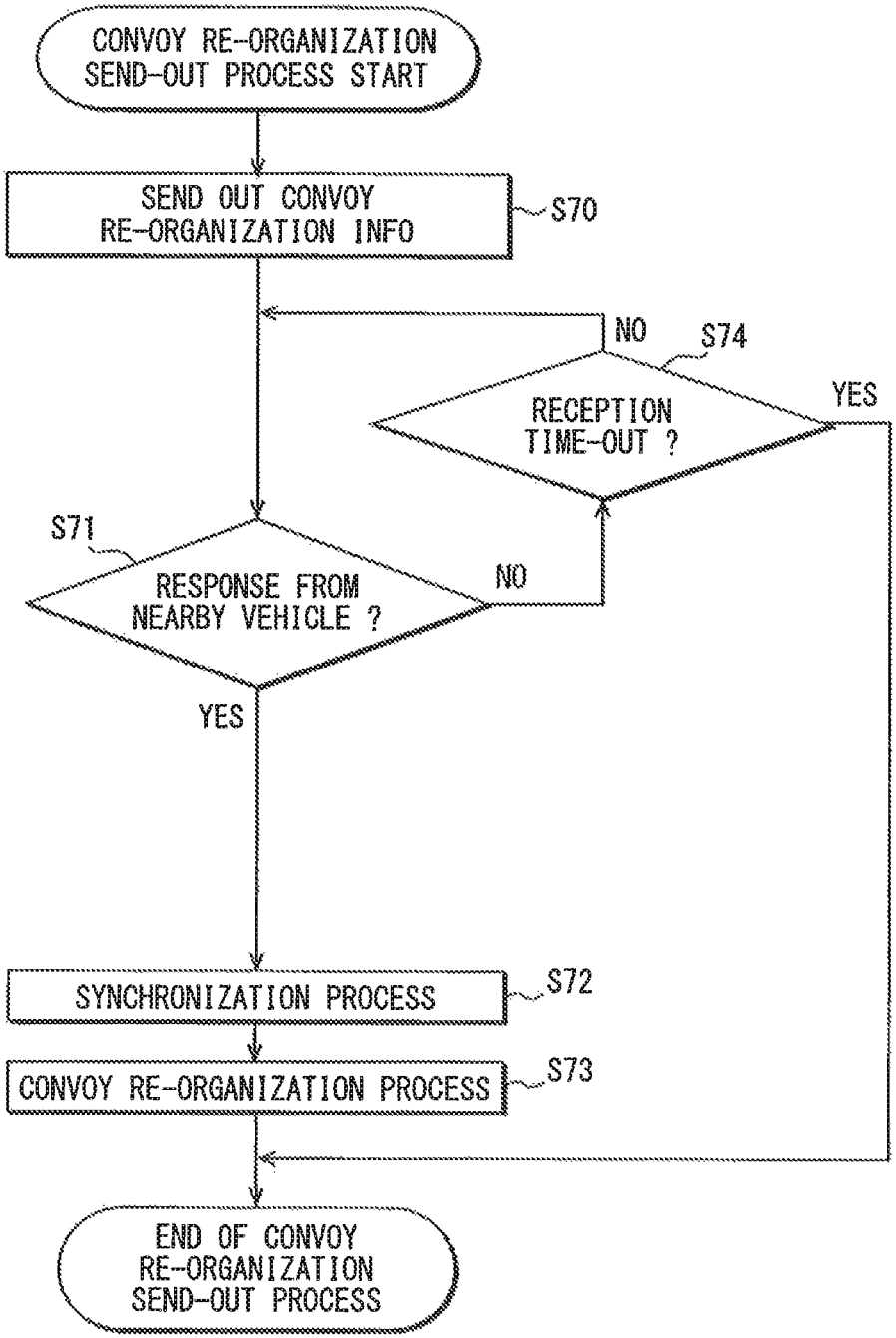
FIGS. 12A/B are flowcharts of the processing operation for a re-organization process of the platoon travel system in an embodiment of the present disclosure.
Figure 12B:
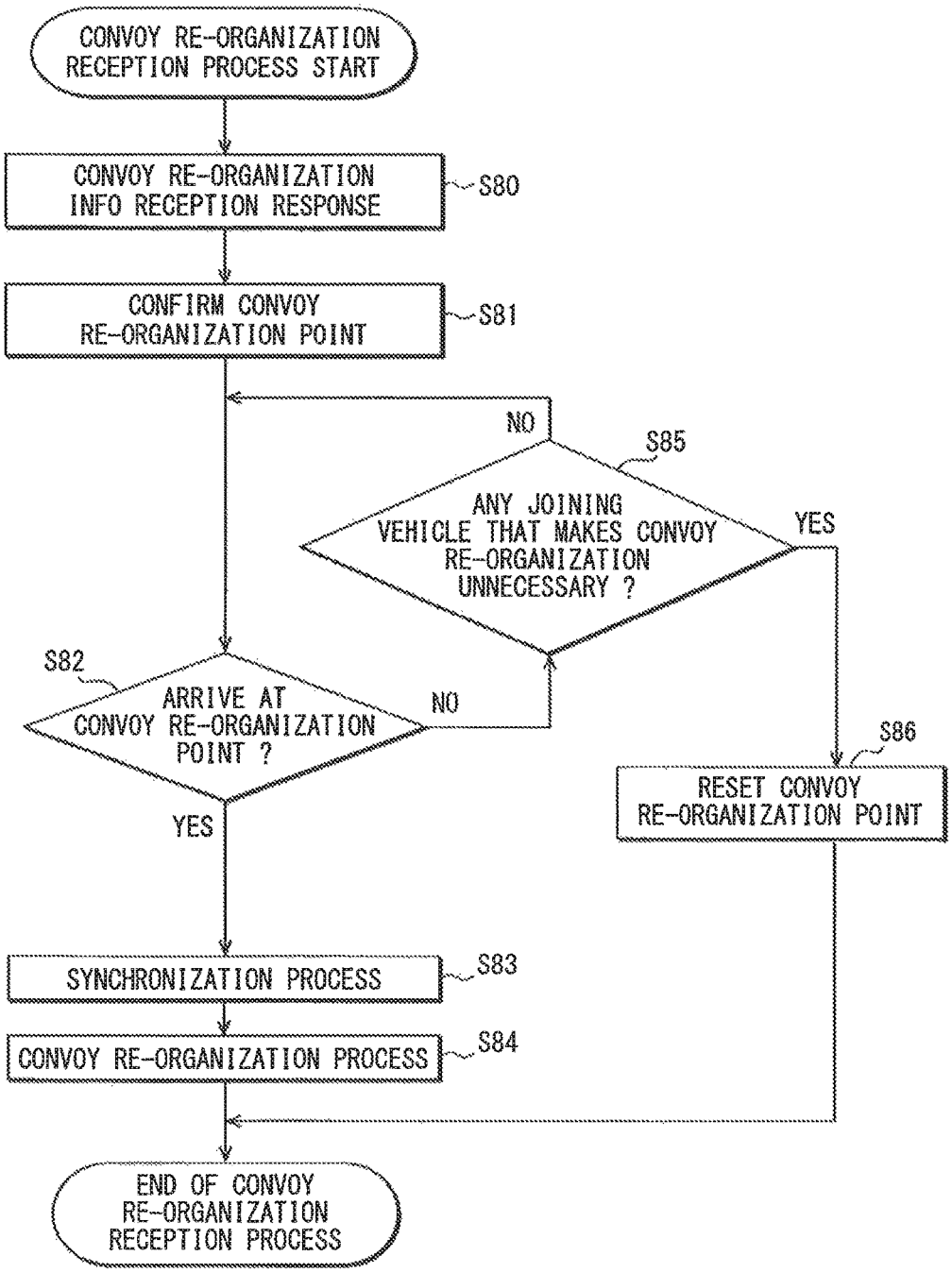

Steps S70-S74 shown in FIG. 12A show the platoon re-organization send-out process which is performed by the manager 13. When receiving an input of the re-organization request information via the antenna 21, the communication device 20, and the communication part 11, the manager 13 considers/acknowledges that it is necessary to re-organize the platoon, and performs the platoon re-organization send-out process. Alternatively, if the re-organization request information is input via the input part 12 from the user interface 60, the manager 13 considers that it is necessary to re-organize the platoon, and performs the platoon re-organization send-out process. Alternatively, if the re-organization request information is input from the departure processor 15, the manager 13 considers that it is necessary to re-organize the platoon, and performs the platoon re-organization send-out process. On the other hand, Steps S81-S88 in FIG. 12B show the platoon re-organization reception process which is performed by the manager 13. When the platoon re-organization information is input via the antenna 21, the communication device 20, and the communication part 11, the manager 13 considers/acknowledges that it is necessary to re-organize the platoon, and performs the platoon re-organization reception process. This platoon re-organization send-out process and the platoon re-organization reception process are processes which are performed by the manager 13 of the ECU 10 disposed in the vehicles participating in the post-departure platoon.

In Step S70, the platoon re-organization information is sent out. That is, the manager 13 transmits the platoon re-organization information via the communication part 11, the communication device 20, and the antenna 21.

Corresponding to such transmission, the manager 13 of the ECU 10 which has received the platoon re-organization information performs processing of Step S80. That is, in Step S80, the manager 13 responds to the platoon re-organization information which has just received. At such time, the manager 13 sends out, to the other vehicle which has participated in the post-departure platoon, response information which shows that the platoon re-organization information has been received via the communication part 11, the communication device 20, and the antenna 21. Thus, the variety of information in the pre-re-organization process (i.e., G1/G2-info) output from the manager 13 to the communication part 11 in FIG. 3 includes such response information.

On the other hand, in Step S71, it is determined whether the other platoon vehicles in the post-departure platoon have responded. That is, the manager 13 determines whether the response information sent out in the above-mentioned step S80 has been received. When the response information has been received via the communication part 11, the communication device 20, and the antenna 21, the manager 13 determines that there is a response, and the process proceeds to Step S72. On the other hand, when the response information has not been received, the manager 13 determines that there is no response, and the process proceeds to Step S74. Thus, the variety of information in the pre-re-organization process output from the communication part 11 to the manager 13 in FIG. 3 includes such response information.

In Step S74, it is determined whether it is a reception time-out. That is, the manager 13 determines whether it is a reception time-out based on whether a preset time has passed after transmission of the platoon re-organization information in Step S70. In other words, the manager 13 determines whether it is a reception time-out based on whether a response from one of the nearby vehicles has arrived in a preset time, after transmitting the platoon re-organization information in Step S70.

When it is determined that the preset time has not passed yet after transmitting the platoon re-organization information, it is determined that it is not yet a reception time-out, and the process returns to Step S71, or when it is determined that the preset time has already passed after transmitting the platoon re-organization information, it is determined that it is a reception time-out now to conclude the platoon re-organization send-out process.

On the other hand, the manager 13 which has responded to the received platoon re-organization information confirms about a platoon re-organization point in Step S81 to the other platoon vehicle (i.e., all vehicles except the self-vehicle) in the post-departure platoon. At such time, the manager 13 confirms whether the platoon is re-organized at a point at which a vehicle departs from the platoon or at a next rest point.

Since the ECU 10 shares the depart point information of platoon vehicles with the other ECUs 10, the ECU 10 knows a next point at which a vehicle departs from the platoon. Further, the ECU 10 recognizes where the next rest point would be when a service area, a rest area or the like is set up as a relay point by the navigation device 30. Thus, the ECU 10 recognizes nearer one of the above two points (i.e., one of the next depart point or the relay point) as a platoon re-organization point.

In Step S82, the manager 13 examines whether it has arrived at the platoon re-organization point. At such time, by comparing the platoon re-organization point confirmed in Step S81 with the current position acquired from the navigation device 30 via the input part 12, the manager 13 confirms whether the platoon has arrived at the platoon re-organization point. When it is determined that the platoon has arrived at the platoon re-organization point, the process proceeds to Step S83, and, when it is determined that the platoon has not arrived at the platoon re-organization point, the process proceeds to Step S85. Further, an arrival of the platoon at the platoon re-organization point may be confirmed mutually by two or more ECU 10*s* disposed in the platoon vehicles.

In Step S85, it is determined whether there is any joining vehicle that makes the platoon re-organization unnecessary. That is, the manager 13 determines whether there is any joining vehicle(s) that would like to join in the platoon and whether such joining of new vehicle(s) would make the re-organization of the platoon unnecessary. When it is determined that there is/are joining vehicle(s) which makes the platoon reorganization unnecessary, the process proceeds to Step S86, and, when it is determined that there is no joining vehicle which makes the platoon reorganization unnecessary, the process returns to Step S82.

Under a certain circumstance, join-in of a new vehicle or vehicles makes the platoon re-organization unnecessary. Therefore, when there is a joining vehicle, processing of Step S10 and subsequent processes as well as processing of Step S20 and subsequent processes shown in the above-mentioned FIGS. 5A/B are performed. The manager 13 can then determine whether there is any platoon joining vehicle that makes the platoon re-organization unnecessary by acquiring the platoon information from the communication part 11 and confirming the acquired platoon information. Thus, in FIG. 3, the variety of information of the during-re-organization process that is to output from the communication part 11 to the manager 13 (i.e., G-2 info) includes the platoon information.

In Step S86, the platoon re-organization point is reset, and it is notified to all vehicles that are performing the platoon travel. At such time, the manager 13 sends out a reset signal which shows a reset of the platoon re-organization point via the communication part 11, the communication device 20, and the antenna 21 to the other vehicles which are in the post-departure platoon.

In Steps S72 and Step S83, a synchronization process is performed in the vehicles participating in the post-departure platoon. The synchronization process is a processing which synchronizes all platoon vehicles participating in the post-departure platoon, in order to re-organize the platoon. The manager 13 of each of the platoon vehicles participating in the post-departure platoon synchronizes with each other of platoon the re-organization process via the antenna 21, the communication device 20, and the communication part 11 which are disposed in each of those vehicles, for performing the platoon re-organization process.

In Steps S73 and Step S84, each of the vehicles in the post-departure platoon performs the platoon re-organization process (i.e., a third drive unit in the claims). Here, the platoon re-organization process is explained with reference to an example of FIG. 14 and FIG. 15.

Figure 15:
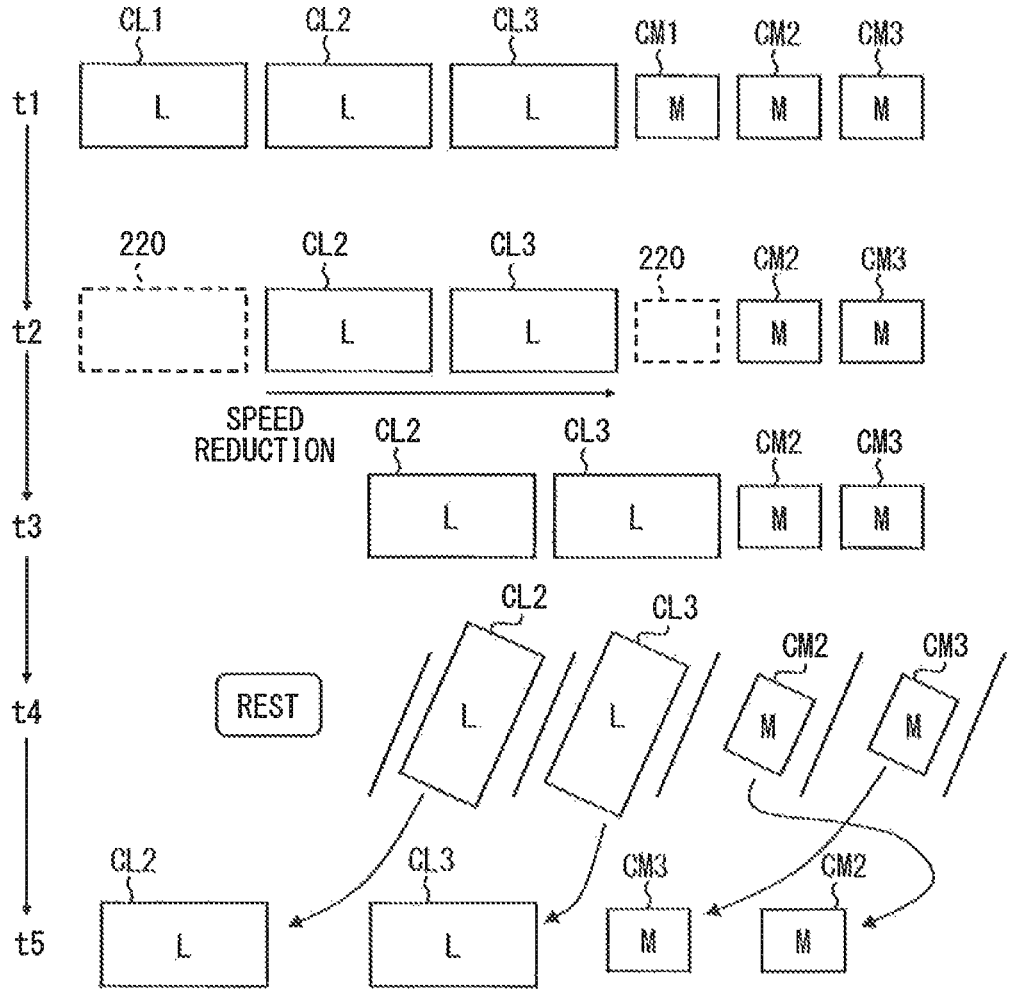
FIG. 15 is an illustration of a rest-stop time re-organization in an embodiment of the present disclosure.

FIG. 14 is an illustration of how the platoon re-organization process is performed during the travel of the platoon at the next point (i.e., the point C) where a departing vehicle departs from the platoon, and FIG. 15 is an illustration of how the platoon re-organization process is performed at the next rest point.

First, the example of FIG. 14 is explained first. The platoon at timing t1 of FIG. 14 shows a post-departure platoon in which all vehicles in the second vehicle group have departed from the platoon when the platoon in FIG. 13 has arrived at the point B. When the platoon in FIG. 14 arrives at the point C, the large-size vehicle CL1 and medium-size vehicle CM1 will further depart from it.

The post-departure platoon, from which the large-size vehicle CL1 and medium-size vehicle CM1 will have already departed from the platoon in FIG. 14, will have a following order of vehicles when the platoon re-organization process will not be performed. That is, in the post-departure platoon, the large-size vehicle CL2 is positioned at a top, and then the large-size vehicle CL3, the medium-size vehicle CM2, and the medium-size vehicle CM3 respectively follow in this order. Thus, in the post departure vehicle positioning, the first vehicle group includes the large-size vehicle CL2 and the large-size vehicle CL3, and, the second vehicle group includes the medium-size vehicle CM2 and the medium-size vehicle CM3, thereby causing no problem in terms of larger projection area vehicles traveling in a front part of the platoon. However, in the second vehicle group, the medium-size vehicle CM3 whose depart point is the point E is positioned behind the medium-size vehicle CM2 whose depart point is the point D. In other words, when the platoon arrives at the point D, the medium-size vehicle CM2 positioned in front of the medium-size vehicle CM3 that is a tail end vehicle of the platoon departs from the platoon earlier than the vehicle CM3, which leads to a collapse of the platoon. That is, this post-departure vehicle does not agree with the organization rule in the present disclosure.

Therefore, when the platoon arrives at the point C as shown at timing t2 of FIG. 14, the platoon re-organization process will be performed (i.e., a third drive unit in the claims). Further, after the departure of the large-size vehicle CL1 and the medium-size vehicle CM1 from the platoon at the point C, a position at a top of the platoon (i.e., a position which was occupied by the large-size vehicle CL1) and a position between the large-size vehicle CL3 and medium-size vehicle CM2 are left as two vacant positions, i.e., respectively as a the post-departure space 220. In such a case, in order to change the travel order of the medium-size vehicle CM2 and the medium-size vehicle CM3, the medium-size vehicle CM3 changes lanes once (i.e., a drive control). Then, the medium-size vehicle CM3 re-joins into the post-departure space 220 (i.e., a drive control).

As described in the above, by re-organizing the platoon while the platoon is travelling, the number of platoon collapses is reduced, and the energy consumption of the platoon is reduced.

Further, at a position between the large-size vehicle CL3 and the medium-size vehicle CM2, a join-in space 210 for accommodating a medium-size vehicle may be provided on demand. For the re-joining of the once-lane-changed vehicle, it may be preferable to provide the join-in space 210 by decelerating vehicles behind a re-joining space. In such manner, the re-joining space may be provided in a travel resistance reduced manner, thereby preventing the deterioration of whole platoon energy consumption.

Further, when the platoon re-organization process is performed, an inter-vehicle distance may be increased to a more-than-required distance. In such a case, it may be desirable to decrease the more-than-required distance by reducing the vehicle speed. In the example of FIG. 14, the inter-vehicle distance between the first vehicle group and the second vehicle group may be increased to a more-than-required distance, due to a lack of the vehicle position switching in the first vehicle group and the vehicle position switching in the second vehicle group in the course of platoon re-organization. Therefore, the large-size vehicle CL2 and the large-size vehicle CL3 in the first vehicle group may preferably reduce the inter-vehicle distance to the second vehicle group by reducing the vehicle speed. In the above-described manner, the travel resistance of the vehicles can be reduced in comparison to the inter-vehicle distance reduction by accelerating the vehicles, thereby preventing deterioration of whole platoon energy consumption.

In other words, at a time of the platoon re-organization process, a platoon vehicle may temporarily depart from the platoon, or a temporarily-departed vehicle may return to the platoon. In such case, Steps S72, S73, S83, and S84 may perform the same processing as the above-described Steps S26, S27 or the above-described Steps S65, S66.

For example, in Steps S72, S73, S83, and S84, when a temporarily-departed platoon vehicle returns to join in the platoon, the inter-vehicle distance of each of the vehicles in the platoon (i.e., between the platoon vehicles) is adjusted to the preset distance (i.e., an inter-vehicle distance adjustment unit in the claims). At the time of join-in of a new vehicle into the platoon, the inter-vehicle distance between a just-ahead vehicle of the join position and a just-behind vehicle of the join position is adjusted to the join-in allow distance, which allows a join-in of the new vehicle (i.e., an inter-vehicle distance adjustment unit in the claims). Further, at the time of join-in of the new vehicle into the platoon, the inter-vehicle distance is adjusted by decelerating, as the decel-target vehicles, the behind platoon vehicles which are behind the join position among all platoon vehicles (i.e., an inter-vehicle distance adjustment unit, deceleration unit). In such manner, the same effects as the above-mentioned Steps S26, S27 are expected.

In Steps S72, S73, S83, and S84, when the platoon vehicles depart from the platoon temporarily, the inter-vehicle distance of each of the vehicles in the platoon (i.e., between the platoon vehicles) is adjusted to the preset distance (i.e., an inter-vehicle distance adjustment unit in the claims). In particular, when a vehicle departs from the platoon, the inter-vehicle distance between a just-ahead vehicle of the departing vehicle and a just-behind vehicle of the departing vehicle is adjusted to the preset distance (i.e., an inter-vehicle distance adjustment unit in the claims). Further, when a vehicle departs from the platoon, the inter-vehicle distance is adjusted by decelerating, as the decel-target vehicles, front platoon vehicles ahead of the departing vehicle (i.e., an inter-vehicle distance adjustment unit, deceleration unit). In such manner, the same effects as the above-mentioned Step S65, S66 are expected.

The processing at the time of vehicle departure from the platoon is a process performed by the manager 13, i.e., the manager 13 serving as a subject of such process. Further, when transmitting the information which shows the inter-vehicle distance, when acquiring the information which shows the inter-vehicle distance, and when accelerating/decelerating the self-vehicle, the manager 13 behaves in the same manner as the join-in processor 14. Therefore, a detailed explanation of the manager 13 is omitted.

Next, an example in FIG. 15 is explained. The platoon shown at timing t1 of FIG. 15 is a post-departure platoon from which all vehicles in the second vehicle group have already departed at the point B when the platoon in FIG. 13 has arrived there. Therefore, when this post-departure platoon arrives at the point C as shown at timing t2 of FIG. 15, the large-size vehicle CL1 and the medium-size vehicle CM1 further depart therefrom, and the platoon does not agree with the organization rule of the present disclosure any more as shown at timing t3 of FIG. 15. In this case, all vehicles of the platoon after such departure park in a parking space, in a manner as shown at timing t4 for the rest of the travel. Whether the platoon has parked or not in a parking space may be determined based on the current position and map data of the navigation device 30. As an example of the parking space, a parking area, a service area and the like in a rest area may be considered.

Then, as shown at timing t5, when finishing rest and making a restart, the re-organization process is performed so that the platoon agrees with the organization rule of the present disclosure (i.e., a third drive unit in the claims). In other words, starting orders of the vehicles are made to realize a vehicle order so that the positioning of the vehicles in the platoon agrees with the organization rule. In the example of FIG. 15, the starting order of the vehicles are, the large-size vehicle CL2 first, with the large-size vehicle CL3, the medium-size vehicle CM3, and the medium-size vehicle CM2 following therefrom.

Thus, even when the platoon became inconsistent with the organize ion rule due to the departure of vehicle(s), the platoon is re-organized to be consistent with the organization rule by performing the platoon re-organization send-out process and the platoon re-organization reception process shown in FIG. 12. Further, by performing the platoon re-organization at a time of resuming the travel after the parking in a parking area as described above, the re-organization of the platoon is performed at a place where no travel resistance exists, thereby enabling the reduction of the energy consumption.

As explained in the above, when organizing a platoon by the plural vehicles and traveling in such manner, the energy consumption of the whole platoon can be reduced. This is because the air resistance of the self-vehicle is reduced by the vehicles traveling in front. In other words, the second vehicle positioned behind the top vehicle of the platoon and the vehicles subsequent thereto vehicle can reduce the energy consumption. However, a vehicle traveling at a very top of the platoon cannot reduce the energy consumption, since there is no vehicle traveling in front of the top vehicle of the platoon.

Therefore, it may be preferable to give an incentive to a vehicle that travels at a very top of the platoon. By setting a certain incentive, a vehicle which would like to travel at the top of the platoon may be increased. As a result, the vehicles which participate/join in the platoon will increase in number, and the energy consumption in the whole platoon can be further reduced.

In order to give an incentive, the ECU 10 saves a top travel record which shows a travel history of a self-vehicle as a top of the platoon based on the platoon information and the information acquired from the navigation device 30. Since the ECU 10 disposed in each of the platoon vehicles has the platoon information, an in-platoon position of the self-vehicle and in-platoon positions of the other vehicles are recognizable. Further, the ECU 10 disposed in each of the platoon vehicles can calculate a travel distance of the self-vehicle at a top position in the platoon, based on the travel route of the platoon that is acquired from the navigation device 30. Therefore, the ECU 10 can generate the top travel record by accumulating the travel distances of the self-vehicle at the top of the platoon.

Then, the ECU 10 transmits, to a control center that is disposed outside of the vehicle, the top travel record together with identification information, such as an ID or the like, via the communication device 20 and the antenna 21. In the control center, an incentive is given to the vehicle according to the travel history in the top travel record transmitted from each of the vehicles. For example, in the control center, it is determined whether an incentive is given according to the travel history. Then, in the control center, a vehicle (i.e., an ID of a vehicle) and an incentive given to the vehicle are associated and saved. In the above-described manner, the control center can collect and manage the travel history and the vehicle information of all the vehicles that use the platoon travel system.

Further, the control center may be implemented as a control center of an ETC system (i.e., an electric toll collection system in Japan). In this case, as an incentive, a preset amount of discount for an expressway toll may be employable. In other words, the control center may provide a preset amount of discount for an expressway toll as an incentive. The preset amount of discount for the expressway toll is instantaneously provided to expressway users, thereby enabling the small entities such as an individual, a small company and the like to recognize the merit quickly.

Further, the control center may be provided as a control center of a country or of a local government. In this case, as an incentive, a tax out regarding a vehicle may be provided. In other words, the control center may provide, as an incentive, a preset amount of tax cut regarding a vehicle. Such a tax cut regarding a vehicle may be collectively provided by a large amount for a business owner or the like, thereby enabling the business owner, especially for the owner of a large business, to recognize the merit.

Further, the ECU 10 disposed in each of the platoon vehicles may mutually examine the contents of the top travel record to see whether the records are correct, for providing an approval. Such an approval can be performed based on the platoon information, for example. In this case, an incentive is given based on the information which shows such an approval (i.e., an approval result).

By devising such an approval scheme, it may be unnecessary for the control center to manage the travel history. Therefore, the control center needs to perform a control of actually provided incentives only, which leads to the cost reduction on a control center side.

Further, when giving an incentive, the incentive may be weighted according to vehicle types. For example, incentive weight for the vehicles in a large-size vehicle group may be higher, relative to incentive weight for the vehicles in a small-size vehicle group or a medium-size vehicle group. Further, incentive weight for the vehicles in a middle-size vehicle group may be higher, relative to incentive weight for the vehicles in a small-size vehicle group.

Although the present disclosure has been fully described in connection with preferred embodiment thereof with reference to the accompanying drawings, it is to be noted that various changes and modifications will become apparent to those skilled in the art.

Modification Example 1

The above-mentioned embodiment uses two types of vehicles as an example of vehicle group classification for the explanation of the platoon. However, the present disclosure is not limited to such configuration. That is, as shown in FIG. 16, three types of vehicles may also be used for organizing a platoon.

The configuration of the platoon travel system in the modification example 1 is the same as the one in the above-mentioned embodiment. Further, most of the processing operations of the platoon travel system in the modification example 1 are the same as the processing operation in the above-mentioned embodiment. Here, description is focused to the difference of the processing operation of the platoon travel system in the modification example 1 from the one in the above-mentioned embodiment.

Figure 16:
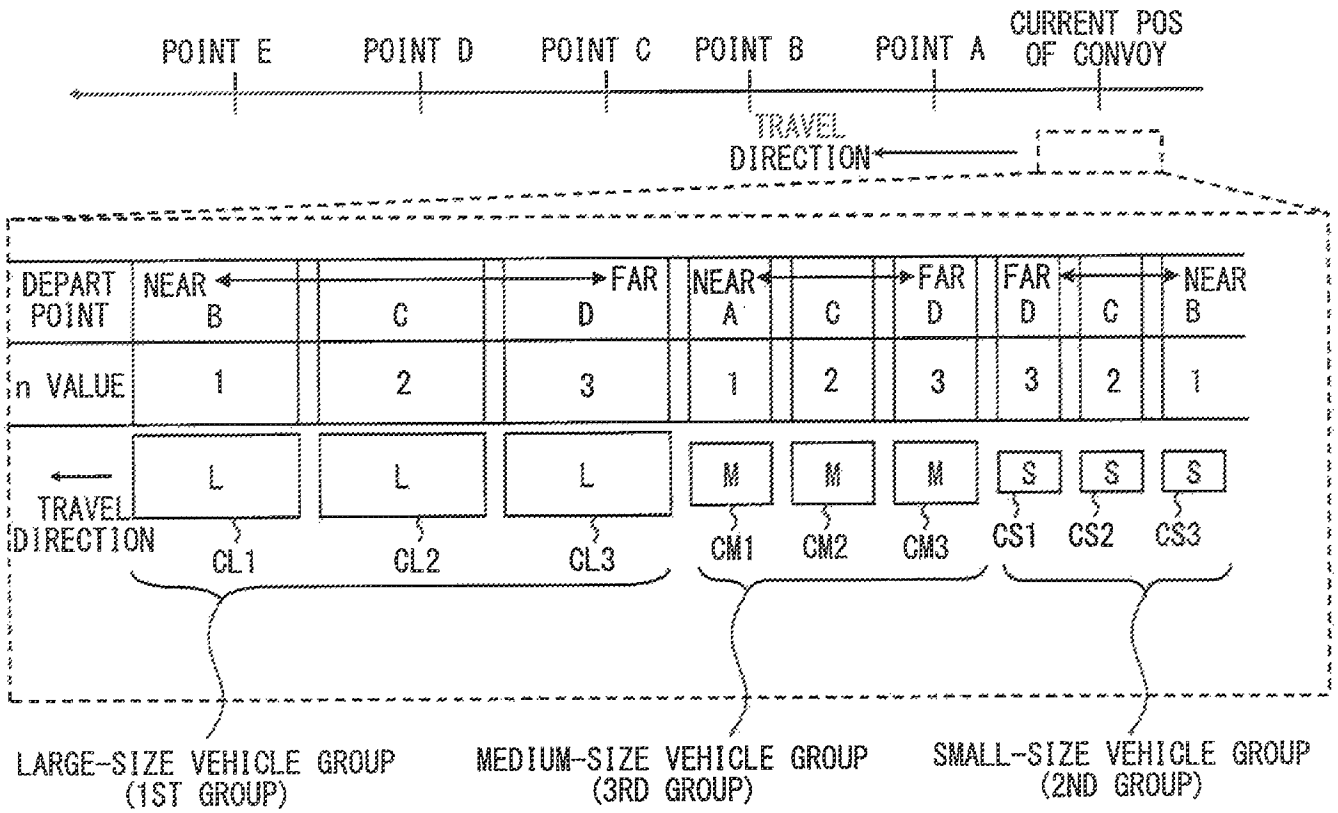
FIG. 16 is an illustration of an example of the platoon in a first modification.

In FIG. 16, the platoon includes, in addition to the first vehicle group and the second vehicle group, the third vehicle group that is a group of medium-size vehicles. In this case, the first vehicle group in FIG. 16 is the same as the first vehicle group of FIG. 8, and the second vehicle group in FIG. 16 is the same as the second vehicle group of FIG. 8.

The third vehicle group includes medium-size vehicles, the body size of which is smaller than the first range, and larger than the second range. In other words, the platoon travel system groups, as the third vehicle group, the vehicles having the body size smaller than the first range and larger than the second range. Here, as shown in FIG. 16, the third vehicle group is configured to include the medium-size vehicle CM1 to the medium-size vehicle CM3. The medium-size vehicle CM1 departs from the platoon at the point A. The medium-size vehicle CM2 departs from the platoon at the point C. The medium-size vehicle CM3 departs from the platoon at the point D.

Based on the projection area of the vehicles, the platoon travel system positions a vehicle group with large projection area vehicles as a top group of the platoon, and positions a vehicle group with small projection area vehicles as a tail end group of the platoon. Therefore, in case that there are three vehicle types respectively forming a vehicle group, an order of the vehicle groups are, from a top of the platoon toward a tail end, the first vehicle group that is a group of the large-size vehicles, the third vehicle group that is a group of the medium-size vehicles, and the second vehicle group that is a group of the small-size vehicles. In other words, the third vehicle group is positioned between the first vehicle group and the second vehicle group. Therefore, the third vehicle group may be designated as a middle vehicle group positioned in a middle of the top vehicle group and the tail end vehicle group.

Further, the platoon travel system determines the vehicle positions in the vehicle group that is a top group of the platoon, in a "near depart point vehicles come closer to platoon front" manner, just like the above-mentioned embodiment. Therefore, in the example of FIG. 16, in the first vehicle group, the large-size vehicle CU comes to a platoon top side, the large-size vehicle CU follows, and the large-size vehicle CO comes last in the vehicle order.

Further, the platoon travel system determines the vehicle positions in the second vehicle group that is a tail end group of the platoon, in a "near depart point vehicles come closer to platoon tail end" manner, just like the above-mentioned embodiment. Therefore, in the example of FIG. 16, in the second vehicle group, the small-size vehicle CS1 comes to a platoon top side, the small-size vehicle CS2 follows, and the small-size vehicle CS3 comes to the last in the vehicle order.

Further, the platoon travel system determines the vehicle positions in the third vehicle group that is a middle group of the platoon, in a "near depart point vehicles come closer to platoon front" manner. In the example of FIG. 16, in the third vehicle group, the medium-size vehicle CM1 comes to a platoon top side, the medium-size vehicle CM2 follows, and the medium-size vehicle CM3 comes last in the vehicle order.

Figure 17:
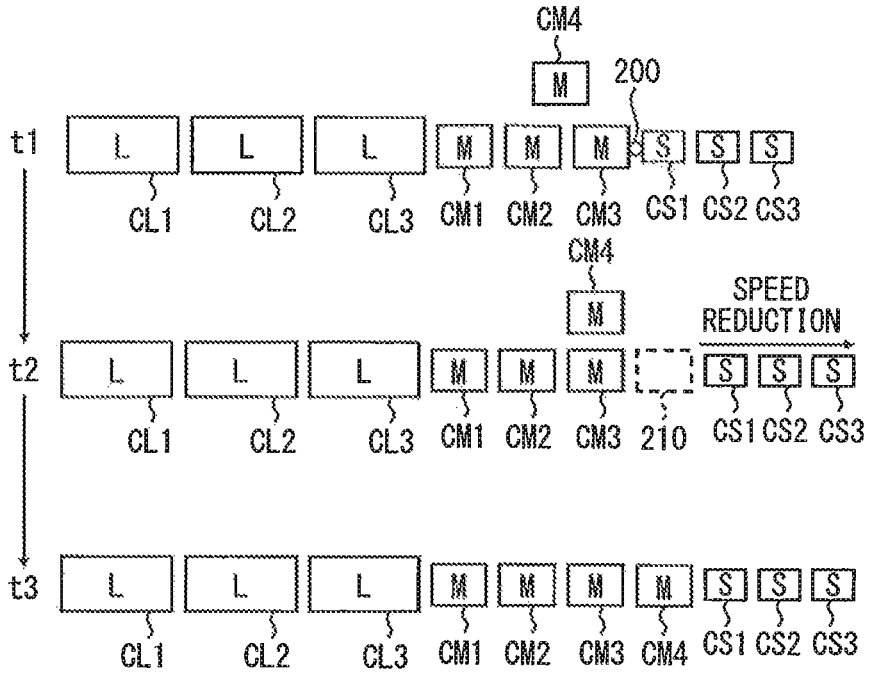
FIG. 17 is an illustration of vehicle behaviors at a join-in time in the first modification.

Here, with reference to FIG. 17, the processing operation of the platoon travel system is described in which a joining vehicle joins in the third vehicle group of a platoon that has three types of vehicles as three vehicle groups. When a vehicle joins in a platoon, the join-in processor 14 of the ECU 10 that is disposed in a joining vehicle CM4 performs the join-in send-out process as mentioned above. On the other hand, the join-in processor 14 of the ECU 10 that is disposed in at least one of the platoon vehicles performs the join-in reception process as mentioned above.

The platoon shown at timing t1 of FIG. 17 is the same as that of the platoon shown in FIG. 16. Further, in the example of FIG. 17, it is assumed as a situation in which the medium-size vehicle CM4 has shown a join-in intention and the join-in of the medium-size vehicle CM4 to the platoon has already been permitted. In other words, in this example, the medium-size vehicle CM4 is equivalent to a joining vehicle. Therefore, the vehicle CM4 may be designated as the joining vehicle CM4 hereafter. In this case, a depart point of the joining vehicle CM4 is the point E.

The join-in processor 14 in a platoon vehicle computes the join-in group of the joining vehicle CM4 based on the projection area of the joining vehicle CM4 and the projection areas of the large-size vehicles CL1-CL3, the medium-size vehicles CM1-CM3, and the small-size vehicles CS1-CS3, each of which are a vehicle participating in the current platoon. Further, the joining vehicle CM4 is a medium-size vehicle. Therefore, the projection area of the joining vehicle CM4 is within the third range. Thus, the join-in processor 14 computes the third vehicle group as the join-in group of the joining vehicle CM4. In other words, the join-in processor 14 determines the third vehicle group as the join-in group of the joining vehicle CM4.

Next, the join-in processor 14 in a platoon vehicle performs the join position determination process. As described above, when the join-in group of the joining vehicle CM4 is determined as the third vehicle group, the join-in processor 14 in the platoon vehicle performs a comparison between (i) a depart point of the joining vehicle and Op a depart point of each of the all vehicles in the join-in group, and determines the join position of the joining vehicle CM4 so that near depart point vehicles come closer to platoon front. In the example of FIG. 17, the depart point of the joining vehicle CM4 is further than the depart points of the medium-size vehicles CM1-CM3. Therefore, the join-in processor 14 in a platoon vehicle determines a position between the medium-size vehicle CM3 and the small-size vehicle CS1 as a join position 200.

In the example of this FIG. 17, the join position 200 is not the top or the tail end of the platoon. Therefore, after determining the join position 200 in this way, just like the above-mentioned embodiment, the small-size vehicles CS1-CS3 which are the platoon vehicles behind the join position 200 slows down, and reserves the join-in space 210 (i.e., at timing t2). In such manner, as shown at timing t3 of FIG. 17, the vehicle groups are positioned, from a platoon top side, in an order of the first vehicle group, the third vehicle group and the second vehicle group, and, in the third vehicle group, the vehicles are positioned, from a platoon top side, in an order of the medium-size vehicle CM1, the medium-size vehicle CM2, the medium-size vehicle CM3, and the medium-size vehicle CM4.

Figure 18:
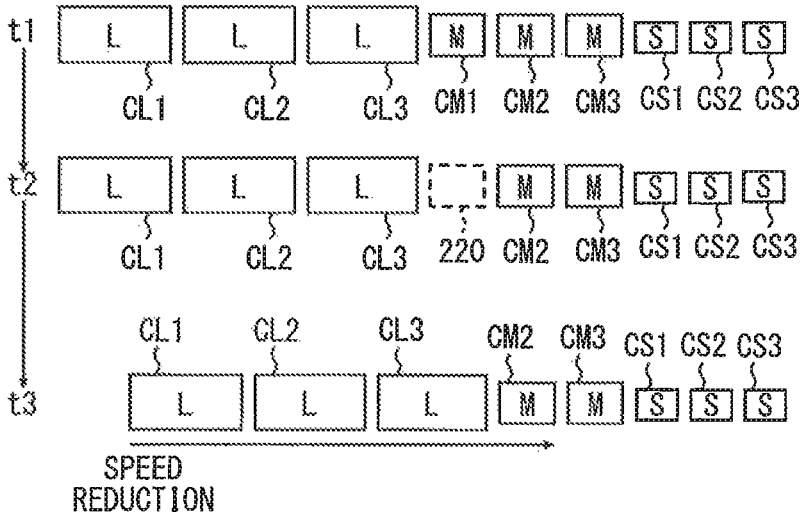
FIG. 18 is an illustration of vehicle behaviors at a departing time in the first modification.

Next, with reference to FIG. 18, the processing operation of the platoon travel system is described in which a vehicle departs from the third vehicle group of a platoon that has three types vehicles as three vehicle groups. The departure processor 15 of the ECU 10 that is disposed in a vehicle which departs from the platoon performs the departure send-out process as mentioned above. On the other hand, the departure processor 15 of the ECU 10 that is disposed in each of the platoon vehicles other than a departing vehicle performs the departure reception process as mentioned above.

The platoon shown at timing t1 of FIG. 18 is the same as the platoon shown in FIG. 16. When the platoon shown at timing t1 of FIG. 18 arrives at the point A, the medium-size vehicle CM1 will depart from it. In this case, unlike the above-mentioned embodiment, when the medium-size vehicle CM1 departs from the platoon, the post-departure space 220 is formed in the middle of the platoon (i.e., at timing t2).

Then, just like the above-mentioned Steps S56 and S65, by the platoon departure process performed in each of the departing vehicle and non-departing vehicles, the post-departure space 220 is made small. In other words, an inter-vehicle distance between the vehicles positioned before and behind the post-departure space 220 is reduced. At such time, the departure processor 15 of the ECU 10 disposed in the platoon vehicles ahead of the post-departure space 220 outputs the drive information which shows slowing down at a constant rate (i.e., a speed reduction control) to the travel system component 80 via the output part 16, as shown at timing t2. In the example of FIG. 18, the large-size vehicles CL1-CL3 slow down at a constant rate. The platoon vehicles ahead of the post-departure space 220 return to a pre-slowdown speed by accelerating at a constant rate, after the slowdown and reduction of the post-departure space 220. In the above-described manner, the travel resistance is reduced and deterioration of the energy consumption is prevented in comparison to a control that accelerates the platoon vehicles behind the post-departure space 220.

Further, the post-departure space 220 may be made small by decelerating the platoon vehicles ahead of the post-departure space 220 and accelerating the platoon vehicles behind the post-departure space 220. In the above-described manner, the post-departure space 220 can be more quickly made smaller in comparison to a case in which the platoon vehicles are decelerated for the reduction of the post-departure space 220. That is, a platoon collapse time is reduced in comparison to the same reduction control for reducing the post-departure space 220 by the deceleration of the vehicles. Further, the post-departure space 220 may be made smaller by accelerating the platoon vehicles behind the post-departure space 220.

The platoon travel system in this modification example 1 can yield the same effects as the system described in the above embodiment. Further, a derangement of vehicle train between the medium-size vehicles and the small-size vehicles is prevented is prevented by positioning near depart point vehicles closer to platoon front in the third vehicle group positioned in the middle of the platoon. Therefore, the travel of the small-size vehicles that are less powerful in comparison to the large-size vehicle or the medium-size vehicle is made smoother.

Further, by positioning near depart point medium-size vehicles closer to a front in a travel direction, the disturbance of air resistance caused by a departure of the medium-size vehicle from the platoon, which affects the travel of the small-size vehicles, is made less frequent, thereby preventing deterioration of the energy consumption.

Modification Example 2

When having a joining vehicle joining into the platoon or having a departing vehicle departing from the platoon, the platoon travel system may perform speed reduction control by using deceleration plan information which shows a deceleration plan for decelerating the decel-target vehicle(s), for the adjustment of the inter-vehicle distance. In the modification example 2, the platoon travel system uses such a deceleration plan. Further, in the modification example 2, the nearby information sensor 40, which detects existence of a vehicle in front of the self-vehicle as well as an inter-vehicle distance to a front vehicle, is adopted. In other words, the ECU 10 in each of the platoon vehicles acquires the inter-vehicle distance to the front vehicle from the nearby information sensor 40 (i.e., a first acquisition unit in the claims). That is, each of the platoon vehicles monitors a front of the self-vehicle. In the modification example 2, like parts have like numbers as the above embodiment and modification, and description of the like parts is not repeated for the brevity of explanation.

The deceleration plan information includes (i) decel start time information indicative of a speed reduction start time when deceleration of a vehicle speed starts, (ii) return start time information indicative of a return start time when returning of a vehicle speed to a pre-deceleration speed starts, and (iii) return end time information indicative of a return end time when returning of a vehicle speed to the pre-deceleration speed ends. The deceleration plan information further includes speed information, which further includes (iv) decel information indicative of a degree/pace of deceleration during a deceleration of a vehicle speed, and (v) accel information indicative of a degree/pace of acceleration during returning of a vehicle speed to the pre-deceleration speed. Further, the speed reduction start time may also be designated as a deceleration start time, and the return start time may also be designated as a return-to-constant-speed start time, and the return end time may also be designated as a return-to-constant-speed end time.

Further, as mentioned above, when having a joining vehicle joining into the platoon or having a departing vehicle departing from the platoon, a part of the platoon vehicles decelerates among all platoon vehicles. Vehicles performing speed reduction control under control of the deceleration plan information are the decel-target vehicles. Further, among all platoon vehicles, at least one platoon vehicle creates the deceleration plan information, which serves as a main platoon-er. Further, among the decel-target vehicles, an associate platoon-er does not create the deceleration plan information.

Figure 19:
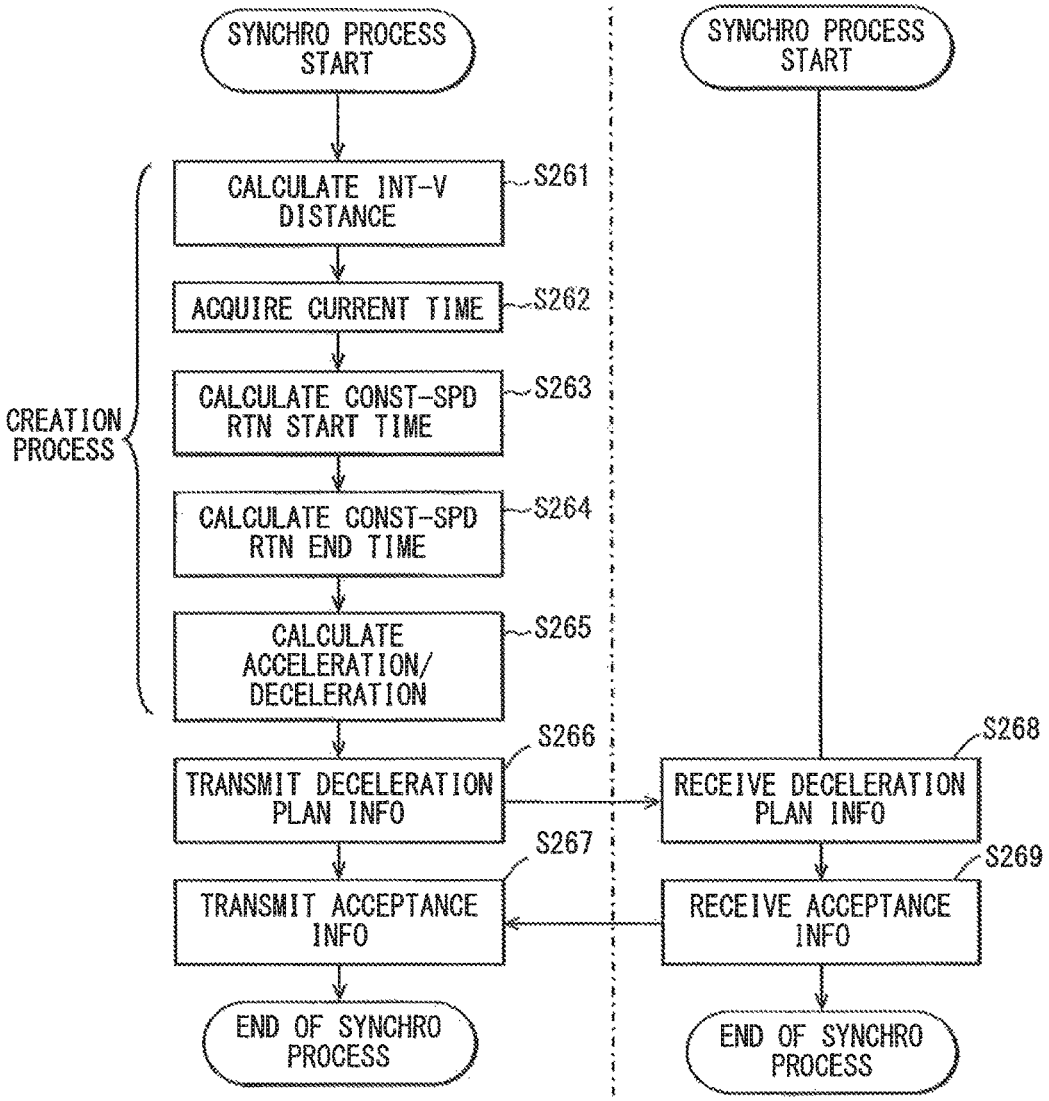
FIG. 19 is a flowchart a synchronization process by the platoon travel controller in a second modification.

A synchronization process shown in the flowchart of FIG. 19 is explained in the following. The ECU 10 performs a flowcharted process of FIG. 19 at a time of synchronization process in the above-mentioned Steps S26, S65, S72, and S83. Therefore, each of the manager 13, the join-in processor 14, and the departure processor 15 performs the flowcharted process of FIG. 19. Steps S261-S267 in FIG. 19 make up a process that is performed by the ECU 10 in the main platoon-er, and Step S268 and S269 makes up a process that is performed by the ECU 10 in the associate platoon-er.

The ECU 10 in the main platoon-er creates the deceleration plan information in Steps S261-S265. First, the inter-vehicle distance is calculated in Step S261 (i.e., a creation unit in the claims). The inter-vehicle distance is a "to-be-increased" inter-vehicle distance, or a "to-be-reduced" inter-vehicle distance. In other words, when a joining vehicle joins in the platoon, it is necessary to reserve the join-in space 210. Therefore, when a joining vehicle joins in the platoon, a "to-be-increased" inter-vehicle distance is calculated as a distance to be added to a pre-join-in distance. At such time, the ECU 10 acquires the information which shows the inter-vehicle distance to the front vehicle from the nearby information sensor 40. The ECU 10 calculates the "to-be-increased" inter-vehicle distance based on the inter-vehicle distance which is indicated in the information acquired from the nearby information sensor 40 and a predetermined joining space equivalent inter-vehicle distance.

On the other hand, when a departing vehicle departs from the platoon, it is necessary to reduce/diminish the post-departure space 220. Therefore, when a departing vehicle departs from the platoon, the "to-be-reduced" "to-be-reduced" inter-vehicle distance is calculated. At such time, the ECU 10 acquires, from the nearby information sensor 40, the information which shows the inter-vehicle distance to the front vehicle. The ECU 10 calculates the "to-be-reduced" inter-vehicle distance based on the inter-vehicle distance which is indicated in the information acquired from the nearby information sensor 40 and a predetermined inter-vehicle distance (i.e., the specified distance) between the platoon vehicles.

A current time is acquired in Step S262 (i.e., a creation unit in the claims). The ECU 10 may acquire the current time by using a real-time clock which is provided in the ECU 10 itself, or may acquire the current time from the navigation device 30. The current time is acquired in order to synchronize the following timings among the platoon vehicles, that is, the deceleration start time, the return start time, and the return end time. Further, when the current time is acquired in Step S262, the deceleration start time may be calculated.

The return-to-constant-speed start time is calculated in Step S263 (i.e., a creation unit in the claims). In other words, the return start time information is created. In Step S264, the return-to-constant-speed end time is calculated is calculated (i.e., a creation unit in the claims). In other words, the return end time information is created.

The time at which a deceleration starts, the time at which a return to the pre-deceleration speed starts, and the time at which a return to the pre-deceleration speed ends are calculated based on the current time and the predetermined specified time. A specified time A is for the calculation of the deceleration start time, a specified time B is for the calculation of the return start time, and a specified time C is for the calculation of the return end time. In such case, the deceleration start time may be calculated as a time when the specified time A has passed from the current time. Similarly, the return start time may be calculated as a time when the specified time B has passed from the current time. Further, the return end time may be calculated as a time when the specified time C has passed from the current time.

Further, the specified time A may be set to a different value according to the "to-be-increased" inter-vehicle distance, or according to the "to-be-reduced" inter-vehicle distance. In such case, the specified time A may be set to one of plural predetermined times depending on the "to-be-increased" inter-vehicle distance, and/or the "to-be-reduced" inter-vehicle distance. Similarly, the specified time B and the specified time C may also be set to one of plural predetermined times according to the "to-be-increased" inter-vehicle distance, and/or the "to-be-reduced" inter-vehicle distance.

In Step S265, the degree of deceleration during a deceleration and the degree of acceleration during a return to the pre-deceleration speed are calculated (i.e., a creation unit in the claims). In other words, the decel information and the accel information are created. The degree of deceleration is calculated based on both of the deceleration start time and the return-to-constant-speed start time calculated in the above-described manner. The degree of acceleration is calculated based on the return-to-constant-speed start time and the return-to-constant-speed end time calculated in the above-described manner.

Then, the deceleration plan information is transmitted in Step S266 (i.e., a share unit in the claims). The ECU 10 in the main platoon-er transmits the deceleration plan information, which is created in former steps prior to Step S265, to the ECU 10 in the associate platoon-er. Therefore, the ECU 10 in the associate platoon-er receives the deceleration plan information in Step S268 (i.e., a share unit in the claims). As such, by performing Steps S266 and S268, the deceleration plan information is shared among the decel-target vehicles.

The acceptance information is transmitted in Step S269. In other words, the ECU 10 in the associate platoon-er agrees to perform the speed reduction control based on the received deceleration plan information, and transmits, to the main platoon-er, the acceptance information which shows that the ECU 10 in the associate platoon-er has agreed to such control. Therefore, the ECU 10 provided in the main platoon-er receives the acceptance information in Step S267.

After the synchronization process is completed, the ECU 10 performs Steps SS27, S66, S73, and S84, as described in the above-mentioned embodiment. At such time, the ECU 10 in each of the decel-target vehicles (cooperatively) reserves the join-in space 210 according to the deceleration plan information by decelerating, and, once the join-in space 210 is reserved, the ECU 10 in each of those vehicles accelerates at constant pace to return to the pre-deceleration speed. That is, in other words, the platoon travel system decelerates, according to the deceleration plan information, the decel-target vehicles while synchronizing those decel-target vehicles (i.e., a deceleration unit in the claims).

When sharing the deceleration plan information among the decel-target vehicles, the deceleration plan information may be transmitted in a daisy-chain manner. In other words, the ECU 10 in the main platoon-er may transmit the deceleration plan information to one of the associate platoon-ers, i.e., a first associate platoon-er, and, the first associate platoon-er may then transmit the deceleration plan information to a second associate platoon-er, which is different from the first one, and may also transmit the acceptance information back to the ECU 10 of the main platoon-er. Further, the second associate platoon-er may then transmit the deceleration plan information to a third associate platoon-en which is different from the second one, and may also transmit the acceptance information back to the ECU 10 of the first associate platoon-er. In such manner, the deceleration plan information is transmitted to all the decel-target vehicles.

Figure 20:
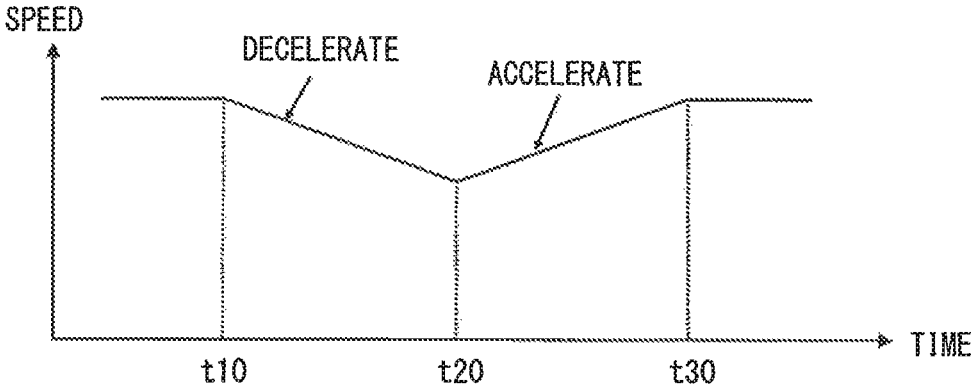
FIG. 20 is a diagram of a relationship between a vehicle speed and time in the second modification.

When the platoon vehicles perform the speed reduction control by using the deceleration plan information, the movement of each of the platoon vehicles may look like a diagram in FIG. 20. In other words, the platoon vehicles start a deceleration at a time (i.e., timing t10) set by the deceleration time information. Further, when decelerating (i.e., timing t10-t20), the platoon vehicles decelerate at constant pace that is set by the decel information. Then, at a time set by the return start time information (i.e., timing t20), the platoon vehicles start returning to the pre-deceleration speed. The platoon vehicles accelerate at the degree of acceleration set by the accel information when returning to the pre-deceleration speed (i.e., timing t20-t30). The platoon vehicles will then travel at the pre-deceleration speed, at the return end time (i.e., timing t30) that is set by the return end time information.

Figure 21:
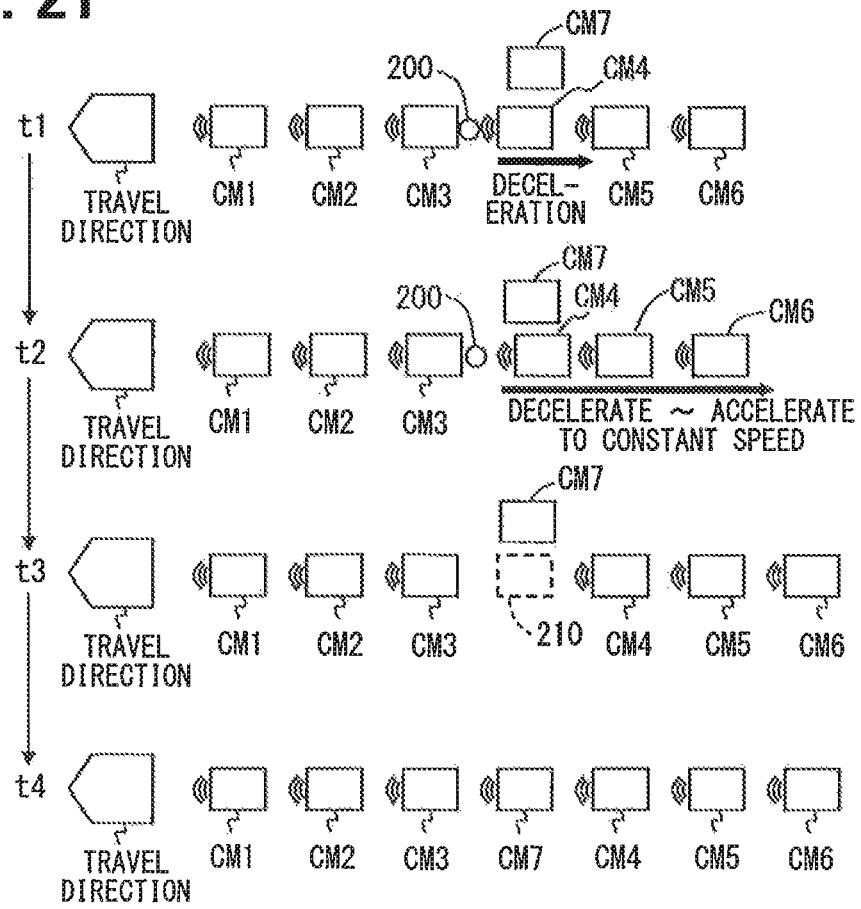
FIG. 21 is an illustration of vehicle behaviors at a time of join-in in the second modification.

Here, an example of FIG. 21 is used to describe the movement of the platoon vehicles at a time of join-in of a new vehicle into the platoon. In the example of FIG. 21, a medium-size vehicle CM7 joins in a platoon which consists of the medium-size vehicles CM1-CM6. The join position 200 of the medium-size vehicle CM7 is between the medium-size vehicle CM3 and the medium-size vehicle CM4. Further, since the ECU 10 in each of the platoon vehicles has the platoon information, and acquires the joining vehicle information from the ECU 10 of the joining vehicle, the ECU 10 can detect the join position 200 in the platoon (i.e., a join-in detection unit in the claims).

In the example of FIG. 21, the join position 200 is not at the top or at the tail end of the platoon. In such a case, in order to let the joining vehicle CM7 join in, it is necessary to reserve the join-in space 210 between the vehicles before and behind the join position 200. In other words, when a new vehicle joins in a platoon, it is necessary to reserve the join-in space 210 for the joining of the joining vehicle.

In such case, the decel-target vehicles are the medium-size vehicle CM4 to the medium-size vehicle CM6. Further, the medium-size vehicle CM4 becomes the main platoon-er, and the medium-size vehicle CM5 and the medium-size vehicle CM6 become the associate platoon-ers. The medium-size vehicle CM4 can detect that a position immediately ahead of the self-vehicle is the join position 200 based on the platoon information retained in the self-vehicle and the joining vehicle information acquired from the medium-size vehicle CM7. In other words, when the platoon vehicles respectively monitor a front of the self-vehicle, and when a joining vehicle to join in the platoon exists, the vehicles behind the join position 200 serve as the decel-target vehicles. Further, the vehicle just behind the join position 200 among the decel-target vehicles becomes the main platoon-er, and the vehicles behind the main platoon-er becomes the associate platoon-ers.

First, at timing t1 in FIG. 21, the ECU 10 of the medium-size vehicle CM4 creates the deceleration plan information, and shares the deceleration plan information among the medium-size vehicles CM4-CM6. The ECU 10 of the medium-size vehicle CM4 may start, at timing t1, the speed reduction control according to the deceleration plan information.

At timing t2, according to the deceleration plan information, the medium-size vehicles CM4-CM6 which are the platoon vehicles behind the join position 200 are decelerated, and the join-in space 210 is reserved (i.e., a speed reduction control, a deceleration unit, an inter-vehicle distance adjustment unit in the claims). In other words, the medium-size vehicles CM4-CM6 start to travel, at the deceleration start time, at the speed with the degree of deceleration which is indicated in the decel information. Then, the medium-size vehicles CM4-CM6 start to travel, at the return-to-constant-speed start time, at the speed with the degree of acceleration which is indicated in the accel information. Then, the medium-size vehicles CM4-CM6 start to travel at the pre-deceleration speed, at the return-to-constant-speed end time. In other words, after deceleration, the medium-size vehicles CM4-CM6 gradually accelerate to travel at the constant speed.

By the travel according to the deceleration plan information in the above-described manner, the medium-size vehicles CM4-CM6 reserve the join-in space 210, as shown at timing t3 in FIG. 21. Once the join-in space 210 is reserved, as shown at timing t4, the joining vehicle CM7 moves into the join-in space 210.

Figure 22:
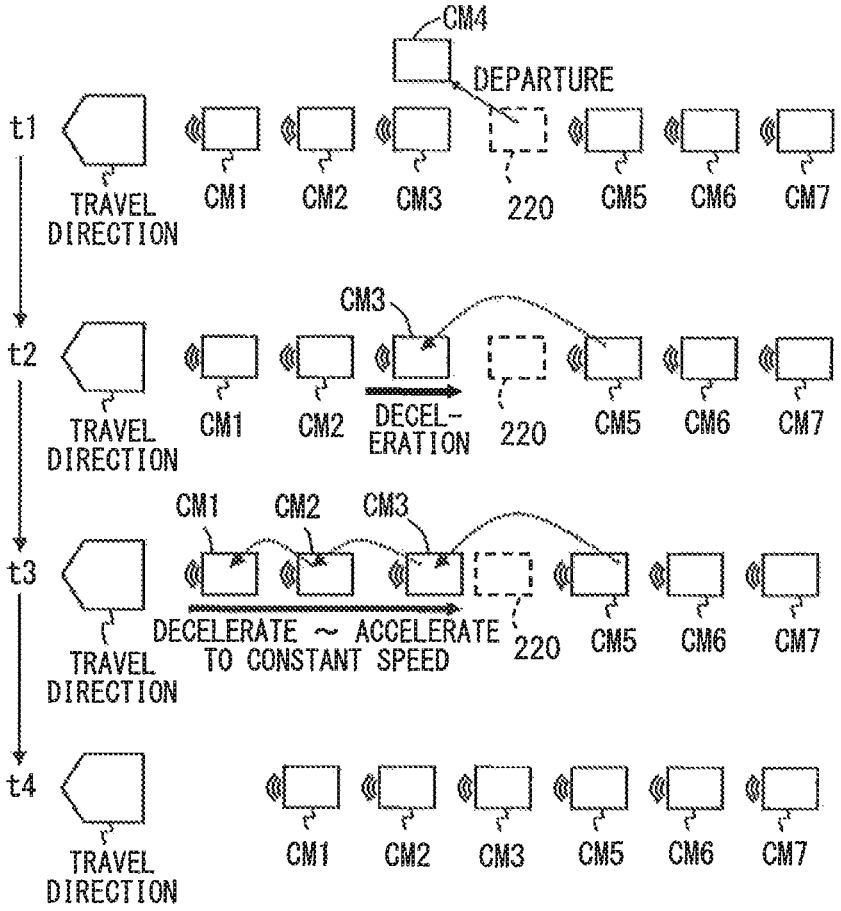
FIG. 22 is an illustration of vehicle behaviors at a time of departure in the second modification.

Next, an example of FIG. 22 is used to describe the movement of the platoon vehicles at a time of departure of a vehicle from the platoon. In the example of this FIG. 22, the medium-size vehicle CM4 departs from the platoon which consists of the medium-size vehicles CM1-CM7. The position of the medium-size vehicle CM4 in the platoon is between the medium-size vehicle CM3 and the medium-size vehicle CM5. Since the ECU 10 in each of the platoon vehicles has the platoon information, and acquires the departure position information from the ECU 10 of the departing vehicle, the ECU 10 in each of the platoon vehicles can detect the departing vehicle in the platoon (i.e., a departure detection unit in the claims). In other words, the ECU 10 of the platoon vehicles can detect the position of the departing vehicle in the platoon (i.e., a departure detection unit in the claims).

In the example of FIG. 22, the departing vehicle is not at the top or at the tail end of the platoon. In such a case, when the departing vehicle CM4 departs from the platoon, the post-departure space 220 will be left. Therefore, it is necessary to reduce such post-departure space 220.

In such case, the decel-target vehicles are the medium-size vehicles CM1-CM3. Further, the medium-size vehicle CM5 becomes the main platoon-er. Although the medium-size vehicle CM5 creates the deceleration plan information, it is not a decel-target vehicle. In other words, when the platoon vehicles respectively monitor a front of the self-vehicle, and when a vehicle departs from the platoon, the vehicles ahead of the departing vehicle serve as the decel-target vehicles, and the vehicle immediately behind the departing vehicle becomes the main platoon-er.

First, at timing t1 in FIG. 22, the medium-size vehicle CM4 departs from the platoon. At timing t2-t3, the medium-size vehicle CM5 creates the deceleration plan information, and shares the deceleration plan information with the medium-size vehicles CM1-CM3. Since the medium-size vehicle CM5 has created the deceleration plan information, the medium-size vehicle CM5 eventually shares the deceleration plan information with the medium-size vehicles CM1-CM3. The ECU 10 of the medium-size vehicle CM3 may start, at timing t2, the speed reduction control according to the deceleration plan information.

At timing t3, according to the deceleration plan information, the medium-size vehicles CM1-CM3 which are the platoon vehicles ahead of the departing vehicle are decelerated, and reduce the post-departure space 220 (i.e., a speed reduction control, a deceleration unit, an inter-vehicle distance adjustment unit in the claims). In other words, the medium-size vehicles CM1-CM3 start to travel, at the deceleration start time, at the speed with the degree of deceleration which is indicated in the decel information. Then, the medium-size vehicles CM1-CM3 start to travel, at the return-to-constant-speed start time, at the degree of acceleration which is indicated in the accel information. Then, the medium-size vehicles CM1-CM3 start to travel at the pre-deceleration speed, at the return-to-constant-speed end time. In other words, after deceleration, the medium-size vehicles CM1-CM3 gradually accelerate to travel at the constant speed. By the travel according to the deceleration plan information in the above-described manner, the medium-size vehicles CM1-CM3 reduce the post-departure space 220, as shown at timing t4 in FIG. 22.

The platoon travel system in the modification example 2 achieves the same effects as the above-mentioned embodiment. Further, in the platoon travel system of the modification example 2, each of the decel-target vehicles shares the deceleration plan information, and each of the decel-target vehicles travels according to the deceleration plan information. Therefore, each of the decel-target vehicles performs the speed reduction control synchronously, and can adjust the inter-vehicle distance accordingly. Thus, in the platoon travel system in the modification example 2, even when a variation of the vehicle speeds among the decel-target vehicles is large due to the capacity difference of the on-board units 100 etc. in the decel-target vehicles, it is not necessary to frequently perform acceleration and deceleration for the adjustment of the inter-vehicle distance. As a result, in the platoon travel system in the modification example 2, the inter-vehicle distance is smoothly adjusted.

However, when performing the platoon travel, an unexpected situation may occur, such as a steep change of the inter-vehicle distance or the like. In such a case, the ECU 10 in each of the decel-target vehicles may output the drive information to the travel system component 80, without regard to the deceleration plan information. In other words, based on the information from the nearby information sensor 40 of the on-board unit 100, the information from the behavioral information sensor 70, and by using the vehicle-to-vehicle communication by the communication device 20, the ECU 10 in each of the decel-target vehicles may perform a fail-safe control.

Modification Example 3

The nearby information sensor 40 may be a sensor that is capable of detecting existence of a vehicle behind the self-vehicle as well as an inter-vehicle distance to a behind vehicle. In the modification example 3, the platoon travel system is configured to use the deceleration plan information, while adopting the nearby information sensor 40 which detects existence of a vehicle behind the self-vehicle as well as an inter-vehicle distance to a behind vehicle. In other words, the ECU 10 in each of the platoon vehicles acquires the inter-vehicle distance to a behind vehicle from the nearby information sensor 40 (i.e., a second acquisition unit in the claims). That is, the platoon vehicles respectively monitor a back of the self-vehicle. In the modification example 3, like parts have like numbers as the above embodiment and modification, and description of the like parts is not repeated for the brevity of explanation. Further, the deceleration plan information is created in the same manner as the modification example 2.

Figure 23:
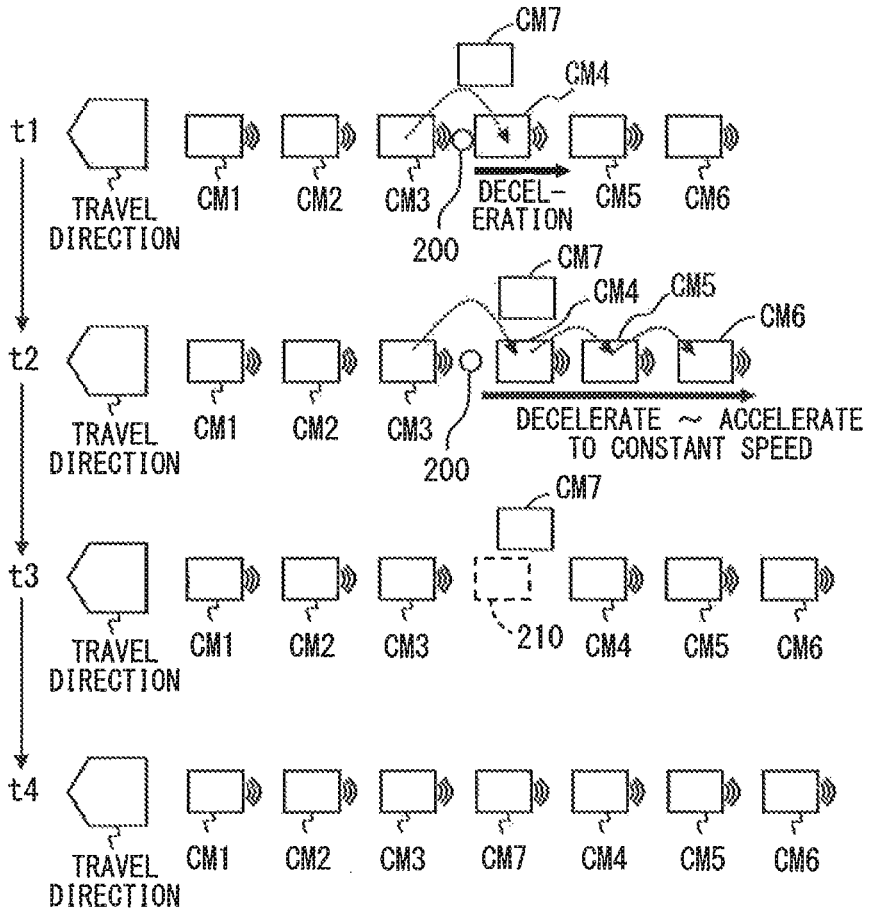
FIG. 23 is an illustration of vehicle behaviors at a time of join-in in a third modification.

First, an example of FIG. 23 is used to describe the movement of the platoon vehicles at a time of join-in of a new vehicle into the platoon. In the example of FIG. 23, the medium-size vehicle CM7 joins in a platoon which consists of the medium-size vehicles CM1-CM6. The join position 200 of the medium-size vehicle CM7 is between the medium-size vehicle CM3 and the medium-size vehicle CM4. Further, since the ECU 10 in each of the platoon vehicles has the platoon information, and acquires the joining vehicle information from the ECU 10 of the joining vehicle, the ECU 10 can detect the join position 200 in the platoon (i.e., a join-in detection unit in the claims).

In the example of FIG. 23, the join position 200 is not at the top or at the tail end of the platoon. In such a case, in order to let the joining vehicle CM7 join in, it is necessary to reserve the join-in space 210 between the vehicles before and behind the join position 200.

In such case, the decel-target vehicles are the medium-size vehicle CM4 to the medium-size vehicle CM6. Further, the medium-size vehicle CM3 becomes the main platoon-er, and the medium-size vehicles CM4-CM6 become the associate platoon-ers. The medium-size vehicle CM3 can detect that a position immediately ahead of the self-vehicle is the join position 200 based on the platoon information retained in the self-vehicle and the joining vehicle information acquired from the medium-size vehicle CM7. In other words, when the platoon vehicles respectively monitor a back of the self-vehicle, and when a joining vehicle to join in the platoon exists, the vehicles behind the join position 200 serve as the decel-target vehicles. Further, the vehicle just-ahead the join position 200 among the decel-target vehicles becomes the main platoon-er, and the vehicles behind the join position 200 becomes the associate platoon-ers.

First, at timing t1 in FIG. 23, the ECU 10 of the medium-size vehicle CM3 creates the deceleration plan information, and shares the deceleration plan information among the medium-size vehicles CM4-CM6. The ECU 10 of the medium-size vehicle CM3 may start, at timing t1, the speed reduction control according to the deceleration plan information.

At timing t2, according to the deceleration plan information, the medium-size vehicles CM4-CM6 which are the platoon vehicles behind the join position 200 are decelerated, and the join-in space 210 is reserved (i.e., a speed reduction control, a deceleration unit, an inter-vehicle distance adjustment unit in the claims). In other words, the medium-size vehicles CM4-CM6 start to travel (i.e., to decelerate), at the deceleration start time, at the speed with the degree of deceleration which is indicated in the decel information. Then, the medium-size vehicles CM4-CM6 start to travel (i.e., to accelerate), at the return-to-constant-speed start time, at the speed with the degree of acceleration which is indicated in the accel information. Then, the medium-size vehicles CM4-CM6 start to travel at the pre-deceleration speed, at the return-to-constant-speed end time. In other words, after deceleration, the medium-size vehicles CM4-CM6 gradually accelerate to travel at the constant speed.

By the travel according to the deceleration plan information in the above-described manner, the medium-size vehicles CM4-CM6 reserve the join-in space 210, as shown at timing t3 in FIG. 23. Once the join-in space 210 is reserved, as shown at timing t4, the joining vehicle CM7 moves into the join-in space 210.

Figure 24:
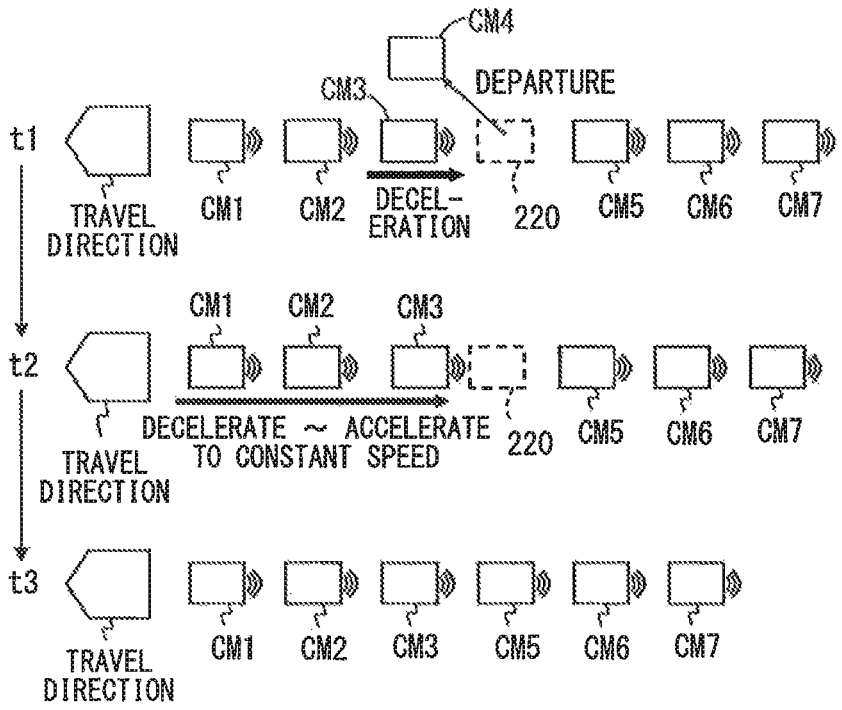
FIG. 24 is an illustration of vehicle behaviors at a time of departure in the third modification.

Next, an example of FIG. 24 is used to describe the movement of the platoon vehicles at a time of departure of a vehicle from the platoon. In the example of this FIG. 24, the medium-size vehicle CM4 departs from the platoon which consists of the medium-size vehicles CM1-CM7. The position of the medium-size vehicle CM4 in the platoon is between the medium-size vehicle CM3 and the medium-size vehicle CM5. Since the ECU 10 in each of the platoon vehicles has the platoon information, and acquires the departure position information from the ECU 10 of the departing vehicle, the ECU 10 in each of the platoon vehicles can detect the departing vehicle in the platoon (i.e., a departure detection unit in the claims).

In the example of FIG. 24, the departing vehicle is not at the top or at the tail end of the platoon. In such a case, when the departing vehicle CM4 departs from the platoon, the post-departure space 220 will be left. Therefore, it is necessary to reduce such post-departure space 220.

In such case, the decel-target vehicles are the medium-size vehicles CM1-CM3. Further, the medium-size vehicle CM3 becomes the main platoon-er. In other words, when the platoon vehicles respectively monitor a back of the self-vehicle, and when a vehicle departs from the platoon, the vehicles ahead of the departing vehicle serve as the decel-target vehicles, and the vehicle immediately ahead of the departing vehicle becomes the main platoon-er.

First, at timing t1 in FIG. 24, the medium-size vehicle CM4 departs from the platoon. At timing t2-t3, the medium-size vehicle CM3 creates the deceleration plan information, and shares the deceleration plan information with the medium-size vehicles CM1-CM2. The ECU 10 of the medium-size vehicle CM3 may start, at timing t1, the speed reduction control according to the deceleration plan information.

At timing t2, according to the deceleration plan information, the medium-size vehicles CM1-CM3 which are the platoon vehicles ahead of the departing vehicle are decelerated, and reduce the post-departure space 220 (i.e., a speed reduction control, a deceleration unit, an inter-vehicle distance adjustment unit in the claims). In other words, the medium-size vehicles CM1-CM3 start to travel, at the deceleration start time, at the speed with the degree of deceleration which is indicated in the decel information. Then, the medium-size vehicles CM1-CM3 start to travel, at the return-to-constant-speed start time, at the degree of acceleration which is indicated in the accel information. Then, the medium-size vehicles CM1-CM3 start to travel at the pre-deceleration speed, at the return-to-constant-speed end time. In other words, after deceleration, the medium-size vehicles CM1-CM3 gradually accelerate to travel at the constant speed. By the travel according to the deceleration plan information in the above-described manner, the medium-size vehicles CM1-CM3 reduce the post-departure space 220, as shown at timing t3 in FIG. 24. The effects achieved in the modification example 3 are the same as that of the modification example 2.

Modification Example 4

In the final position determination process of the above-mentioned embodiment and the modification example 1, the join position is determined based on a depart point of the joining vehicle and a depart point of each of the platoon vehicles. However, the present disclosure is not limited to such configuration. As shown in this modification example 4, in the final position determination process, a join position may be determined based on the remaining energy of the joining vehicle and the remaining energy of the platoon vehicles. Further, the platoon travel system in the modification example 4 is mostly the same as the one in the above-mentioned embodiment. Here, description is focused to the difference of the processing operation of the platoon travel system in the modification example 4 from the one in the above-mentioned embodiment.

The platoon travel system in the modification example 4 differs from the one in the above-mentioned embodiment on the following points. That is, the differences are: (i) an input of information which shows the remaining energy of the self-vehicle to the ECU 10 (i.e., the join-in processor 14), (ii) a transmission and a reception of the information which shows the remaining energy to and from the nearby vehicles, and (iii) the contents of the final position determination process. For example, in the modification example 4, the information (i.e., remaining energy information) which shows the remaining energy is acquired in Step S32 of FIG. 6.

A configuration for outputting the information which shows the remaining energy of the self-vehicle to the ECU 10 may be, for example, that the behavioral information sensor 70 acquires the remaining energy of the self-vehicle, and the sensor 70 than outputs the remaining energy of the self-vehicle. The remaining energy is, for example, a remaining amount of travel energy that is required for a travel of the self-vehicle. Therefore, in a gasoline-powered vehicle or a diesel vehicle, a remaining fuel is equivalent to the remaining energy. In a hybrid vehicle, the remaining fuel and the remaining electric power (in a battery) are equivalent to the remaining energy. The remaining electric power is equivalent to the remaining energy in an electric vehicle.

Figure 25:
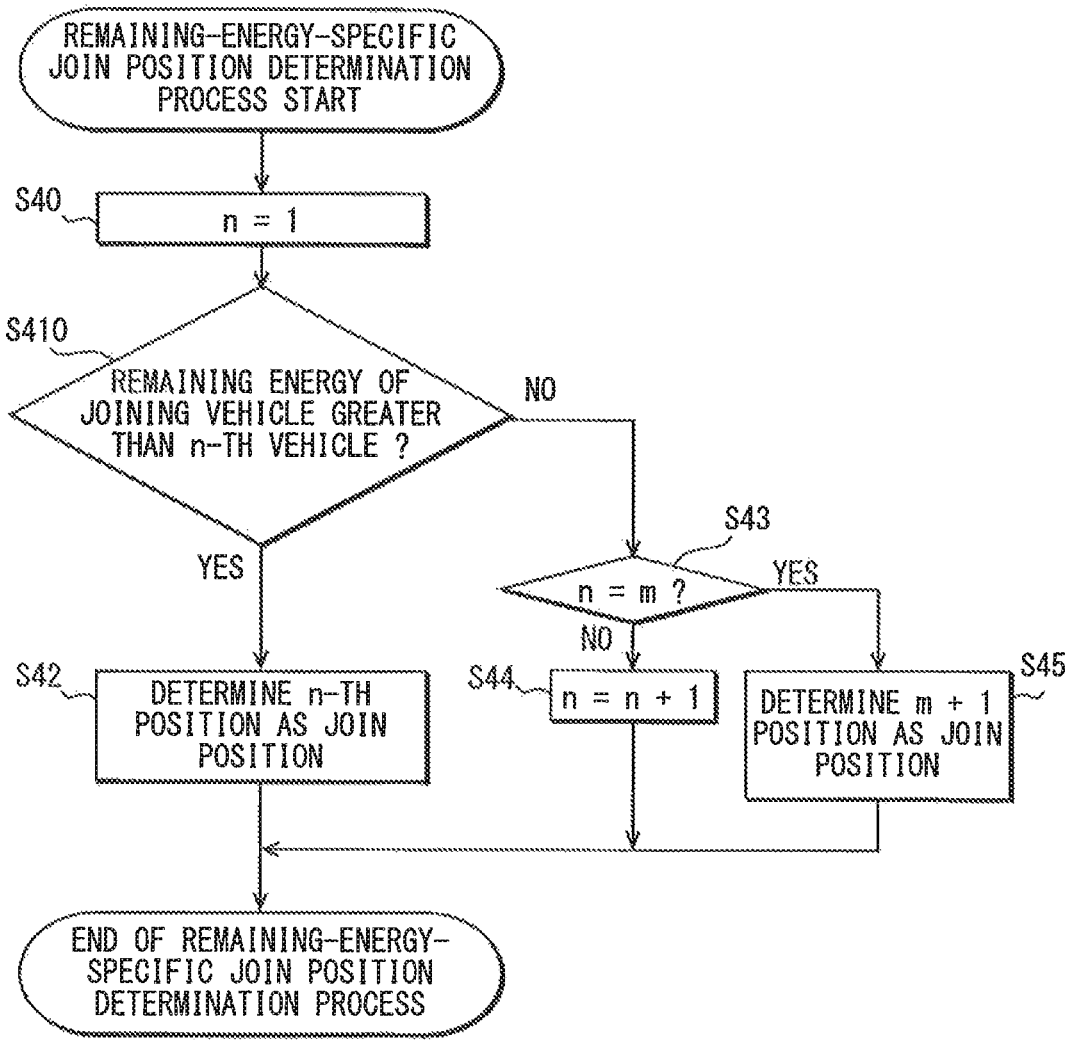
FIG. 25 is a flowchart of a remaining energy specific position determination process by the platoon travel controller in a fourth modification.

Here, with reference to FIG. 25, the final position determination process in the modification example 4 is explained. As a reminder, the final position determination process in the above-mentioned embodiment determines in Step S40 whether a depart point of the joining vehicle is either the same point as or nearer than a depart point of the n-th vehicle. On the other hand, the final position determination process in the modification example 4 determines in Step S410 whether the remaining fuel of the joining vehicle is larger than the remaining energy of the n-th vehicle. Therefore, in the flowchart of FIG. 25, the same contents of the final position determination process as the one in the above-mentioned embodiment have the some step numbers as FIG. 7, for the brevity of the explanation by avoiding the repetition.

In Step S410, the join-in processor 14 determines whether the remaining energy of the joining vehicle is larger than the remaining energy of the n-th vehicle. When it is determined that the remaining energy of the joining vehicle is larger than the n-th vehicle, the process proceeds to Step S42, and, when it is determined that the remaining energy of the joining vehicle is not larger than the remaining energy of the n-th vehicle, the process proceeds to Step S43.

In such manner, the platoon travel system positions, in the first vehicle group that is a top group of the platoon, a vehicle having larger remaining energy at a closer-to-platoon-front position, that is, the larger remaining energy vehicles come forward in the travel direction (i.e., come closer to a top) in the platoon. Further, the platoon travel system positions, in the second vehicle group that is a tail end group of the platoon, a vehicle having smaller remaining energy at a closer-to-platoon-front position, that is, the smaller remaining energy vehicles come forward in the travel direction (i.e., come closer to a top) in the platoon.

The travel resistance for each of the platoon vehicles is smaller for the vehicle in the middle of the platoon than for the top vehicle or for the tail end vehicle of the platoon. Therefore, by positioning the smaller remaining energy vehicles in the middle of the platoon, a travelable distance of each of such vehicles (i.e., traveling in a middle of the platoon vehicles) can be extended.

In case that a platoon includes three types of vehicles respectively forming separate vehicle groups, the platoon travel system positions, in the third vehicle group that is configured to be positioned in between the first vehicle group and the second vehicle group, a vehicle having the larger remaining energy at a position closer to platoon front, that is, the larger remaining energy vehicles come forward in the travel direction (i.e., come closer to a top) in the platoon.

Modification Example 5

In the final position determination process of the above-mentioned embodiment and the modification example 1, the join position is determined based on a depart point of the joining vehicle and a depart point of each of the platoon vehicles. However, the present disclosure is not limited to such configuration. As shown in the modification example 5, in the final position determination process, a join position may be determined based on the travel output of the joining vehicle and the travel output of the each of the platoon vehicles. The platoon travel system in the modification example 5 is mostly the same as the one in the above-mentioned embodiment. Here, description is focused to the difference of the processing operation of the platoon travel system in the modification example 3 from the one in the above-mentioned embodiment.

The platoon travel system in the modification example 5 differs from the one in the above-mentioned embodiment on the following points. That is, the differences are: (i) an input of information which shows the travel output of the self-vehicle to the ECU 10 (i.e., the join-in processor 14), (ii) a transmission and a reception of the information which shows the travel output to and from the nearby vehicles, and (iii) the contents of the final position determination process. For example, in the modification example 5, the information (i.e., travel output information) which shows the travel output is acquired in Step S32 of FIG. 6.

A configuration for outputting the information which shows the travel output of the self-vehicle to the ECU 10 may be, for example, that the behavioral information sensor 70 stores the travel output of the self-vehicle and the sensor 70 outputs the travel output of the self-vehicle. A configuration for outputting the information which shows the travel output of the self-vehicle to the join-in processor 14 of the ECU 10 may be, for example, that a memory (e.g., ROM, RAM) of the ECU 10 memorizes the travel output of the self-vehicle and the memory of the ECU 10 outputs the memorized travel output of the self-vehicle.

Figure 26:
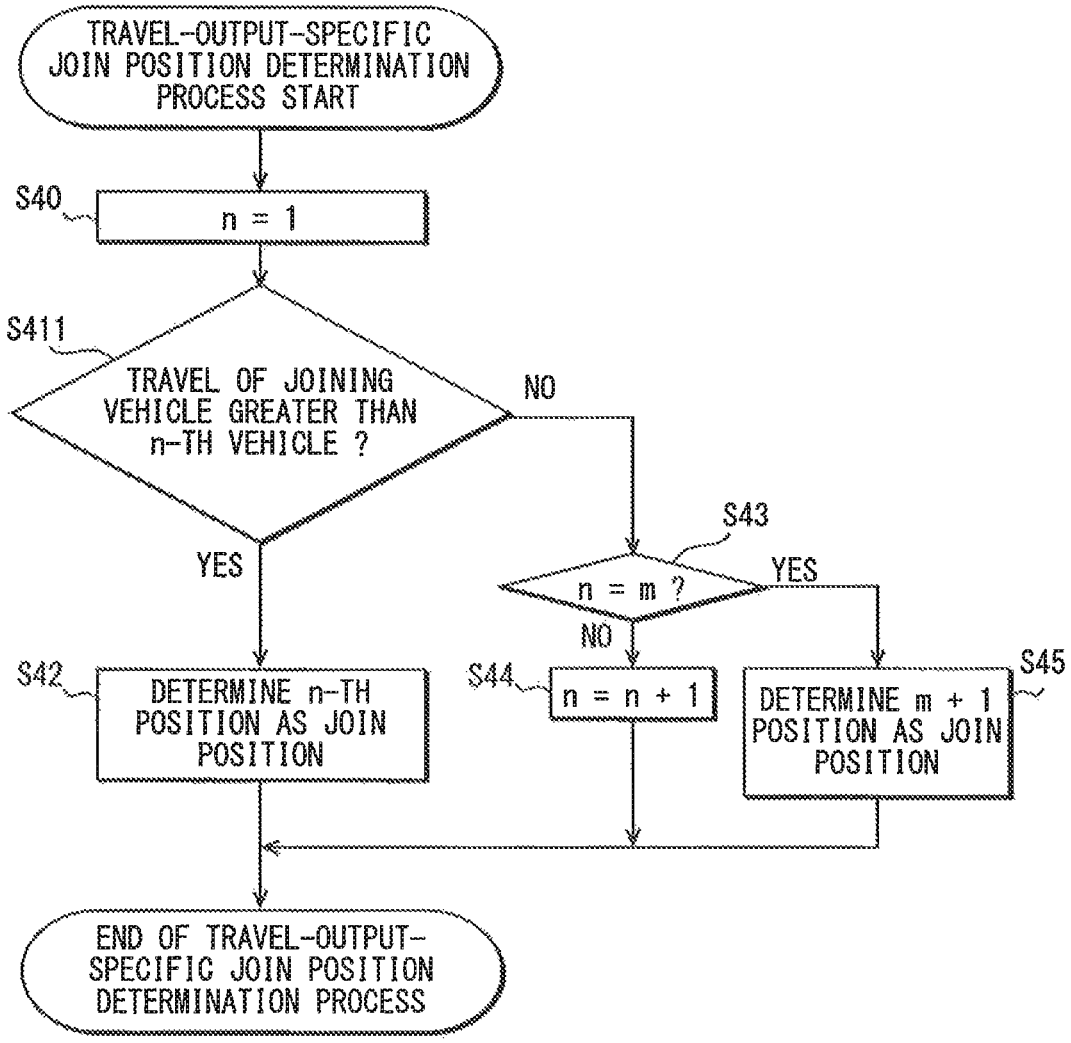
FIG. 26 is a flowchart of an output specific position determination process by the platoon travel controller in a fifth modification.

Here, with reference to FIG. 26, the final position determination process in the modification example 5 is explained. As a reminder, the final position determination process in the above-mentioned embodiment determines in Step S40 whether a depart point of the joining vehicle is either the same point as or nearer than a depart point of the n-th vehicle. On the other hand, the final position determination process in the modification example 5 determines in Step S411 whether the travel output of the joining vehicle is higher than the travel output of the n-th vehicle. Therefore, in the flowchart of FIG. 26, the same contents of the final position determination process as the one in the above-mentioned embodiment have the same step numbers as FIG. 7, for the brevity of the explanation by avoiding the repetition.

In Step S411, the join-in processor 14 determines whether the travel output of the joining vehicle is higher than the remaining energy of the n-th vehicle. When it is determined that the travel output of the joining vehicle is higher than the n-th vehicle, the process proceeds to Step S42, and, when it is determined that the travel output of the joining vehicle is not higher than the travel output of the n-th vehicle, the process proceeds to Step S43.

In such manner, the platoon travel system positions, in the first vehicle group that is a top group of the platoon, a vehicle having higher travel output at a closer-to-platoon-front position, that is, the higher travel output vehicles come forward in the travel direction (i.e., come closer to a top) in the platoon. Further, the platoon travel system positions, in the second vehicle group that is a tail end group of the platoon, a vehicle having lower travel output at a closer-to-platoon-front position, that is, the lower travel output vehicles come forward in the travel direction (i.e., come closer to atop) in the platoon.

The travel resistance for each of the platoon vehicles is smaller for the vehicle in the middle of the platoon than for the top vehicle or for the tail end vehicle of the platoon. Therefore, by positioning the lower travel output vehicles in the middle of the platoon, such vehicles traveling in the middle of the platoon can travel with lower energy. Therefore, deterioration of the energy consumption of the whole platoon is prevented. Further, by positioning high travel output vehicles at a top and at a tail end of the platoon, the platoon travel of the vehicles is made smoother and faster.

In case that a platoon includes three types of vehicles respectively forming separate vehicle groups, the platoon travel system positions, in the third vehicle group positioned in between the first vehicle group and the second vehicle group, a vehicle having higher travel output at a closer-to-platoon-front position, that is, the higher travel output vehicles come forward in the travel direction (i.e., come closer to a top) in the platoon.

Modification Example 6

Figure 27:
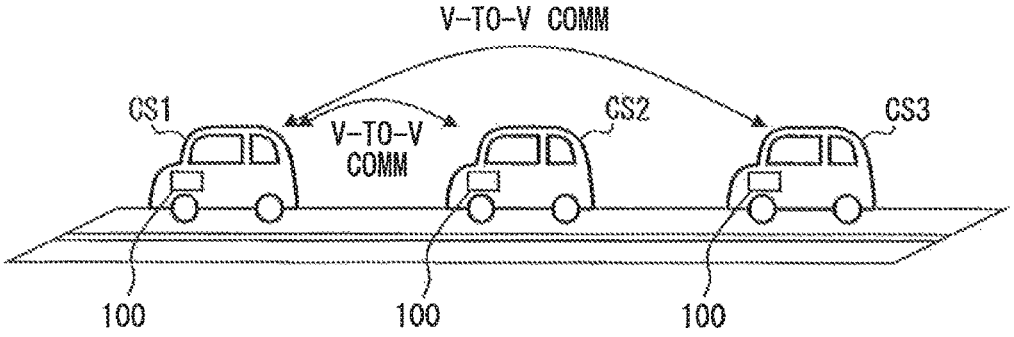
FIG. 27 is an illustration of the platoon travel system in a sixth modification.

The multi-master method is used in the above-mentioned embodiment and the like. However, the present disclosure is not limited to such configuration. A master-slave method may also be used in the platoon travel system of the present disclosure as shown in FIG. 27. Even when such master-slave method is used in the platoon travel system of the present disclosure, the same effect as the above-mentioned embodiment is achieved. However, the information regarding vehicle safety is exchanged among the platoon vehicles via the vehicle-to-vehicle communication between them. The information about vehicle safety is the information required for the prevention of the collision of the vehicles, such as the information which shows the inter-vehicle distance, the information which shows the change of the inter-vehicle distance, the brake information which shows the amount of press of a brake pedal, and the like.

In case that the master-slave method is used, the ECU 10 disposed in a master vehicle performs the join-in reception process, the departure reception process, and the platoon re-organization reception process described in the above (e.g., in FIG. 4). However, the synchronization process and the platoon join-in process of the join-in reception process are performed by the ECU 10 in the master vehicle, by the ECU 10 in slave vehicles, and by the ECU 10 in the joining vehicle. Further, the ECU 10 in the master vehicle, the ECU 10 in the slave vehicles, and the ECU 10 in a departing vehicle respectively perform the synchronization process and the platoon departure process of the departure reception process. Further, the ECU 10 in the master vehicle and the ECU 10 in the slave vehicles respectively perform the synchronization process and the platoon re-organization process of the platoon re-organization reception process.

Modification Example 7

Figure 28:
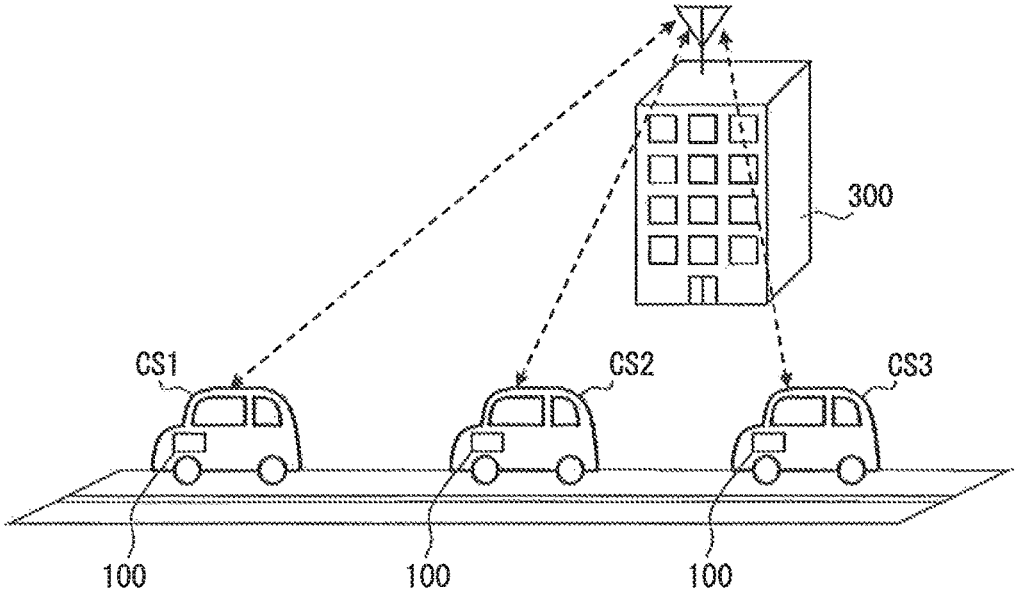
FIG. 28 is an illustration of the platoon travel system in a seventh modification.

The multi-master method is used in the above-mentioned embodiment and the like. However, the present disclosure is not limited to such configuration. As shown in FIG. 28, a data center method may also be used in the platoon travel system of the present disclosure. Even when the platoon travel system uses the data center method, the same effect as the above-mentioned embodiment is achieved. However, the information regarding vehicle safety is exchanged among the platoon vehicles via the vehicle-to-vehicle communication between them.

In case that the data center method is used, a data center 300 performs the join-in reception process, the departure reception process, and the platoon re-organization reception process described above (see FIG. 4 for example). However, the ECU 10 in the master vehicle, the ECU 10 in the slave vehicles, and the ECU 10 in the joining vehicle respectively perform the synchronization process and the platoon join-in process of the join-in reception process. Further, the ECU 10 in the master vehicle, the ECU 10 in the slave vehicles, and the ECU 10 in the departing vehicle respectively perform the synchronization process and the platoon departure process of the departure reception process. Further, the ECU 10 in the master vehicle and the ECU 10 in the slave vehicles perform the synchronization process and the platoon re-organization process of the platoon re-organization reception process.

The data center 300 is capable of performing the join-in reception process, the departure reception process, and the platoon re-organization reception process, and, in the data center 300, computers such as servers and the like that are installed. The servers in the data center 300 are capable of wirelessly communicating with the on-board unit of the vehicles that use the platoon travel system. Therefore, the computers in the data center 300 perform the join-in reception process, the departure reception process, and the platoon re-organization reception process. Further, in the data center method, the communication device 20 of the vehicles that use the platoon travel system is implemented as a device having a road-to-vehicle communication function for the communication with the data center 300.

Such changes, modifications, and summarized schemes are to be understood as being within the scope of the present disclosure as defined by appended claims.

What is claimed is:

1. A platoon travel system for organizing plural vehicles into platoon vehicles and performing a platoon travel of the platoon vehicles at a preset travel speed and a preset inter-vehicle distance from each other, the system comprising:

at least one processor located in an Engine Control Unit (ECU), the at least one processor is configured to:

(i) organize, in a platoon organization unit, a platoon by acquiring, from each of the plural vehicles, projection area information indicative of a projection area of each vehicle and (ii) position, from a front of the platoon, vehicles in a larger projection area vehicle first manner in which the vehicles are arranged in a descending order of the projection areas from the front of the platoon;

determine whether a particular departing vehicle is departing from the platoon;

determine whether a particular joining vehicle is joining in the platoon; and adjust, in an inter-vehicle distance adjustment unit, an inter-vehicle distance between the platoon vehicles at a vehicle joining time and at a vehicle departure time; the vehicle joining time defined as when the particular joining vehicle is determined to be joining in the platoon; in the vehicle joining time, the at least one processor is configured to adjust the inter-vehicle distance to the preset inter-vehicle distance by controlling, to be decelerated, deceleration target vehicles in the platoon which are traveling behind a particular join position that is reserved for the particular joining vehicle; and the vehicle departure time defined as when the particular departing vehicle is determined to be departing from the platoon; in the vehicle departure time, the at least one processor is configured to adjust the inter-vehicle distance to the preset inter-vehicle distance by controlling, to be decelerated, deceleration target vehicles in the platoon which are traveling ahead of the particular departing vehicle.

2. The platoon travel system of claim 1, wherein the at least one processor is further configured to:

acquire, in a first acquisition unit, in each of the platoon vehicles, the inter-vehicle distance to a front vehicle, wherein adjust, by the inter-vehicle distance adjustment unit, the inter-vehicle distance acquired by the first acquisition unit to the preset inter-vehicle distance.

3. The platoon travel system of claim 2, further comprising:

a first transmission unit, in each of the platoon vehicles, wherein the at least one processor is further configured to:

transmit, via the first transmission unit, in each of the platoon vehicles, the inter-vehicle distance acquired by the first acquisition unit to a just-ahead vehicle that is immediately ahead of a self-vehicle; and detect, by a departure detection unit, in each of the platoon vehicles, the particular departing vehicle in the platoon, wherein the inter-vehicle distance adjustment unit adjusts, by controlling, to be decelerated, a deceleration target vehicle which is the just-ahead vehicle that is detected by the departure detection unit as traveling immediately ahead of the particular departing vehicle, a transmitted inter-vehicle distance between the just-ahead vehicle of the particular departing vehicle and a just-behind vehicle that is immediately behind the particular departing vehicle which has been transmitted by the first transmission unit, to the preset inter-vehicle distance.

4. The platoon travel system of claim 2, wherein the at least one processor is further configured to transmit, via a first transmission unit, in each of the platoon vehicles, the inter-vehicle distance acquired by the first acquisition unit to a just-ahead vehicle that is immediately ahead of a self-vehicle; and detect, by a departure detection unit, in each of the platoon vehicles, t departing vehicle in the platoon, wherein the inter-vehicle distance adjustment unit adjusts, by controlling, to be decelerated, the deceleration target vehicles in the platoon which are traveling ahead of the particular departing vehicle, a transmitted inter-vehicle distance between each of the platoon vehicles which has been transmitted by the first transmission unit, to the preset inter-vehicle distance.

5. The platoon travel system of claim 4, wherein the at least one processor is further configured to adjust, by the inter-vehicle distance adjustment unit, when the inter-vehicle distance between the just-ahead vehicle of the particular departing vehicle and the just-behind vehicle of the particular departing vehicle becomes the preset inter-vehicle distance, the inter-vehicle distance between each of the platoon vehicles to the preset inter-vehicle distance by controlling a travel speed of each of the deceleration target vehicles to return to the preset travel speed.

6. The platoon travel system of claim 2, wherein the at least one processor is further configured to detect, by a join-in detection unit, in each of the platoon vehicles, the particular join position in the platoon, control, via the inter-vehicle distance adjustment unit to decelerate the deceleration target vehicles which are all vehicles in the platoon behind the particular join position detected by the join-in detection unit, the inter-vehicle distance between each of the platoon vehicles to the preset inter-vehicle distance while adjusting an inter-vehicle distance between a just-ahead vehicle immediately ahead of the particular join position and a just-behind vehicle that is immediately behind the particular join position to a join-in allow distance.

7. The platoon travel system of claim 3, further comprising:

a second acquisition unit, in each of the platoon vehicles, wherein the at least one processor is further configured to:

acquire, via the second acquisition unit, the inter-vehicle distance to a behind vehicle located behind the self vehicle, wherein the inter-vehicle distance adjustment unit adjusts the inter-vehicle distance acquired by the second acquisition unit to the preset inter-vehicle distance.

8. The platoon travel system of claim 7, further comprising:

a second transmission unit, in each of the platoon vehicles, wherein the at least one processor is further configured to:

transmit, via the second transmission unit, in each of the platoon vehicles, the inter-vehicle distance acquired by the second acquisition unit to a just-behind vehicle that is immediately behind a self-vehicle; and detect, via a join-in detection unit, in each of the platoon vehicles, the particular join position in the platoon, wherein the inter-vehicle distance adjustment unit adjusts, by decelerating the deceleration target vehicle which is a just-behind position vehicle that is detected by the join-in detection unit as traveling immediately behind the particular join position, a transmitted inter-vehicle distance between a just-ahead in position vehicle and a just-behind join position vehicle to a join-in allow distance that allows the join-in of the particular joining vehicle.

9. The platoon travel system of claim 8, wherein the at least one processor is further configured to adjust, by the inter-vehicle distance adjustment unit, by controlling to be decelerated, the deceleration target vehicles which are all vehicles in the platoon behind the particular join position, the transmitted inter-vehicle distance between each of the platoon vehicles, which has been transmitted by the second transmission unit, to the preset inter-vehicle distance while adjusting the transmitted inter-vehicle distance between the just-ahead join position vehicle and the just-behind join position vehicle to the join-in allow distance.

10. The platoon travel system of claim 9, wherein the processor is further configured to adjust, by the inter-vehicle distance adjustment unit, when the inter-vehicle distance between the just-ahead join position vehicle and the just-behind join position vehicle becomes the join-in allow distance, the inter-vehicle distance between each of the platoon vehicles to the preset inter-vehicle distance by returning a travel speed of each of the deceleration target vehicles to the preset travel speed.

11. The platoon travel system of claim 7, wherein the at least one processor is further configured to detect, by a departure detection unit, in each of the platoon vehicles, the particular departing vehicle in the platoon, wherein the inter-vehicle distance adjustment unit adjusts, by decelerating the deceleration target vehicles which are all platoon vehicles ahead of the particular departing vehicle that is detected by the departure detection unit, the inter-vehicle distance between each of the platoon vehicles to the preset distance while adjusting the inter-vehicle distance which has been increased by the departure of the particular departing vehicle back to the preset inter-vehicle distance.

12. The platoon travel system of claim 1, wherein the inter-vehicle distance adjustment unit is further configured to create, in a creation unit, deceleration plan information for decelerating the deceleration target vehicles, share, by a share unit, the deceleration plan information among the deceleration target vehicles, and decelerate, by a deceleration unit, the deceleration target vehicles according to the deceleration plan information while synchronizing the deceleration target vehicles with each other.

13. The platoon travel system of claim 12, wherein the deceleration plan information includes (i) deceleration start time information indicative of a speed reduction start time when deceleration of a vehicle speed starts, (ii) return start time information indicative of a return start time when returning of the vehicle speed to a pre-deceleration speed starts, and (iii) return end time information indicative of a return end time when returning of the vehicle speed to the pre-deceleration speed ends.

14. The platoon travel system of claim 1, wherein the at least one processor is further configured to determine the positioning, from the front of the platoon, of the vehicles in the larger projection area vehicle first manner based on the projection area information of the plural vehicles.

15. The platoon travel system of claim 1, further comprising a wireless short-range antenna in each of the plural vehicles in the platoon, and the at least one processor is in a self-vehicle, the at least one processor is further configured to communicate, via the wireless short-range antenna, with the plural vehicles in the platoon, to acquire the projection area information of each vehicle, and communicate, via the wireless short-range antenna, with the plural vehicles in the platoon, deceleration plan information to deceleration target vehicles in the platoon which are traveling, and control, responsive to deceleration plan information that specifies a deceleration of the self-vehicle, a travel system component which comprises a drive, an engine, a motor generator, and a brake to decelerate the self-vehicle.

16. The platoon travel system of claim 13, further comprising a wireless short-range antenna in each of the plural vehicles in the platoon, and the at least one processor is in a self-vehicle, the at least one processor is further configured to communicate, via the wireless short-range antenna, with the plural vehicles in the platoon, to acquire the projection area information of each vehicle, and communicate, via the wireless short-range antenna, with the plural vehicles in the platoon, the deceleration plan information which has been created to deceleration target vehicles in the platoon which are traveling, and control, responsive to deceleration plan information that specifies a deceleration of the self-vehicle, a travel system component which comprises a drive, an engine, a motor generator, and a brake to: (i) decelerate the self-vehicle at the speed reduction start time, (ii) start returning the self-vehicle to the pre-deceleration speed at the return start time, and (iii) end returning the self-vehicle to the pre-deceleration speed at the return end time.

17. The platoon travel system of claim 1, further comprising:

a wireless short-range antenna in each of the plural vehicles in the platoon; and a first information sensor, in a self-vehicle, that detects the inter-vehicle distance to a front vehicle before the self-vehicle;

wherein the at least one processor is in the self-vehicle, the at least one processor is further configured to receive, via the wireless short-range antenna, a join-in allow distance;

acquire, from the first information sensor, the inter-vehicle distance to the front vehicle, control, responsive to the join-in allow distance received via the wireless short-range antenna, a travel system component which comprises a drive, an engine, a motor generator, and a brake to: (i) decelerate the self-vehicle to adjust the inter-vehicle distance to the join-in allow distance, (ii) return the self-vehicle to the pre-set travel speed when the inter-vehicle distance acquired from the first information sensor becomes the join-in allow distance.

* * * * *